US011695222B2

(12) United States Patent
Mahanfar et al.

(10) Patent No.: US 11,695,222 B2
(45) **Date of Patent: *Jul. 4, 2023**

(54) ANTENNA APERTURE IN PHASED ARRAY ANTENNA SYSTEMS

(71) Applicant: Space Exploration Technologies Corp., Hawthorne, CA (US)

(72) Inventors: Alireza Mahanfar, Kirkland, WA (US); Javier Rodriguez De Luis, Kirkland, WA (US); Nil Apaydin, Kirkland, WA (US); Ersin Yetisir, Redmond, WA (US); Shaya Karimkashi Arani, Glendale, CA (US)

(73) Assignee: Space Exploration Technologies Corp., Hawthorne, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/339,913

(22) Filed: Jun. 4, 2021

(65) Prior Publication Data

US 2021/0296789 A1 Sep. 23, 2021

Related U.S. Application Data

(63) Continuation of application No. 16/276,294, filed on Feb. 14, 2019, now Pat. No. 11,056,801.

(60) Provisional application No. 62/631,689, filed on Feb. 17, 2018, provisional application No. 62/631,195, filed on Feb. 15, 2018.

(51) Int. Cl.

| | |
|---|---|
| ***H01Q 21/00*** | (2006.01) |
| ***H01Q 21/24*** | (2006.01) |
| ***H01Q 1/36*** | (2006.01) |

(52) U.S. Cl.

CPC ..... *H01Q 21/24* (2013.01); *H01Q 1/36* (2013.01); *H01Q 21/0018* (2013.01)

(58) Field of Classification Search

CPC .. H01Q 1/36; H01Q 3/30; H01Q 3/36; H01Q 21/22; H01Q 21/24; H04B 7/0617; H04B 7/086

See application file for complete search history.

(56) References Cited

U.S. PATENT DOCUMENTS 5,122,806 A 6/1992 Julian
6,167,286 A * 12/2000 Ward ..... H04B 7/086 455/562.1

(Continued)

OTHER PUBLICATIONS

International Search Report and Written Opinion dated Jun. 5, 2019, issued in corresponding International Application No. PCT/US2019/018071, filed Feb. 14, 2019, 16 pages.

(Continued)

*Primary Examiner* — Tung X Le
(74) *Attorney, Agent, or Firm* — Polsinelli PC

(57) ABSTRACT

In some embodiments, a phased array antenna includes a carrier; a first plurality of antenna elements carried by the carrier and configured to transmit and/or receive signals at a first value of a parameter, and a second plurality of antenna elements carried by the carrier and configured to transmit and/or receive signals at a second value of the parameter different from the first value of the parameter. The antenna elements of the first plurality of antenna elements and the second plurality of antenna elements are located within a common aperture of the phased array antenna.

23 Claims, 40 Drawing Sheets

(56) References Cited

U.S. PATENT DOCUMENTS

| | | | | |
|---|---|---|---|---|
| 7,466,287 | B1 | 12/2008 | Lam et al. | |
| 9,379,437 | B1 | 6/2016 | Stutzke et al. | |
| 10,141,993 | B2 | 11/2018 | Lee et al. | |
| 10,333,633 | B2 * | 6/2019 | Petersson | H04B 7/0617 |
| 2001/0018327 | A1 | 8/2001 | Houston et al. | |
| 2003/0076274 | A1 | 4/2003 | Phelan et al. | |
| 2003/0151550 | A1 * | 8/2003 | Chen | H04B 7/2041 342/372 |
| 2007/0063898 | A1 | 3/2007 | Phelan et al. | |
| 2008/0278370 | A1 * | 11/2008 | Lachner | G01S 13/87 342/200 |
| 2008/0291101 | A1 | 11/2008 | Braunstein et al. | |
| 2008/0297414 | A1 | 12/2008 | Krishnaswamy et al. | |
| 2009/0009392 | A1 * | 1/2009 | Jacomb-Hood | H01Q 1/288 342/374 |
| 2010/0026574 | A1 * | 2/2010 | Pozgay | H01Q 3/36 342/371 |
| 2013/0106641 | A1 * | 5/2013 | Warke | H04L 27/0014 342/21 |
| 2013/0127682 | A1 | 5/2013 | MacManus et al. | |
| 2014/0203969 | A1 * | 7/2014 | Maltsev | H04B 7/0617 342/385 |
| 2016/0204508 | A1 | 7/2016 | Christopher | |
| 2017/0163326 | A1 * | 6/2017 | Kim | H04B 7/0697 |
| 2017/0271776 | A1 | 9/2017 | Biancotto et al. | |

OTHER PUBLICATIONS

International Search Report and Written Opinion dated Jun. 7, 2019, issued in corresponding International Application No. PCT/US2019/018064, filed Feb. 14, 2019, 11 pages.

* cited by examiner

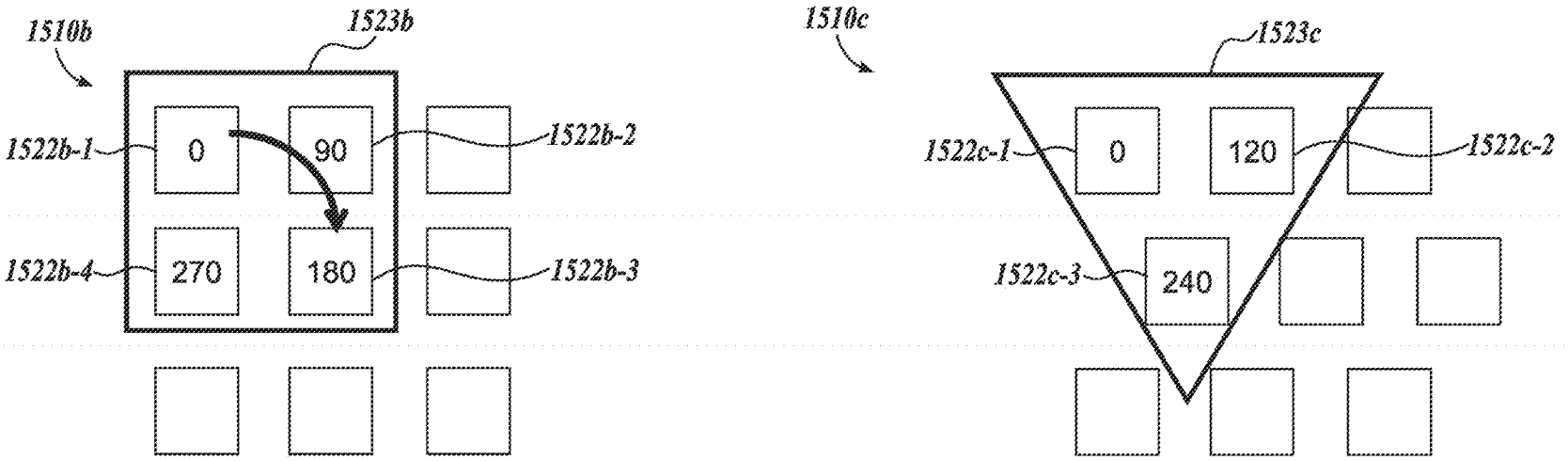
FIG. 15B
FIG. 15C
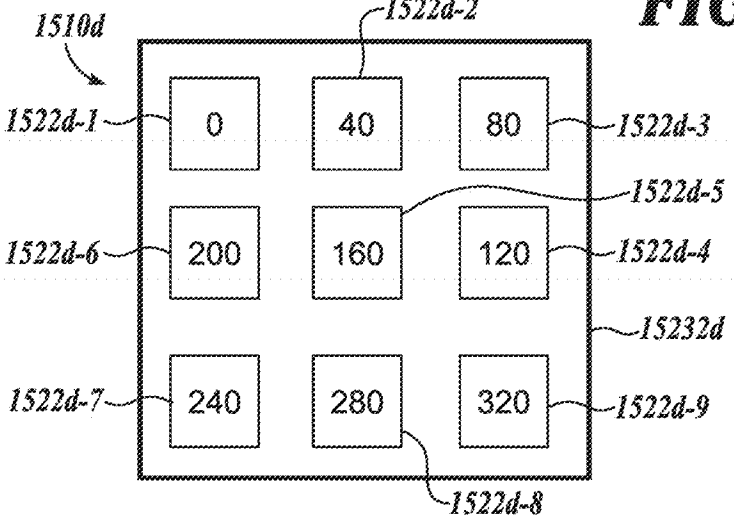
FIG. 15D

ANTENNA APERTURE IN PHASED ARRAY ANTENNA SYSTEMS

CROSS-REFERENCES TO RELATED APPLICATIONS

This application is a continuation of U.S. application Ser. No. 16/276,294, filed Feb. 14, 2019, which claims the benefit of U.S. Provisional Application Nos. 62/631,195, filed Feb. 15, 2018, and 62/631,689, filed Feb. 17, 2018, the disclosures all of which are hereby expressly incorporated by reference herein in their entirety.

BACKGROUND

An antenna (such as a dipole antenna) typically generates radiation in a pattern that has a preferred direction. For example, the generated radiation pattern is stronger in some directions and weaker in other directions. Likewise, when receiving electromagnetic signals, the antenna has the same preferred direction. Signal quality (e.g., signal to noise ratio or SNR), whether in transmitting or receiving scenarios, can be improved by aligning the preferred direction of the antenna with a direction of the target or source of the signal. However, it is often impractical to physically reorient the antenna with respect to the target or source of the signal. Additionally, the exact location of the source/target may not be known. To overcome some of the above shortcomings of the antenna, a phased array antenna can be formed from a set of antenna elements to simulate a large directional antenna. An advantage of a phased array antenna is its ability to transmit and/or receive signals in a preferred direction (e.g., the antenna's beamforming ability) without physical repositioning or reorientating.

It would be advantageous to configure phased array antennas having increased bandwidth while maintaining a high ratio of the main lobe power to the side lobe power. Likewise, it would be advantageous to configure phased array antennas having reduced weight, reduced size, lower manufacturing cost, and/or lower power requirements. Accordingly, embodiments of the present disclosure are directed to these and other improvements in phase array antennas or portions thereof.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a phased array antenna system is provided. The system includes: a first portion carrying an antenna lattice including a plurality of antenna elements, wherein the plurality of antenna elements are arranged in a first configuration, wherein the first configuration is a space tapered configuration; and a second portion carrying a beamformer lattice including a plurality of beamformer elements, wherein the plurality of beamformer elements are arranged in a second configuration different from the first configuration, wherein each of the plurality of antenna elements are electrically coupled by mapping to one of the plurality of beamformer elements.

In accordance with another embodiment of the present disclosure, a phased array antenna system is provided. The system includes: a carrier; an antenna lattice including a plurality of antenna elements supported by the carrier, the antenna lattice having a space tapered configuration; a beamformer lattice including a plurality of beamformer elements supported by the carrier having a configuration different from the antenna lattice configuration, wherein at least one of the beamformer elements is laterally displaced from at least one of the antenna elements; and mapping for electrically coupling the antenna lattice to the beamformer lattice.

In accordance with another embodiment of the present disclosure, an antenna lattice for a phased array antenna system is provided. The antenna lattice includes: a plurality of antenna elements configured in a space tapered configuration; and mapping from each of the plurality of antenna elements to one of a plurality of other elements, wherein the plurality of other elements are in a configuration different from the space tapered configuration of the antenna lattice.

In accordance with another embodiment of the present disclosure, a phased array antenna system is provided. The system includes a first portion carrying an antenna lattice including a plurality of antenna elements, wherein the plurality of antenna elements are arranged in a first configuration wherein the first configuration is a space tapered configuration; and a second portion carrying a beamformer lattice including a plurality of beamformer elements, wherein the plurality of beamformer elements are arranged in a second configuration different from the first configuration, wherein at least one of the plurality of antenna elements is laterally spaced from a corresponding one of the plurality of beamformer elements, wherein each of the plurality of antenna elements are electrically coupled to one of the plurality of beamformer elements.

In any of the embodiments described herein, the antenna lattice may include a first antenna element, a second antenna element and a third antenna element, wherein the first, second and third antenna elements are distributed between a center and a periphery of the carrier, with the first antenna element being closest to the center, the third antenna element being furthest from the center, and the second antenna element being positioned between the first and third antenna elements, wherein the first antenna element and the second antenna elements are separated by a first distance, and the second antenna element and the third antenna element are separated by a second distance different than the first distance, and wherein the second antenna element is the closest element along a line to both of the first antenna element and the third antenna element.

In any of the embodiments described herein, the first antenna element may be one of a plurality of the antenna elements of a first arrangement of antenna elements, the second antenna element may be one of a plurality of the antenna elements of a second arrangement of the antenna elements, and the third antenna element may be one of a plurality of the antenna elements of a third arrangement of the antenna elements, wherein areas between the first and the second arrangements, and between the second and the third arrangements may be free of the antenna elements.

In any of the embodiments described herein, the first, the second, and the third arrangements of the antenna elements may be in substantially circular patterns.

In any of the embodiments described herein, the first, the second, and the third arrangements of the antenna elements may be in substantially rectangular patterns.

In any of the embodiments described herein, the first, the second, and the third arrangements of the antenna elements may be in sunflower patterns.

In any of the embodiments described herein, the first, the second, and the third arrangements of the antenna elements may be in concentric or non-concentric patterns.

In any of the embodiments described herein, the first, the second, and the third antenna elements may be arranged along the same line from the center to the periphery of the carrier.

In any of the embodiments described herein, the first, the second and the third antenna elements may be configured to transmit signals at the same frequency.

In any of the embodiments described herein, at least two of the first, the second and the third antenna elements may be configured to transmit signals at different frequency.

In any of the embodiments described herein, the first, the second and the third antenna elements may be configured to emit signals at the same polarization.

In any of the embodiments described herein, the first, the second and the third antenna elements may be configured to emit signals at different polarization.

In any of the embodiments described herein, the second configuration may be an organized or evenly spaced configuration.

In any of the embodiments described herein, at least one of the plurality of beamformer elements in the beamformer lattice may be laterally displaced from at least one of the plurality of antenna elements in the antenna lattice.

In any of the embodiments described herein, the first and second portions may define at least a portion of a carrier.

In any of the embodiments described herein, the carrier may have a first side facing in a first direction and a second side facing in a second direction away from the first direction.

In any of the embodiments described herein, wherein the antenna lattice may be on the first side of the carrier.

In any of the embodiments described herein, the beamformer lattice may be on the second side of the carrier.

In any of the embodiments described herein, the antenna elements and the beamformer elements may be in a 1:1 ratio.

In any of the embodiments described herein, the antenna elements and the beam former elements may be in a greater than 1:1 ratio.

In any of the embodiments described herein, the first and second portions are first and second layers.

In any of the embodiments described herein, the embodiments may include a third layer disposed between the first portion and the second portion carrying at least a portion of a mapping between the plurality of antenna elements and the plurality of beamformer elements.

In any of the embodiments described herein, the first, second, and third layers may be discrete PCB layers in a PCB stack.

In any of the embodiments described herein, at least some antenna elements of the plurality of antenna elements may be physically rotated relative to other antenna elements of the plurality of antenna elements.

In accordance with another embodiment of the present disclosure, a phased array antenna is provided. The phased array antenna includes: a carrier; a first plurality of antenna elements carried by the carrier and configured to transmit and/or receive signals at a first value of a parameter; and a second plurality of antenna elements carried by the carrier and configured to transmit and/or receive signals at a second value of the parameter different from the first value of the parameter, wherein individual antenna elements of the first plurality of antenna elements are interspersed with individual antenna elements of the second plurality of antenna elements.

In accordance with another embodiment of the present disclosure, a method of generating a layout for antenna elements of a phased array antenna is provided. The method includes: generating a first arrangement of a first plurality of antenna elements, wherein the antenna elements of the first plurality are configured to transmit and/or receive signals at a first value of a parameter; and generating a second arrangement of a second plurality of antenna elements, wherein the antenna elements of the second plurality are configured to transmit and/or receive signals at a second value of the parameter different from the first value of the parameter, and wherein individual antenna elements of the first plurality of antenna elements are interspersed with individual antenna elements of the second plurality of antenna elements.

In accordance with another embodiment of the present disclosure, a method of using a phased array antenna is provided. The method includes receiving or transmitting a first signal at a first value of a parameter using a first plurality of antenna elements of the phased array antenna; and receiving or transmitting a second signal at a second value of the parameter different from the first value of the parameter using a second plurality of antenna elements of the phased array antenna, wherein individual antenna elements of the first plurality of antenna elements are interspersed with individual antenna elements of the second plurality of antenna elements.

In any of the embodiments described herein, the parameter may be selected from a group consisting of frequency, polarization, beam orientation, data streams, time multiplexing segments, and combinations thereof.

In any of the embodiments described herein, the parameter may be a first parameter, and the antenna may further include a third plurality of antenna elements carried by the carrier and configured to transmit and/or receive signals at a third value of the first parameter different from the first and second values of the first parameter, wherein individual antenna elements of the first, second, and third pluralities of antenna elements may be interspersed.

In any of the embodiments described herein, embodiments may further include a fourth plurality of antenna elements carried by the carrier and configured to transmit and/or receive signals at a fourth value of the first parameter different from the first, second, and third values of the first parameter, wherein individual antenna elements of the first, second, third and fourth pluralities of antenna elements may be interspersed.

In any of the embodiments described herein, the antenna elements of the first and second pluralities of antenna elements may be configured to transmit and/or receive signals at least in part during the same period of time.

In any of the embodiments described herein, the antenna elements of the first plurality may be distributed in a first arrangement, and the antenna elements of the second plurality are distributed in a second arrangement.

In any of the embodiments described herein, the first arrangement and the second arrangement may be in circular or rectangular configurations.

In any of the embodiments described herein, the first arrangement and the second arrangement may be in concentric or non-concentric configurations.

In any of the embodiments described herein, the first arrangement and/or the second arrangement may be in space tapered arrangements.

In any of the embodiments described herein, the first arrangement may receive or transmit a first beam in a first direction and the second arrangement may receive or transmit a second beam in a second direction.

In any of the embodiments described herein, the parameter may be selected from a group consisting of frequency, polarization, beam orientation, data streams, time multiplexing segments, and combinations thereof.

In any of the embodiments described herein, embodiments may further include determining one or more measures of phased array antenna performance for the antenna elements of the first and second pluralities, wherein the measures are selected from a group consisting of scattering parameters ($S_{LL}$), sidelobe level, gain, directivity, beam width, and scan range, comparing at least one measure to a predetermined threshold, and determining whether the first and second arrangements met the threshold.

In any of the embodiments described herein, embodiments may further include determining that at least one of the first and second arrangements do not meet the threshold, and changing a distance between the first and second arrangements.

In any of the embodiments described herein, embodiments may further include determining that at least one of the first and second arrangements do not meet the threshold, and changing a distance between individual antenna elements of the first and second arrangements.

In any of the embodiments described herein, the first arrangement and the second arrangement may be configured to collectively transmit and/or receive two beams in two different directions.

In any of the embodiments described herein, the first and the second arrangements of the antenna elements may be in circular or rectangular configurations.

In any of the embodiments described herein, the first and the second arrangements of the antenna elements may be in concentric or non-concentric configurations.

In any of the embodiments described herein, the first arrangement and/or the second arrangement may be in space tapered arrangements.

In any of the embodiments described herein, embodiments may further include generating a third arrangement of a third plurality of antenna elements, wherein the antenna elements of the third plurality are configured to transmit and/or receive signals at a third value of the parameter different from the first and second values of the parameter, and wherein individual antenna elements of the first, second, and third pluralities of antenna elements may be interspersed.

In any of the embodiments described herein, embodiments may further include generating a fourth arrangement of a fourth plurality of antenna elements, wherein the antenna elements of the fourth plurality are configured to transmit and/or receive signals at a fourth value of the parameter different from the first, second and third values of the parameter, and wherein individual antenna elements of the first, second, third and fourth pluralities of antenna elements may be interspersed.

In any of the embodiments described herein, the parameter may be selected from a group consisting of frequency, polarization, beam orientation, data streams, time multiplexing segments, and combinations thereof.

In any of the embodiments described herein, the antenna elements of the first and second pluralities of antenna elements may be configured to transmit and/or receive signals at least partly during the same period of time.

In any of the embodiments described herein, the antenna elements of the first plurality may be distributed in a first arrangement, and the antenna elements of the second plurality may be distributed in a second arrangement.

In any of the embodiments described herein, the first arrangement and the second arrangement may be configured to collectively transmit and/or receive two beams in two different directions.

In any of the embodiments described herein, embodiments may further include receiving or transmitting a third signal at a third value of a first parameter using a third plurality of antenna elements of the phased array antenna, wherein individual antenna elements of the first, second, and third pluralities of antenna elements are interspersed.

In any of the embodiments described herein, embodiments may further include receiving or transmitting a fourth signal at a fourth value of a first parameter using a fourth plurality of antenna elements of the phased array antenna, wherein individual antenna elements of the first, second, third and fourth pluralities of antenna elements are interspersed.

In accordance with one embodiment of the present disclosure a phased array antenna is provided. The phased array antenna includes: an antenna lattice disposed on a carrier, the antenna lattice including a plurality of antenna elements arranged in an antenna lattice configuration, wherein at least some antenna elements of the plurality of antenna elements are physically rotated relative to other antenna elements of the plurality of antenna elements.

In any of the embodiments described herein, wherein at least a portion of the antenna lattice configuration is a circular pattern defining a plurality of ring arrangements of antenna elements.

In any of the embodiments described herein, at least a portion of the antenna lattice configuration may be a space tapered configuration.

In any of the embodiments described herein, at least a portion of the antenna lattice configuration may be a 2-D array.

In any of the embodiments described herein, a sub-set of the plurality of antenna elements in the antenna lattice may be grouped in a grouping, and wherein the antenna elements in the grouping may be physically rotated relative to adjacent antenna elements in the grouping by a determined degree of rotation.

In any of the embodiments described herein, the antenna elements in the grouping may be electrically excited by an electrical phase shift equal to the determined degree of rotation.

In any of the embodiments described herein, the grouping may be adjacent relationships between all the antenna elements within a specific area on the carrier, and wherein the determined degree of rotation between adjacent antenna elements may be equal to 360 divided by the number of antenna elements.

In any of the embodiments described herein, the grouping may be a ring arrangement of antenna elements, and wherein the degree of angular rotation may be equal to the angular distance between adjacent antenna elements in the ring arrangement.

In any of the embodiments described herein, wherein the grouping may include adjacent relationships between all the antenna elements within a specific area on the carrier, and wherein the determined degree of rotation between adjacent antenna elements may be equal to 360 divided by the number of antenna elements, wherein the grouping may be a ring arrangement of antenna elements with other groupings, and wherein the degree of angular rotation of the grouping is equal to the angular distance between adjacent groupings in the ring arrangement.

In accordance with another embodiment of the present disclosure, a phased array antenna is provided. The phased array antenna includes a carrier; a first plurality of antenna elements carried by the carrier and configured to transmit and/or receive signals at a first value of a parameter; and a second plurality of antenna elements carried by the carrier and configured to transmit and/or receive signals at a second value of the parameter different from the first value of the parameter. The antenna elements of the first plurality of antenna elements and the second plurality of antenna elements are located within a common aperture of the phased array antenna.

In accordance with another embodiment of the present disclosure, a phased array antenna system is provided. The phased array antenna system includes a carrier; a first plurality of antenna elements carried by the carrier and configured to transmit signals; and a second plurality of antenna elements carried by the carrier and configured to receive signals, wherein antenna elements of the first plurality of antenna elements and the second plurality of antenna elements are located within a common aperture of the phased array antenna system. In any of the embodiments described herein, individual antenna elements of the first plurality of antenna elements and the second array of antenna elements are interspersed.

In any of the embodiments described herein, individual antenna elements of the first plurality of antenna elements and the second array of antenna elements are interspersed.

In any of the embodiments described herein, the first value of the parameter is a first frequency and the first plurality of antenna elements is configured to transmit signals at the first frequency, and wherein the second value of the parameter is a second frequency, different from the first frequency, and the second plurality of antenna elements is configured to receive signals at the second frequency.

In any of the embodiments described herein, the parameter is selected from a group consisting of frequency, polarization, beam orientation, data streams, time multiplexing segments, and combinations thereof.

In any of the embodiments described herein, embodiments may further include a third plurality of antenna elements carried by the carrier and configured to transmit and/or receive signals at a third value of the parameter different from the first and second values of the parameter, wherein individual antenna elements of the first, second, and third pluralities of antenna elements are interspersed.

In any of the embodiments described herein, the antenna elements of the first and second pluralities of antenna elements are configured to transmit and/or receive signals at least in part during a same period of time.

In any of the embodiments described herein, the antenna elements of the first plurality are distributed in a first arrangement, and the antenna elements of the second plurality are distributed in a second arrangement.

In any of the embodiments described herein, the first arrangement and the second arrangement are in circular or rectangular configurations.

In any of the embodiments described herein, the first arrangement and the second arrangement are concentric configurations.

In any of the embodiments described herein, the first arrangement and the second arrangement are non-concentric configurations.

In any of the embodiments described herein, the first arrangement and/or the second arrangement are in space tapered arrangements.

In any of the embodiments described herein, the first arrangement receives or transmits a first beam in a first direction and the second arrangement receives or transmits a second beam in a second direction.

In any of the embodiments described herein, the first plurality of antenna elements is included in a first array of antenna elements including N antenna elements and the second plurality of antenna elements is included in in a second array of antenna elements including M antenna elements, wherein N and M are different.

In any of the embodiments described herein, the first array of antenna elements occupies a first area within the common aperture and the second array of antenna elements occupies a second area within the common aperture and wherein the first area is contained within the second area.

In any of the embodiments described herein, the first plurality of antenna elements is included in a first array of antenna elements configured to transmit signals at a first frequency and the second plurality of antenna elements is included in a second array of antenna elements configured to receive signals at a second frequency, different from the first frequency.

In any of the embodiments described herein, the first array of antenna elements includes N antenna elements and the second array of antenna elements includes M antenna elements.

In any of the embodiments described herein, N and M are different.

In any of the embodiments described herein, the first array of antenna elements occupies a first area within the common aperture and the second array of antenna elements occupies a second area within the common aperture and wherein the first area is contained within the second area.

In accordance with another embodiment of the present disclosure, a method of using a phased array antenna is provided. The method includes receiving or transmitting a first signal at a first value of a parameter using a first plurality of antenna elements of the phased array antenna; and receiving or transmitting a second signal at a second value of the parameter different from the first value of the parameter using a second plurality of antenna elements of the phased array antenna, wherein antenna elements of the first plurality of antenna elements and the second plurality of antenna elements are located within a common aperture of the phased array antenna.

In any of the embodiments described herein, the first plurality of antenna elements and the second array of antenna elements are interspersed within the common aperture.

In any of the embodiments described herein, embodiments may further include receiving or transmitting a third signal at a third value of the parameter different from the first and second values of the parameter using a third plurality of antenna elements, wherein individual antenna elements of the first, second, and third pluralities of antenna elements are interspersed.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein:

FIGS. 15A-15D are schematic layouts of an antenna lattice including antenna rotation schemes for polarization purity in accordance with embodiments of the present disclosure;

DETAILED DESCRIPTION

Figure 1A:
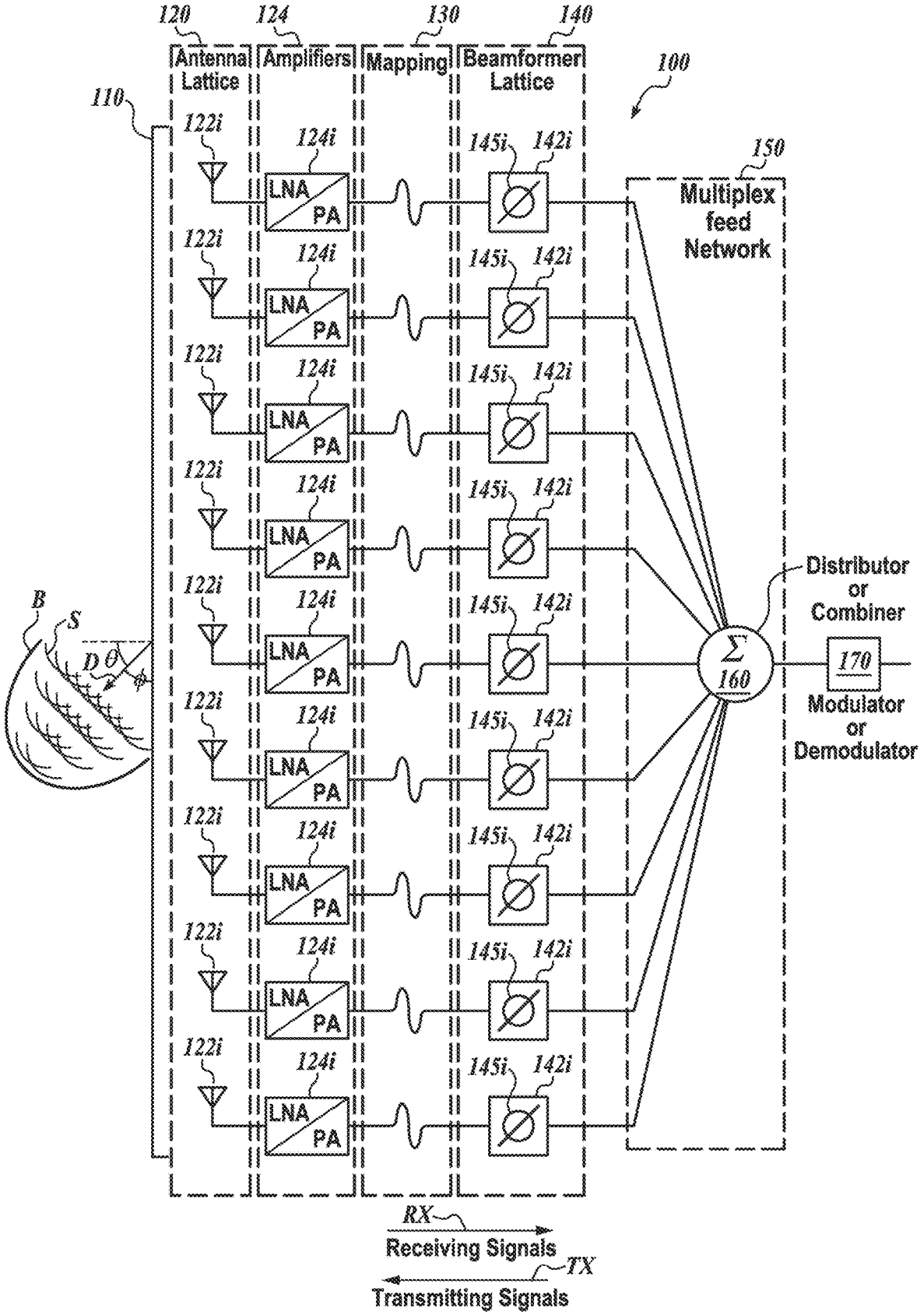
FIG. 1A illustrates a schematic of an electrical configuration for a phased array antenna system in accordance with one embodiment of the present disclosure including an antenna lattice defining an antenna aperture, mapping, a beamformer lattice, a multiplex feed network, a distributor or combiner, and a modulator or demodulator.

Embodiments of present disclosure are directed to apparatuses, systems, and methods relating to antenna apertures in phased array antenna systems. Some embodiments of the present disclosure include apparatuses, systems, and methods directed to configuring antenna lattices in a space tapered configuration and related other components and mapping from the antenna lattices, interspersing of antenna elements in an antenna aperture, and rotation of antenna element in the antenna aperture for purity polarization. These and other aspects of the present disclosure will be more fully described below.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C).

Language such as "top surface", "bottom surface", "vertical", "horizontal", and "lateral" in the present disclosure is meant to provide orientation for the reader with reference to the drawings and is not intended to be the required orientation of the components or to impart orientation limitations into the claims.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, it may not be included or may be combined with other features.

Many embodiments of the technology described herein may take the form of computer- or controller-executable instructions, including routines executed by a programmable computer or controller. Those skilled in the relevant art will appreciate that the technology can be practiced on computer/controller systems other than those shown and described above. The technology can be embodied in a special-purpose computer, controller or data processor that is specifically programmed, configured or constructed to perform one or more of the computer-executable instructions described above. Accordingly, the terms "computer" and "controller" as generally used herein refer to any data processor and can include Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display or LCD.

FIG. 1A is a schematic illustration of a phased array antenna system 100 in accordance with embodiments of the present disclosure. The phased array antenna system 100 is designed and configured to transmit or receive a combined beam B composed of signals S (also referred to as electromagnetic signals, wavefronts, or the like) in a preferred direction D from or to an antenna aperture 110. (Also see the combined beam B and antenna aperture 110 in FIG. 1B). The direction D of the beam B may be normal to the antenna aperture 110 or at an angle θ from normal.

Referring to FIG. 1A, the illustrated phased array antenna system 100 includes an antenna lattice 120, a mapping system 130, a beamformer lattice 140, a multiplex feed network 150 (or a hierarchical network or an H-network), a combiner or distributor 160 (a combiner for receiving signals or a distributor for transmitting signals), and a modulator or demodulator 170. The antenna lattice 120 is configured to transmit or receive a combined beam B of radio frequency signals S having a radiation pattern from or to the antenna aperture 110.

In accordance with embodiments of the present disclosure, the phased array antenna system 100 may be a multi-beam phased array antenna system, in which each beam of the multiple beams may be configured to be at different angles, different frequency, and/or different polarization.

In the illustrated embodiment, the antenna lattice 120 includes a plurality of antenna elements 122*i*. A corresponding plurality of amplifiers 124*i* are coupled to the plurality of antenna elements 122*i*. The amplifiers 124*i* may be low noise amplifiers (LNAs) in the receiving direction RX or power amplifiers (PAs) in the transmitting direction TX. The plurality of amplifiers 124*i* may be combined with the plurality of antenna elements 122*i* in for example, an antenna module or antenna package. In some embodiments, the plurality of amplifiers 124*i* may be located in another lattice separate from the antenna lattice 120.

Figure 1B:
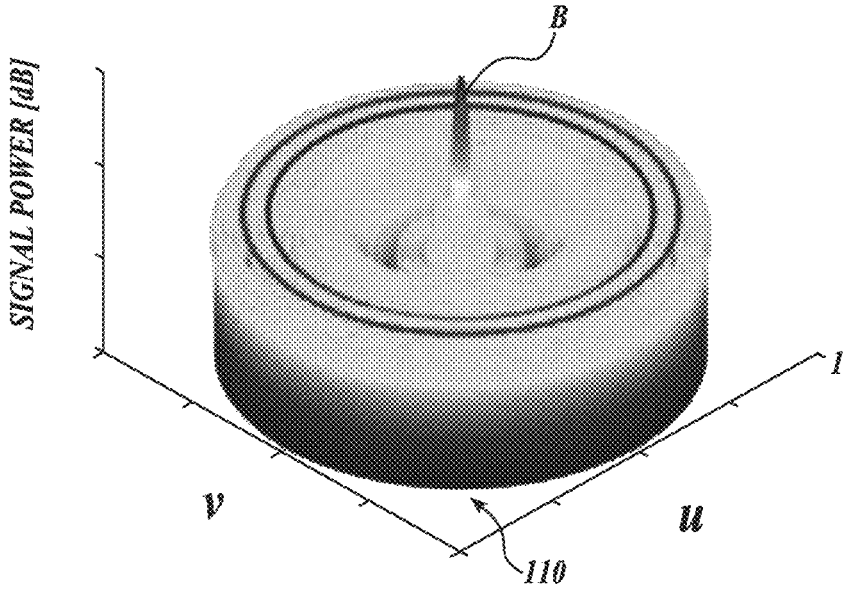
FIG. 1B illustrates a signal radiation pattern achieved by a phased array antenna aperture in accordance with one embodiment of the present disclosure.

Multiple antenna elements 122*i* in the antenna lattice 120 are configured for transmitting signals (see the direction of arrow TX in FIG. 1A for transmitting signals) or for receiving signals (see the direction of arrow RX in FIG. 1A for receiving signals). Referring to FIG. 1B, the antenna aperture 110 of the phased array antenna system 100 is the area through which the power is radiated or received. In accordance with one embodiment of the present disclosure, an exemplary phased array antenna radiation pattern from a phased array antenna system 100 in the u/v plane is provided in FIG. 1B. The antenna aperture has desired pointing angle D and an optimized beam B, for example, reduced side lobes Ls to optimize the power budget available to the main lobe Lm or to meet regulatory criteria for interference, as per regulations issued from organizations such as the Federal Communications Commission (FCC) or the International Telecommunication Union (ITU). (See FIG. 1F for a description of side lobes Ls and the main lobe Lm.)

Figure 1C:
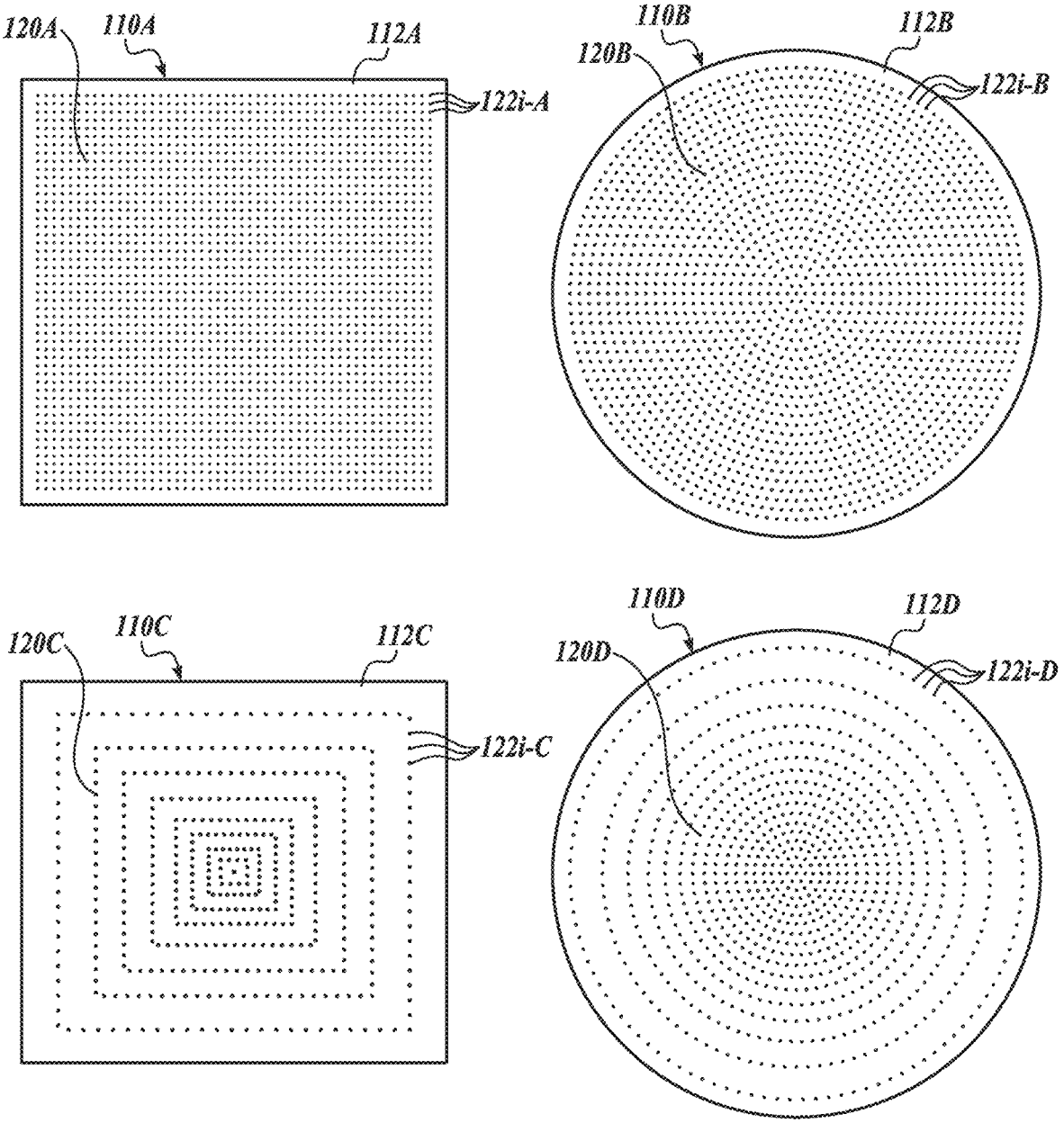
FIG. 1C illustrates schematic layouts of individual antenna elements of phased array antennas to define various antenna apertures in accordance with embodiments of the present disclosure (e.g., rectangular, circular, space tapered).

Referring to FIG. 1C, in some embodiments (see embodiments 120A, 120B, 120C, 120D), the antenna lattice 120 defining the antenna aperture 110 may include the plurality of antenna elements 122*i* arranged in a particular configuration on a printed circuit board (PCB), ceramic, plastic, glass, or other suitable substrate, base, carrier, panel, or the like (described herein as a carrier 112). The plurality of antenna elements 122*i*, for example, may be arranged in concentric circles, in a circular arrangement, in columns and rows in a rectilinear arrangement, in a radial arrangement, in equal or uniform spacing between each other, in non-uniform spacing between each other, or in any other arrangement. Various example arrangements of the plurality of antenna elements 122*i* in antenna lattices 120 defining antenna apertures (110A, 110B, 110C, and 110D) are shown, without limitation, on respective carriers 112A, 112B, 112C, and 112D in FIG. 1C.

The beamformer lattice 140 includes a plurality of beamformers 142*i* including a plurality of phase shifters 145*i*. In the receiving direction RX, the beamformer function is to delay the signals arriving from each antenna element so the signals all arrive to the combining network at the same time. In the transmitting direction TX, the beamformer function is to delay the signal sent to each antenna element such that all signals arrive at the target location at the same time. This delay can be accomplished by using "true time delay" or a phase shift at a specific frequency.

Following the transmitting direction of arrow TX in the schematic illustration of FIG. 1A, in a transmitting phased array antenna system 100, the outgoing radio frequency (RF) signals are routed from the modulator 170 via the distributer 160 to a plurality of individual phase shifters 145*i* in the beamformer lattice 140. The RF signals are phase-offset by the phase shifters 145*i* by different phases, which vary by a predetermined amount from one phase shifter to another. Each frequency needs to be phased by a specific amount in order to maintain the beam performance. If the phase shift applied to different frequencies follows a linear behavior, the phase shift is referred to as "true time delay". Common phase shifters, however, apply a constant phase offset for all frequencies.

For example, the phases of the common RF signal can be shifted by 0° at the bottom phase shifter 145*i* in FIG. 1A, by 4*a* at the next phase shifter 145*i* in the column, by 24*a* at the next phase shifter, and so on. As a result, the RF signals that arrive at amplifiers 124*i* (when transmitting, the amplifiers are power amplifiers "PAs") are respectively phase-offset from each other. The PAs 124*i* amplify these phase-offset RF signals, and antenna elements 122*i* emit the RF signals S as electromagnetic waves.

Because of the phase offsets, the RF signals from individual antenna elements 122*i* are combined into outgoing wave fronts that are inclined at angle $\phi$ from the antenna aperture 110 formed by the lattice of antenna elements 122*i*. The angle $\phi$ is called an angle of arrival (AoA) or a beamforming angle. Therefore, the choice of the phase offset 4*a* determines the radiation pattern of the combined signals S defining the wave front. In FIG. 1B, an exemplary phased array antenna radiation pattern of signals S from an antenna aperture 110 in accordance with one embodiment of the present disclosure is provided.

Following the receiving direction of arrow RX in the schematic illustration of FIG. 1A, in a receiving phased array antenna system 100, the signals S defining the wave front are detected by individual antenna elements 122*i*, and amplified by amplifiers 124*i* (when receiving signals the amplifiers are low noise amplifiers "LNAs"). For any non-zero AoA, signals S comprising the same wave front reach the different antenna elements 122*i* at different times. Therefore, the received signal will generally include phase offsets from one antenna element of the receiving (RX) antenna element to another. Analogously to the emitting phased array antenna case, these phase offsets can be adjusted by phase shifters 145*i* in the beamformer lattice 140. For example, each phase shifter 145*i* (e.g., a phase shifter chip) can be programmed to adjust the phase of the signal to the same reference, such that the phase offset among the individual antenna elements 122*i* is canceled in order to combine the RF signals corresponding to the same wave front. As a result of this constructive combining of signals, a higher signal to noise ratio (SNR) can be attained on the received signal, which results in increased channel capacity.

Still referring to FIG. 1A, a mapping system 130 may be disposed between the antenna lattice 120 and the beamformer lattice 140 to provide length matching for equidistant electrical connections between each antenna element 122*i* of the antenna lattice 120 and the phase shifters 145*i* in the beamformer lattice 140, as will be described in greater detail below. A multiplex feed or hierarchical network 150 may be disposed between the beamformer lattice 140 and the distributor/combiner 160 to distribute a common RF signal to the phase shifters 145*i* of the beamformer lattice 140 for respective appropriate phase shifting and to be provided to the antenna elements 122*i* for transmission, and to combine RF signals received by the antenna elements 122*i*, after appropriate phase adjustment by the beamformers 142*i*.

In accordance with some embodiments of the present disclosure, the antenna elements 122*i* and other components of the phased array antenna system 100 may be contained in an antenna module to be carried by the carrier 112. (See, for example, antenna modules 226*a* and 226*b* in FIG. 2B). In the illustrated embodiment of FIG. 2B, there is one antenna element 122*i* per antenna module 226*a*. However, in other embodiments of the present disclosure, antenna modules 226*a* may incorporate more than one antenna element 122*i*.

Figure 1D:
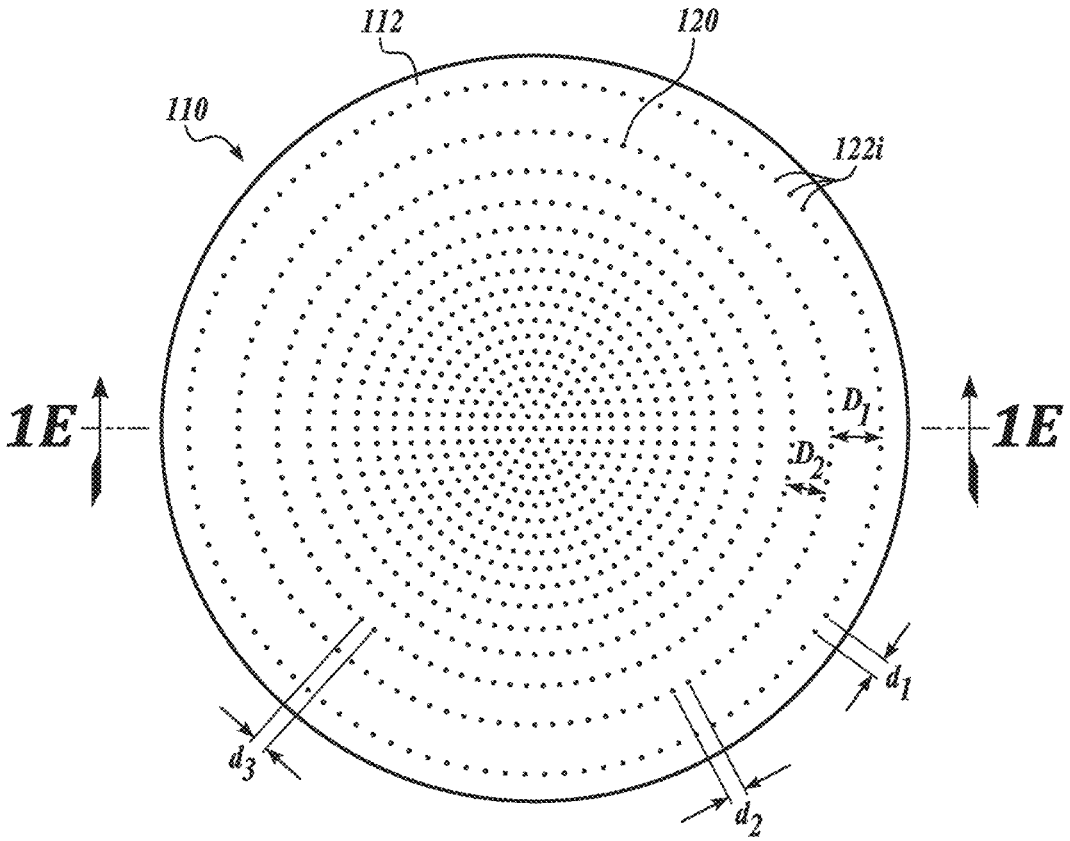
FIG. 1D illustrates individual antenna elements in a space tapered configuration to define an antenna aperture in accordance with embodiments of the present disclosure.
Figure 1E:
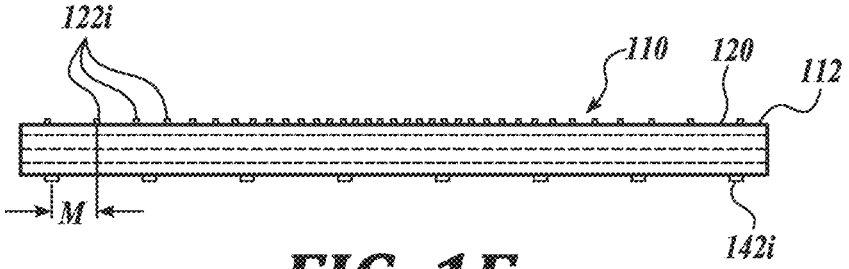
FIG. 1E is a cross-sectional view of a panel defining the antenna aperture in FIG. 1D.

Referring to FIGS. 1D and 1E, an exemplary configuration for an antenna aperture 120 in accordance with one embodiment of the present disclosure is provided. In the illustrated embodiment of FIGS. 1D and 1E, the plurality of antenna elements 122*i* in the antenna lattice 120 are distributed with a space taper configuration on the carrier 112. In accordance with a space taper configuration, the number of antenna elements 122*i* changes in their distribution from a center point of the carrier 112 to a peripheral point of the carrier 112. For example, compare spacing between adjacent antenna elements 122*i*, D1 to D2, and compare spacing between adjacent antenna elements 122*i*, d1, d2, and d3. Although shown as being distributed with a space taper configuration, other configurations for the antenna lattice are also within the scope of the present disclosure.

The system 100 includes a first portion carrying the antenna lattice 120 and a second portion carrying a beamformer lattice 140 including a plurality of beamformer elements. As seen in the cross-sectional view of FIG. 1E, multiple layers of the carrier 112 carry electrical and electromagnetic connections between elements of the phased array antenna system 100. In the illustrated embodiment, the antenna elements 122*i* are located the top surface of the top layer and the beamformer elements 142*i* are located on the bottom surface of the bottom layer. While the antenna elements 122*i* may be configured in a first arrangement, such as a space taper arrangement, the beamformer elements 142*i* may be arranged in a second arrangement different from the antenna element arrangement. For example, the number of antenna elements 122*i* may be greater than the number of beamformer elements 142*i*, such that multiple antenna elements 122*i* correspond to one beamformer element 142*i*. As another example, the beamformer elements 142*i* may be laterally displaced from the antenna elements 122*i* on the carrier 112, as indicated by distance M in FIG. 1E. In one embodiment of the present disclosure, the beamformer elements 142*i* may be arranged in an evenly spaced or organized arrangement, for example, corresponding to an H-network, or a cluster network, or an unevenly spaced network such as a space tapered network different from the antenna lattice 120. In some embodiments, one or more additional layers may be disposed between the top and bottom layers of the carrier 112. Each of the layers may comprise one or more PCB layers.

Figure 1F:
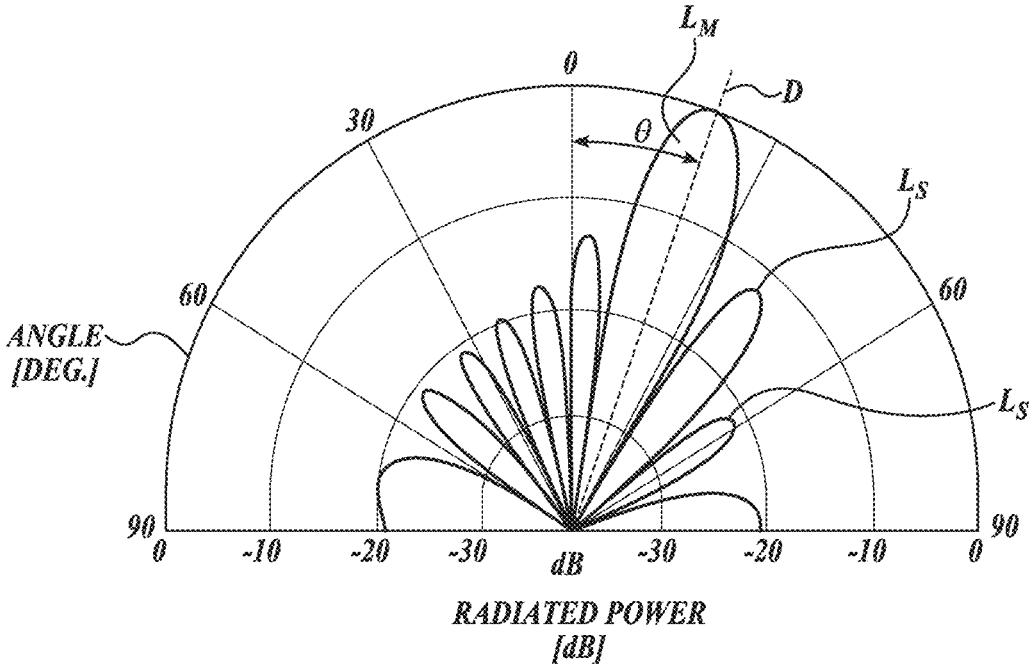
FIG. 1F is a graph of a main lobe and undesirable side lobes of an antenna signal.

Referring to FIG. 1F, a graph of a main lobe Lm and side lobes Ls of an antenna signal in accordance with embodiments of the present disclosure is provided. The horizontal (also the radial) axis shows radiated power in dB. The angular axis shows the angle of the RF field in degrees. The main lobe Lm represents the strongest RF field that is generated in a preferred direction by a phased array antenna system 100. In the illustrated case, a desired pointing angle D of the main lobe Lm corresponds to about 20°. Typically, the main lobe Lm is accompanied by a number of side lobes Ls. However, side lobes Ls are generally undesirable because they derive their power from the same power budget thereby reducing the available power for the main lobe Lm. Furthermore, in some instances the side lobes Ls may reduce the SNR of the antenna aperture 110. Also, side lobe reduction is important for regulation compliance.

One approach for reducing side lobes Ls is arranging elements 122*i* in the antenna lattice 120 with the antenna elements 122*i* being phase offset such that the phased array antenna system 100 emits a waveform in a preferred direction D with reduced side lobes. Another approach for reducing side lobes Ls is power tapering. However, power tapering is generally undesirable because by reducing the power of the side lobe Ls, the system has increased design complexity of requiring of "tunable and/or lower output" power amplifiers.

In addition, a tunable amplifier 124*i* for output power has reduced efficiency compared to a non-tunable amplifier. Alternatively, designing different amplifiers having different gains increases the overall design complexity and cost of the system.

Yet another approach for reducing side lobes Ls in accordance with embodiments of the present disclosure is a space tapered configuration for the antenna elements 122*i* of the antenna lattice 120. (See the antenna element 122*i* configuration in FIGS. 1C and 1D.) Space tapering may be used to reduce the need for distributing power among antenna elements 122*i* to reduce undesirable side lobes Ls. However, in some embodiments of the present disclosure, space taper distributed antenna elements 122*i* may further include power or phase distribution for improved performance.

Figure 1G:
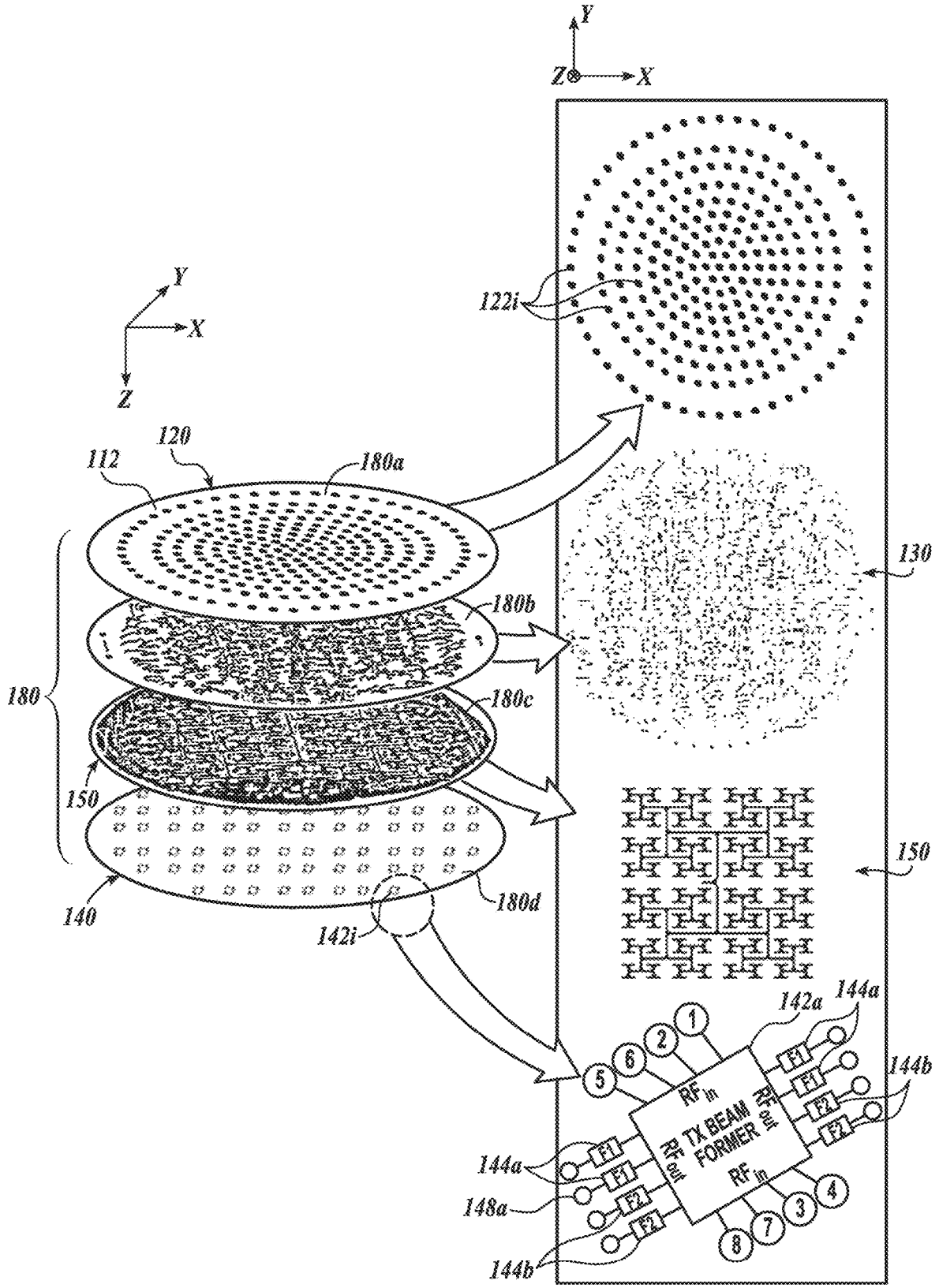
FIG. 1G illustrates an isometric view of a plurality of stack-up layers which make up a phased array antenna system in accordance with one embodiment of the present disclosure.

In addition to undesirable side lobe reduction, space tapering may also be used in accordance with embodiments of the present disclosure to reduce the number of antenna elements 122*i* in a phased array antenna system 100 while still achieving an acceptable beam B from the phased array antenna system 100 depending on the application of the system 100. (For example, compare in FIG. 1C the number of space-tapered antenna elements 122*i* on carrier 112D with the number of non-space tapered antenna elements 122*i* carrier by carrier 112B.) FIG. 1G depicts an exemplary configuration of the phased array antenna system 100 implemented as a plurality of PCB layers in lay-up 180 in accordance with embodiments of the present disclosure. The plurality of PCB layers in lay-up 180 may comprise a PCB layer stack including an antenna layer 180*a*, a mapping layer 180*b*, a multiplex feed network layer 180*c*, and a beamformer layer 180*d*. In the illustrated embodiment, mapping layer 180*b* is disposed between the antenna layer 180*a* and multiplex feed network layer 180*c*, and the multiplex feed network layer 180*c* is disposed between the mapping layer 180*b* and the beamformer layer 180*d*.

Although not shown, one or more additional layers may be disposed between layers 180*a* and 180*b*, between layers 180*b* and 180*c*, between layers 180*c* and 180*d*, above layer 180*a*, and/or below layer 180*d*. Each of the layers 180*a*, 180*b*, 180*c*, and 180*d* may comprise one or more PCB sub-layers. In other embodiments, the order of the layers 180*a*, 180*b*, 180*c*, and 180*d* relative to each other may differ from the arrangement shown in FIG. 1G. For instance, in other embodiments, beamformer layer 180*d* may be disposed between the mapping layer 180*b* and multiplex feed network layer 180*c*.

Layers 180*a*, 180*b*, 180*c*, and 180*d* may include electrically conductive traces (such as metal traces that are mutually separated by electrically isolating polymer or ceramic), electrical components, mechanical components, optical components, wireless components, electrical coupling structures, electrical grounding structures, and/or other structures configured to facilitate functionalities associated with the phase array antenna system 100. Structures located on a particular layer, such as layer 180*a*, may be electrically interconnected with vertical vias (e.g., vias extending along the z-direction of a Cartesian coordinate system) to establish electrical connection with particular structures located on another layer, such as layer 180*d*.

Antenna layer 180*a* may include, without limitation, the plurality of antenna elements 122*i* arranged in a particular arrangement (e.g., a space taper arrangement) as an antenna lattice 120 on the carrier 112. Antenna layer 180*a* may also include one or more other components, such as corresponding amplifiers 124*i*. Alternatively, corresponding amplifiers 124*i* may be configured on a separate layer. Mapping layer 180*b* may include, without limitation, the mapping system 130 and associated carrier and electrical coupling structures. Multiplex feed network layer 180*c* may include, without limitation, the multiplex feed network 150 and associated carrier and electrical coupling structures. Beamformer layer 180*d* may include, without limitation, the plurality of phase shifters 145*i*, other components of the beamformer lattice 140, and associated carrier and electrical coupling structures. Beamformer layer 180*d* may also include, in some embodiments, modulator/demodulator 170 and/or coupler structures. In the illustrated embodiment of FIG. 1G, the beamformers 142*i* are shown in phantom lines because they extend from the underside of the beamformer layer 180*d*.

Although not shown, one or more of layers 180*a*, 180*b*, 180*c*, or 180*d* may itself comprise more than one layer. For example, mapping layer 180*b* may comprise two or more layers, which in combination may be configured to provide the routing functionality discussed above. As another example, multiplex feed network layer 180*c* may comprise two or more layers, depending upon the total number of multiplex feed networks included in the multiplex feed network 150.

Figure 2A:
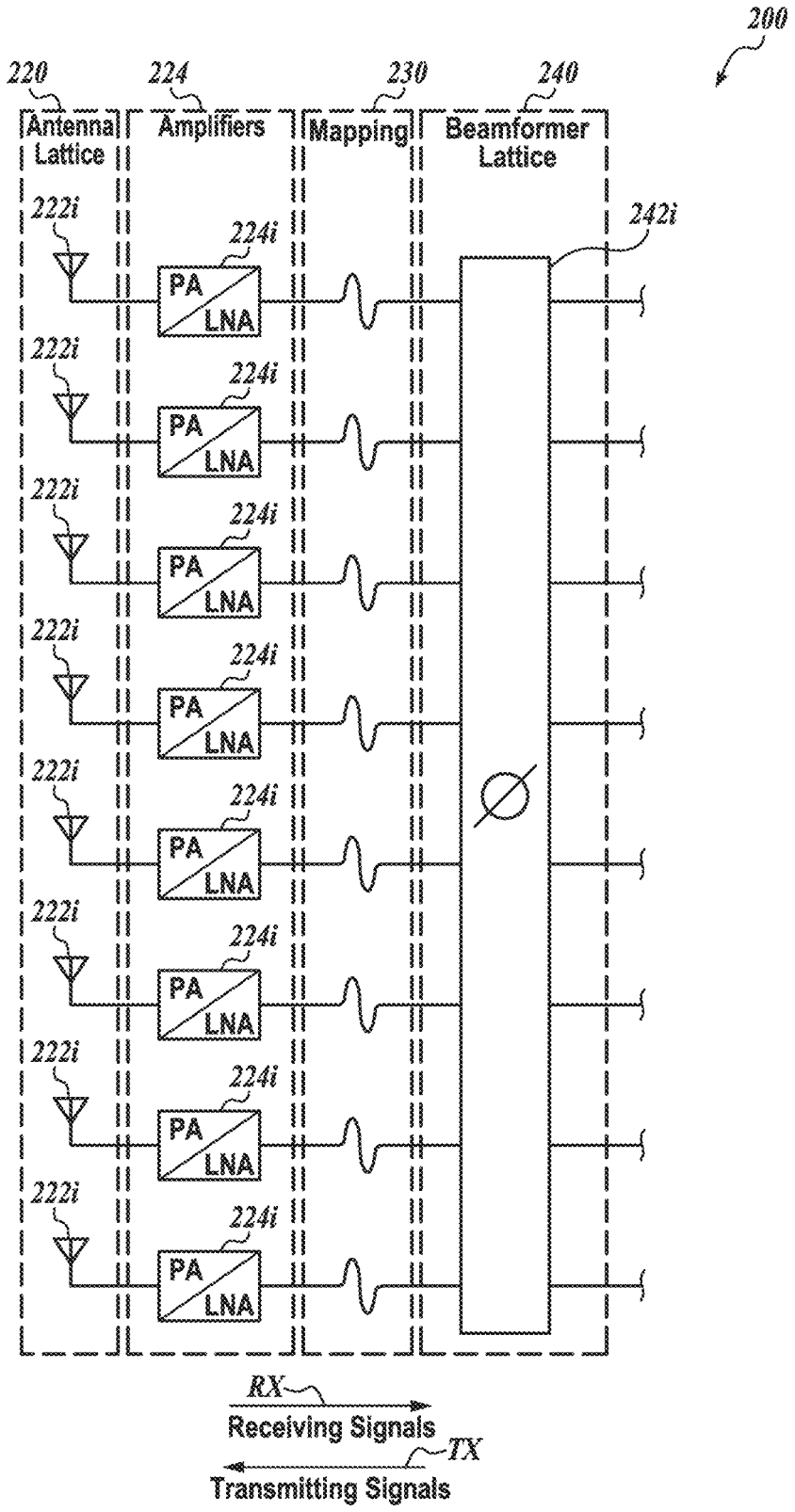
FIG. 2A illustrates a schematic of an electrical configuration for multiple antenna elements in an antenna lattice coupled to a single beamformer in a beamformer lattice in accordance with one embodiment of the present disclosure.

In accordance with embodiments of the present disclosure, the phased array antenna system 100 may be a multi-beam phased array antenna system. In a multi-beam phased array antenna configuration, each beamformer 142*i* may be electrically coupled to more than one antenna element 122*i*. The total number of beamformer 142*i* may be smaller than the total number of antenna elements 122*i*. For example, each beamformer 142*i* may be electrically coupled to four antenna elements 122*i* or to eight antenna elements 122*i*. FIG. 2A illustrates an exemplary multi-beam phased array antenna system in accordance with one embodiment of the present disclosure in which eight antenna elements 222*i* are electrically coupled to one beamformer 242*i*. In other embodiments, each beamformer 142*i* may be electrically coupled to more than eight antenna elements 122*i*.

Figure 2B:
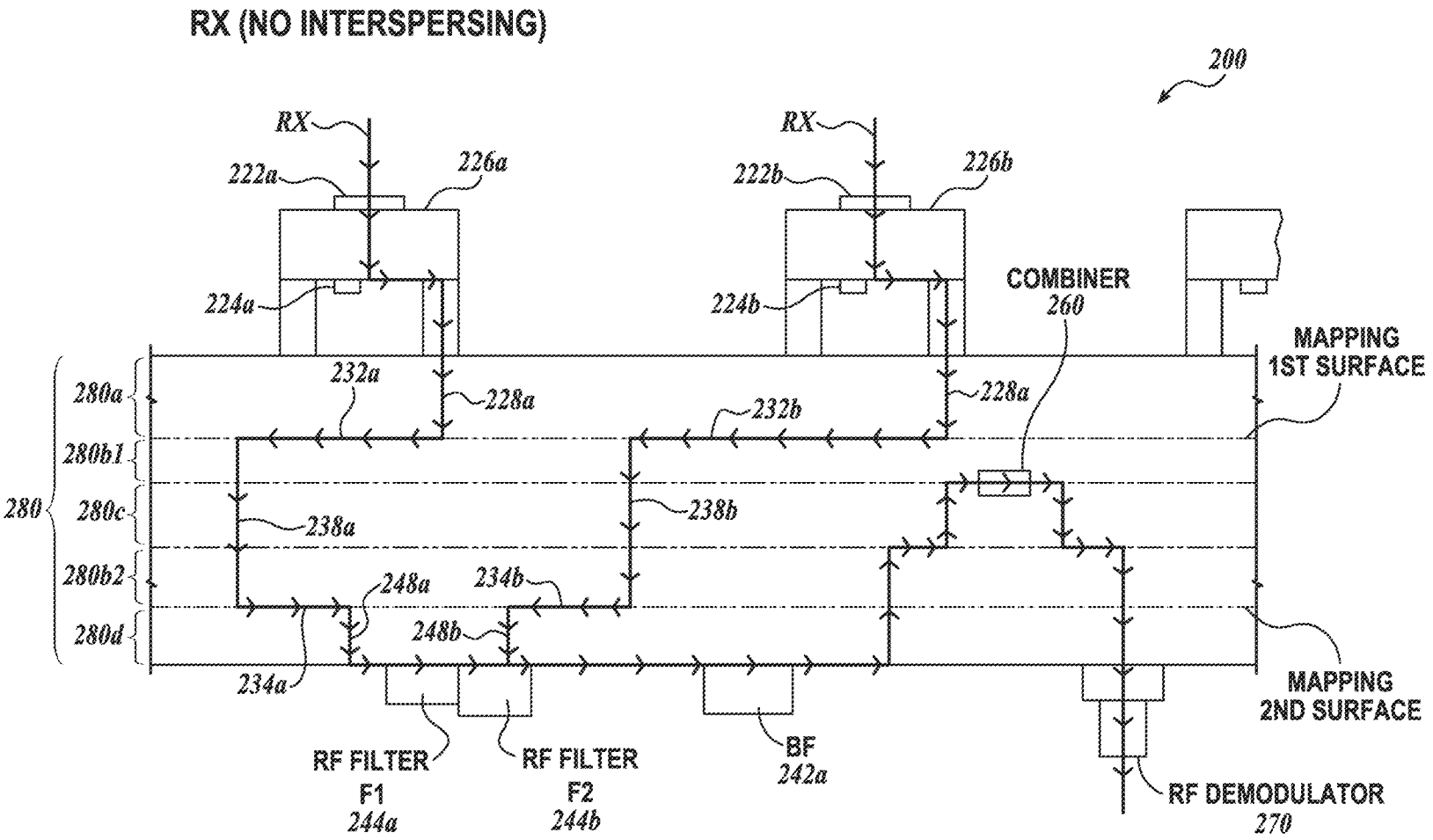
FIG. 2B illustrates a schematic cross section of a plurality of stack-up layers which make up a phased array antenna system in an exemplary receiving system in accordance with the electrical configuration of FIG. 2A.

FIG. 2B depicts a partial, close-up, cross-sectional view of an exemplary configuration of the phased array antenna system 200 of FIG. 2A implemented as a plurality of PCB layers 280 in accordance with embodiments of the present disclosure. Like part numbers are used in FIG. 2B as used in FIG. 1G with similar numerals, but in the 200 series.

In the illustrated embodiment of FIG. 2B, the phased array antenna system 200 is in a receiving configuration (as indicated by the arrows RX). Although illustrated as in a receiving configuration, the structure of the embodiment of FIG. 2B may be modified to be also be suitable for use in a transmitting configuration.

Signals are detected by the individual antenna elements 222*a* and 222*b*, shown in the illustrated embodiment as being carried by antenna modules 226*a* and 226*b* on the top surface of the antenna lattice layer 280*a*. After being received by the antenna elements 222*a* and 222*b*, the signals are amplified by the corresponding low noise amplifiers (LNAs) 224*a* and 224*b*, which are also shown in the illustrated embodiment as being carried by antenna modules 226*a* and 226*b* on a top surface of the antenna lattice layer 280*a*.

In the illustrated embodiment of FIG. 2B, a plurality of antenna elements 222*a* and 222*b* in the antenna lattice 220 are coupled to a single beamformer 242*a* in the beamformer lattice 240 (as described with reference to FIG. 2A). However, a phased array antenna system implemented as a plurality of PCB layers having a one-to-one ratio of antenna elements to beamformer elements or having a greater than one-to-one ratio are also within the scope of the present disclosure. In the illustrated embodiment of FIG. 2B, the beamformers 242*i* are coupled to the bottom surface of the beamformer layer 280*d*.

In the illustrated embodiment, the antenna elements 222*i* and the beamformer elements 242*i* are configured to be on opposite surfaces of the lay-up of PCB layers 280. In other embodiments, beamformer elements may be co-located with antenna elements on the same surface of the lay-up. In other embodiments, beamformers may be located within an antenna module or antenna package.

As previously described, electrical connections coupling the antenna elements 222*a* and 222*b* of the antenna lattice 220 on the antenna layer 280*a* to the beamformer elements 242*a* of the beamformer lattice 240 on the beamformer layer 280*d* are routed on surfaces of one or more mapping layers 280*b*1 and 280*b*2 using electrically conductive traces. Exemplary mapping trace configurations for a mapping layer are provided in layer 130 of FIG. 1G.

In the illustrated embodiment, the mapping is shown on top surfaces of two mapping layers 280*b*1 and 280*b*2. However, any number of mapping layers may be used in accordance with embodiments of the present disclosure, including a single mapping layer. Mapping traces on a single mapping layer cannot cross other mapping traces. Therefore, the use of more than one mapping layer can be advantageous in reducing the lengths of the electrically conductive mapping traces by allowing mapping traces in horizontal planes to cross an imaginary line extending through the lay-up 280 normal to the mapping layers and in selecting the placement of the intermediate vias between the mapping traces.

In addition to mapping traces on the surfaces of layers 280*b*1 and 280*b*2, mapping from the antenna lattice 220 to the beamformer lattice 240 further includes one or more electrically conductive vias extending vertically through one or more of the plurality of PCB layers 280.

In the illustrated embodiment of FIG. 2B, a first mapping trace 232*a* between first antenna element 222*a* and beamformer element 242*a* is formed on the first mapping layer 280*b*1 of the lay-up of PCB layers 280. A second mapping trace 234*a* between the first antenna element 222*a* and beamformer element 242*a* is formed on the second mapping layer 280*b*2 of the lay-up of PCB layers 280. An electrically conductive via 238*a* connects the first mapping trace 232*a* to the second mapping trace 234*a*. Likewise, an electrically conductive via 228*a* connects the antenna element 222*a* (shown as connecting the antenna module 226*a* including the antenna element 222*a* and the amplifier 224*a*) to the first mapping trace 232*a*. Further, an electrically conductive via 248*a* connects the second mapping trace 234*a* to RF filter 244*a* and then to the beamformer element 242*a*, which then connects to combiner 260 and RF demodulator 270.

Of note, via 248*a* corresponds to via 148*a* and filter 244*a* corresponds to filter 144*a*, both shown on the surface of the beamformer layer 180*d* in the previous embodiment of FIG. 1G. In some embodiments of the present disclosure, filters may be omitted depending on the design of the system.

Similar mapping connects the second antenna element 222*b* to RF filter 244*b* and then to the beamformer element 242*a*. The second antenna element 222*b* may operate at the same or at a different value of a parameter than the first antenna element 222*a* (for example at different frequencies). If the first and second antenna elements 222*a* and 222*b* operate at the same value of a parameter, the RF filters 244*a* and 244*b* may be the same. If the first and second antenna elements 222*a* and 222*b* operate at different values, the RF filters 244*a* and 244*b* may be different.

Mapping traces and vias may be formed in accordance with any suitable methods. In one embodiment of the present disclosure, the lay-up of PCB layers 280 is formed after the multiple individual layers 280*a*, 280*b*, 280*c*, and 280*d* have been formed. For example, during the manufacture of layer 280*a*, electrically conductive via 228*a* may be formed through layer 280*a*. Likewise, during the manufacture of layer 280*d*, electrically conductive via 248*a* may be formed through layer 280*d*. When the multiple individual layers 280*a*, 280*b*, 280*c*, and 280*d* are assembled and laminated together, the electrically conductive via 228*a* through layer 280*a* electrically couples with the trace 232*a* on the surface of layer 280*b*1, and the electrically conductive via 248*a* through layer 280*d* electrically couples with the trace 234*a* on the surface of layer 280*b*2.

Other electrically conductive vias, such as via 238*a* coupling trace 232*a* on the surface of layer 280*b*1 and trace 234*a* on the surface of layer 280*b*2 can be formed after the multiple individual layers 280*a*, 280*b*, 280*c*, and 280*d* are assembled and laminated together. In this construction method, a hole may be drilled through the entire lay-up 280 to form the via, metal is deposited in the entirety of the hole forming an electrically connection between the traces 232*a* and 234*a*. In some embodiments of the present disclosure, excess metal in the via not needed in forming the electrical connection between traces 232*a* and 234*a* can be removed by back-drilling the metal at the top and/or bottom portions of the via. In some embodiments, back-drilling of the metal is not performed completely, leaving a via "stub". Tuning may be performed for a lay-up design with a remaining via "stub". In other embodiments, a different manufacturing process may produce a via that does not span more than the needed vertical direction.

As compared to the use of one mapping layer, the use of two mapping layers 280*b*1 and 280*b*2 separated by intermediate vias 238*a* and 238*b* as seen in the illustrated embodiment of FIG. 2B allows for selective placement of the intermediate vias 238*a* and 238*b*. If these vias are drilled though all the layers of the lay-up 280, they can be selectively positioned to be spaced from other components on the top or bottom surfaces of the lay-up 280.

Figure 3A:
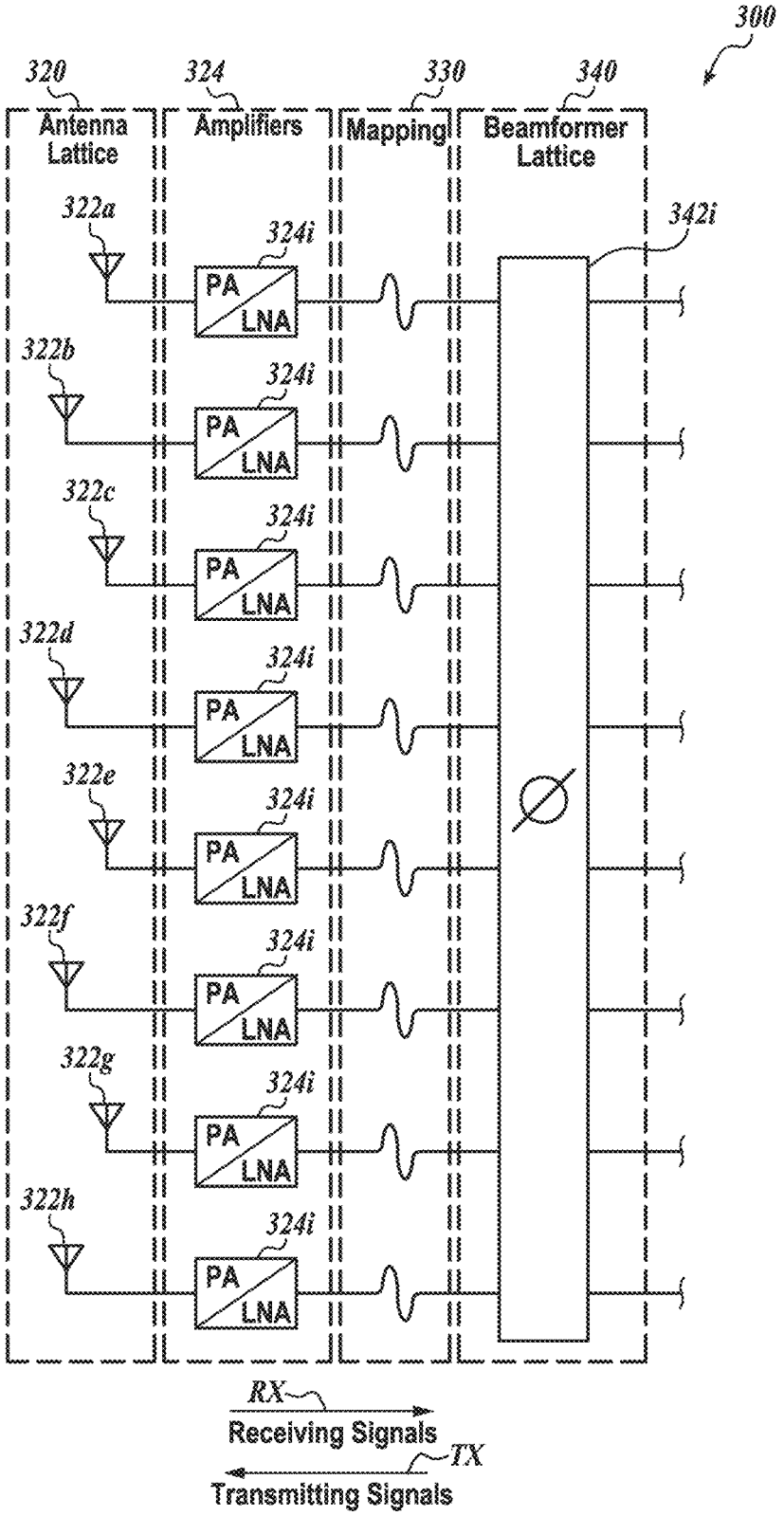
FIG. 3A illustrates a schematic of an electrical configuration for multiple interspersed antenna elements in an antenna lattice coupled to a single beamformer in a beamformer lattice in accordance with one embodiment of the present disclosure.
Figure 3B:
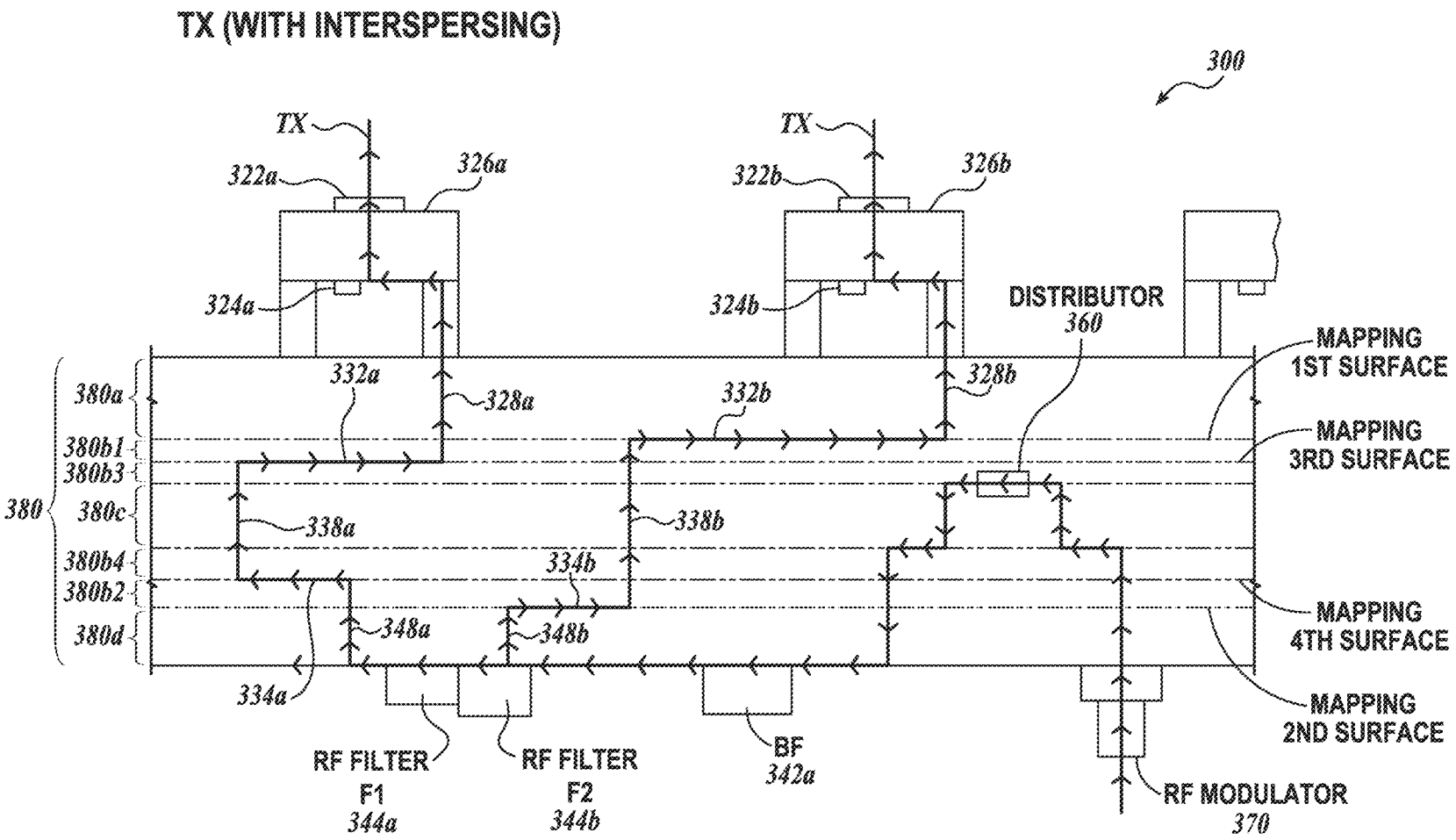
FIG. 3B illustrates a schematic cross section of a plurality of stack-up layers which make up a phased array antenna system in an exemplary transmitting and interspersed system in accordance with the electrical configuration of FIG. 3A.

FIGS. 3A and 3B are directed to another embodiment of the present disclosure. FIG. 3A illustrates an exemplary multi-beam phased array antenna system in accordance with one embodiment of the present disclosure in which eight antenna elements 322*i* are electrically coupled to one beamformer 342*i*, with the eight antenna elements 322*i* being into two different groups of interspersed antenna elements 322*a* and 322*b*.

FIG. 3B depicts a partial, close-up, cross-sectional view of an exemplary configuration of the phased array antenna system 300 implemented as a stack-up of a plurality of PCB layers 380 in accordance with embodiments of the present disclosure. The embodiment of FIG. 3B is similar to the embodiment of FIG. 2B, except for differences regarding interspersed antenna elements, the number of mapping layers, and the direction of signals, as will be described in greater detail below. Like part numbers are used in FIG. 3B as used in FIG. 3A with similar numerals, but in the 300 series.

In the illustrated embodiment of FIG. 3B, the phased array antenna system 300 is in a transmitting configuration (as indicated by the arrows TX). Although illustrated as in a transmitting configuration, the structure of the embodiment of FIG. 3B may be modified to also be suitable for use in a receiving configuration.

In some embodiments of the present disclosure, the individual antenna elements 322*a* and 322*b* may be configured to receive and/or transmit data at different values of one or more parameters (e.g., frequency, polarization, beam orientation, data streams, receive (RX)/transmit (TX) functions, time multiplexing segments, etc.). These different values may be associated with different groups of the antenna elements. For example, a first plurality of antenna elements carried by the carrier is configured to transmit and/or receive signals at a first value of a parameter. A second plurality of antenna elements carried by the carrier are configured to transmit and/or receive signals at a second value of the parameter different from the first value of the parameter, and the individual antenna elements of the first plurality of antenna elements are interspersed with individual antenna elements of the second plurality of antenna elements.

As a non-limiting example, a first group of antenna elements may receive data at frequency f1, while a second group of antenna elements may receive data at frequency f2.

The placement on the same carrier of the antenna elements operating at one value of the parameter (e.g., first frequency or wavelength) together with the antenna elements operating at another value of the parameter (e.g., second frequency or wavelength) is referred to herein as "interspersing". In some embodiments, the groups of antenna elements operating at different values of parameter or parameters may be placed over separate areas of the carrier in a phased array antenna. In some embodiments, at least some of the antenna elements of the groups of antenna elements operating at different values of at least one parameter are adjacent or neighboring one another. In other embodiments, most or all the antenna elements of the groups of antenna elements operating at different values of at least one parameter are adjacent or neighboring one another.

In the illustrated embodiment of FIG. 3A, antenna elements 322*a* and 322*b* are interspersed antenna elements with first antenna element 322*a* communicating at a first value of a parameter and second antenna element 322*a* communicating at a second value of a parameter.

Although shown in FIG. 3A as two groups of interspersed antenna elements 322*a* and 322*b* in communication with a single beamformer 342*a*, the phased array antenna system 300 may be also configured such that one group of interspersed antenna elements communicate with one beamformer and another group of interspersed antenna elements communicate with another beamformer.

In the illustrated embodiment of FIG. 3B, the lay-up 380 includes four mapping layers 380*b*1, 380*b*2, 380*b*3, and 380*b*4, compared to the use of two mapping layers 280*b*1 and 280*b*2 in FIG. 2B. Mapping layers 380*b*1 and 380*b*2 are connected by intermediate via 338*a*. Mapping layers 380*b*3 and 380*b*4 are connected by intermediate via 338*b*. Like the embodiment of FIG. 2B, the lay-up 380 of the embodiment of FIG. 3B can allow for selective placement of the intermediate vias 338*a* and 338*b*, for example, to be spaced from other components on the top or bottom surfaces of the lay-up 380.

The mapping layers and vias can be arranged in many other configurations and on other sub-layers of the lay-up 180 than the configurations shown in FIGS. 2B and 3B. The use of two or more mapping layers can be advantageous in reducing the lengths of the electrically conductive mapping traces by allowing mapping traces in horizontal planes to cross an imaginary line extending through the lay-up normal to the mapping layers and in selecting the placement of the intermediate vias between the mapping traces. Likewise, the mapping layers can be configured to correlate to a group of antenna elements in an interspersed configuration. By maintaining consistent via lengths for each grouping by using the same mapping layers for each grouping, trace length is the only variable in length matching for each antenna to beamformer mapping for each grouping.

Space Tapered Antenna Lattice

As described above, antenna elements in a phased array antenna system may be arranged having a space tapered configuration. FIGS. 1D and 1E are schematic layouts (also referred to as distributions, arrangements, or lattices) of individual antenna elements of a phased array antenna lattice 120 in accordance with an embodiment of the present technology. The individual antenna elements 122*i* of the antenna lattice 120 are distributed over a carrier 112. In some embodiments, the antenna elements 122*i* may be surface-mounted to the carrier 112. In some embodiments, the antenna elements 122*i* may be disposed in an antenna module or antenna package, which is surface mounted to the carrier 112.

In some embodiments of the present disclosure, the antenna elements 122*i* are distributed on the carrier with a space taper configuration. In accordance with a space taper configuration, the number of antenna elements changes in their distribution from a center point of the carrier 112 to a peripheral point of the carrier 112.

Figure 4:
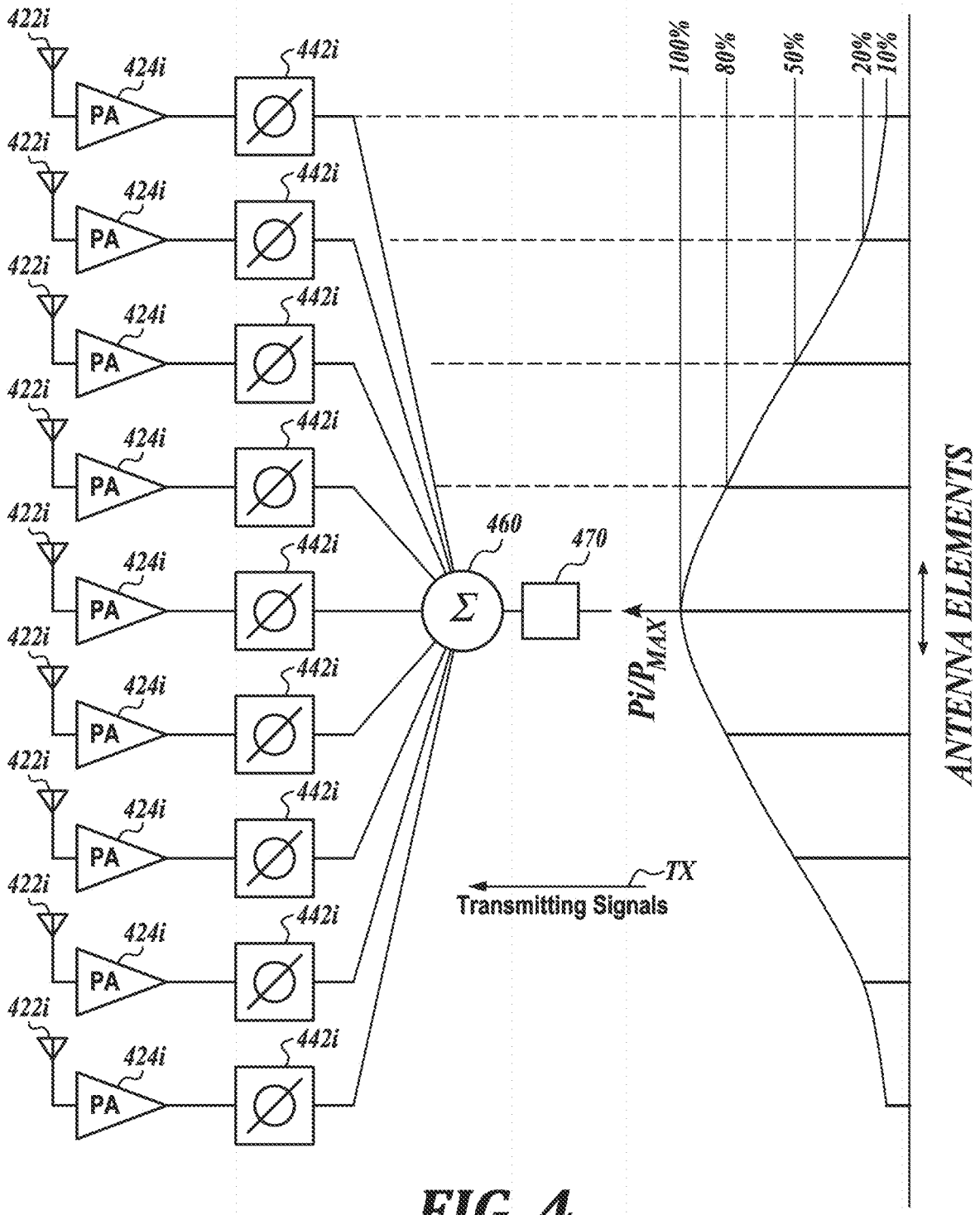
FIG. 4 (PRIOR ART)
FIG. 4 is a schematic of an electrical configuration for a phased array antenna system having a power tapering configuration in accordance with previously developed technology.

FIG. 4 is a graph of power distribution over individual antenna elements of a phased array antenna. The illustrated phased array antenna includes a plurality of antenna elements 422*i* configured for transmitting signals including a central antenna element and peripheral antenna elements. Although illustrated as in a transmitting configuration, the structure of the embodiment of FIG. 4 may be modified to also be suitable for use in a receiving configuration.

In the illustrated embodiment of FIG. 4, the power to the peripheral antenna elements is reduced to reduce the power of unwanted side lobes Ls (e.g., see FIG. 1F showing side lobes Ls). As shown in the graph of FIG. 4 in a non-limiting example of power tapering, the central antenna element 422*i* is powered at 100% of the available power (i.e., available amplification of the PA, or $P_i/P_{MAX}$) of the corresponding PA 424*i*. However, the antenna elements 422*i* adjacent the central antenna element are powered at decreasing levels of power, starting from about 80% of the available PA power for the antenna elements 422*i* that are closest to the central antenna elements, down to about 10% for the peripheral antenna elements 422*i* in the illustrated case. Such a distribution of power at the PAs 424*i* and, correspondingly, at the antenna elements 422*i* will generally make the side lobes Ls smaller.

As discussed above, power tapering is generally undesirable because by reducing the power of the side lobe Ls, the system has increased design complexity of requiring of "tunable and/or lower output" power amplifiers. In addition, a tunable amplifier 124*i* for output power has reduced efficiency compared to a non-tunable amplifier. Alternatively, designing different amplifiers having different gains increases the overall design complexity and cost of the system.

In accordance with embodiments of the present disclosure, space tapering of antenna elements may be used to reduce or eliminate the need for distributing power to peripheral antenna elements to reduce undesirable side lobes. However, in some embodiments of the present disclosure, space tapered distributed antenna elements may further include power distribution for improved performance. In addition, space tapering may be used to reduce the number of antenna elements in a phased array antenna.

Space tapered antenna elements have different spacing between adjacent elements. In accordance with embodiments of the present disclosure, space tapering may be configured in many different arrangements. In some embodiments of the present disclosure, the antenna elements 122*i* may be distributed in a line or along a line, such as, close to a line. For example, in FIG. 1E, antenna elements 122*i* along a line are distributed between a center and a periphery of the carrier, with a plurality of antenna elements distributed between the center and the periphery of the carrier 112. In some embodiments, the antenna elements 122*i* are distributed more densely in the central area of the carrier 112, and less densely in the peripheral area of the carrier 112.

In one embodiment, the antenna layout may include at least some antenna elements having changing distribution along a line from the center to the periphery of the carrier. For example, the antenna layout may include first, second, and third antenna elements. The first antenna element is closest to the center of the carrier 112, the third antenna element is furthest from the center, and the second antenna element is positioned between the first and third antenna elements. The first and second antenna elements are separated by a first distance, and the second and third antenna elements are separated by a second distance different from the first distance. The second antenna element is the closest antenna element along a line to both the first antenna element and the third antenna element.

Referring to FIG. 1D, space tapering of antenna elements 122*i* in the illustrated embodiment is configured in circular arrangements. Space tapering between elements may be affected by inter-ring tapering, which is tapering the distance between concentric rings, as indicated by the difference in the distances D1 and D2 between adjacent rings of antenna elements. Space tapering between elements may also be affected by intra-ring tapering, which is tapering the distance between adjacent antenna elements in the same ring, as indicated by the differences in the distances d1, d2, and d3 between adjacent elements in the same rings. Groupings of antenna elements 122*i* may be referred to herein as rings, ring arrangements, or arrangements in an antenna lattice.

Figure 7A:
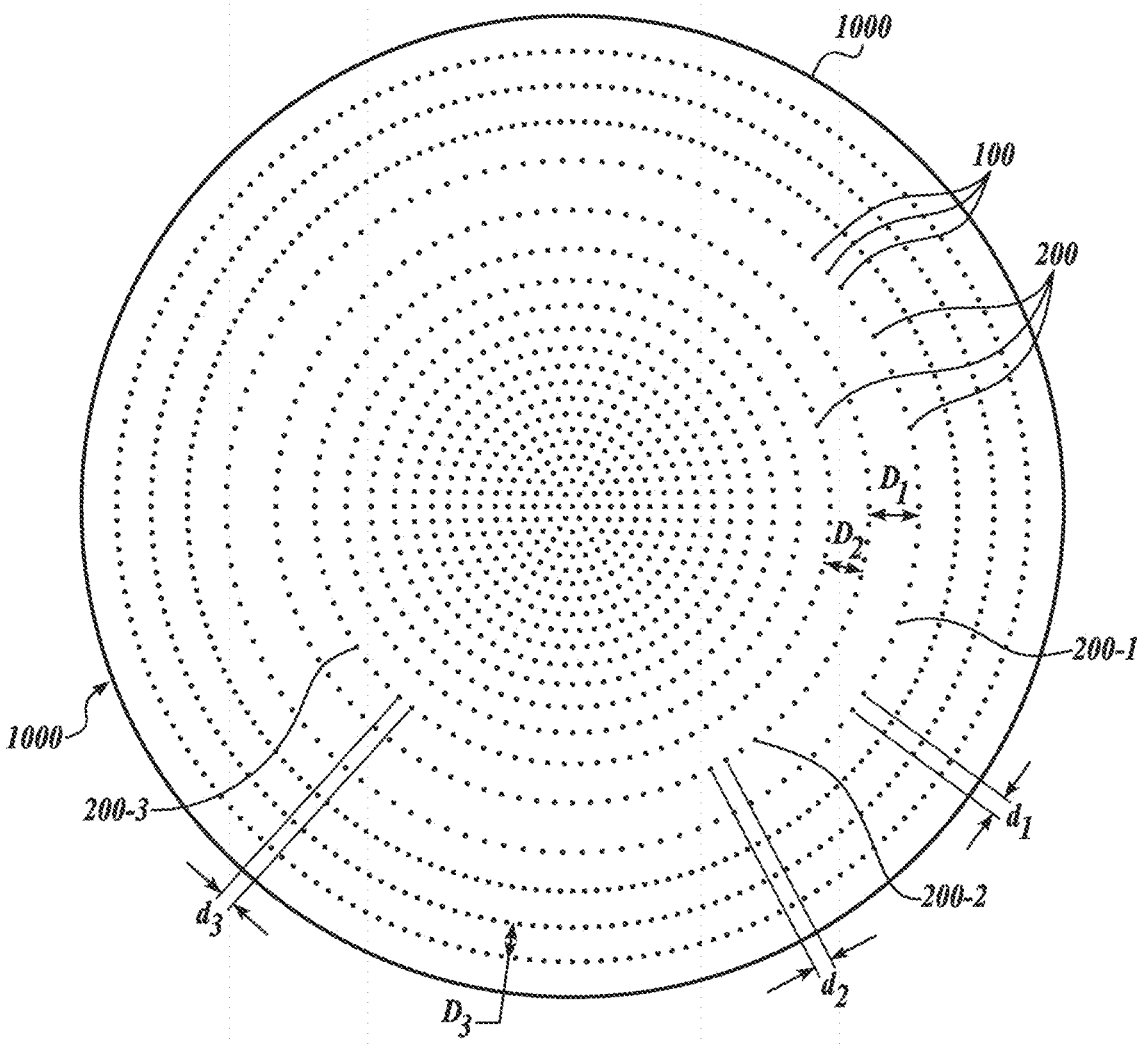
FIGS. 7A-7H are various exemplary schematic layouts of antenna elements in space tapered antenna lattices in phased array antenna systems in accordance with embodiments of the present technology.
Figure 7B:
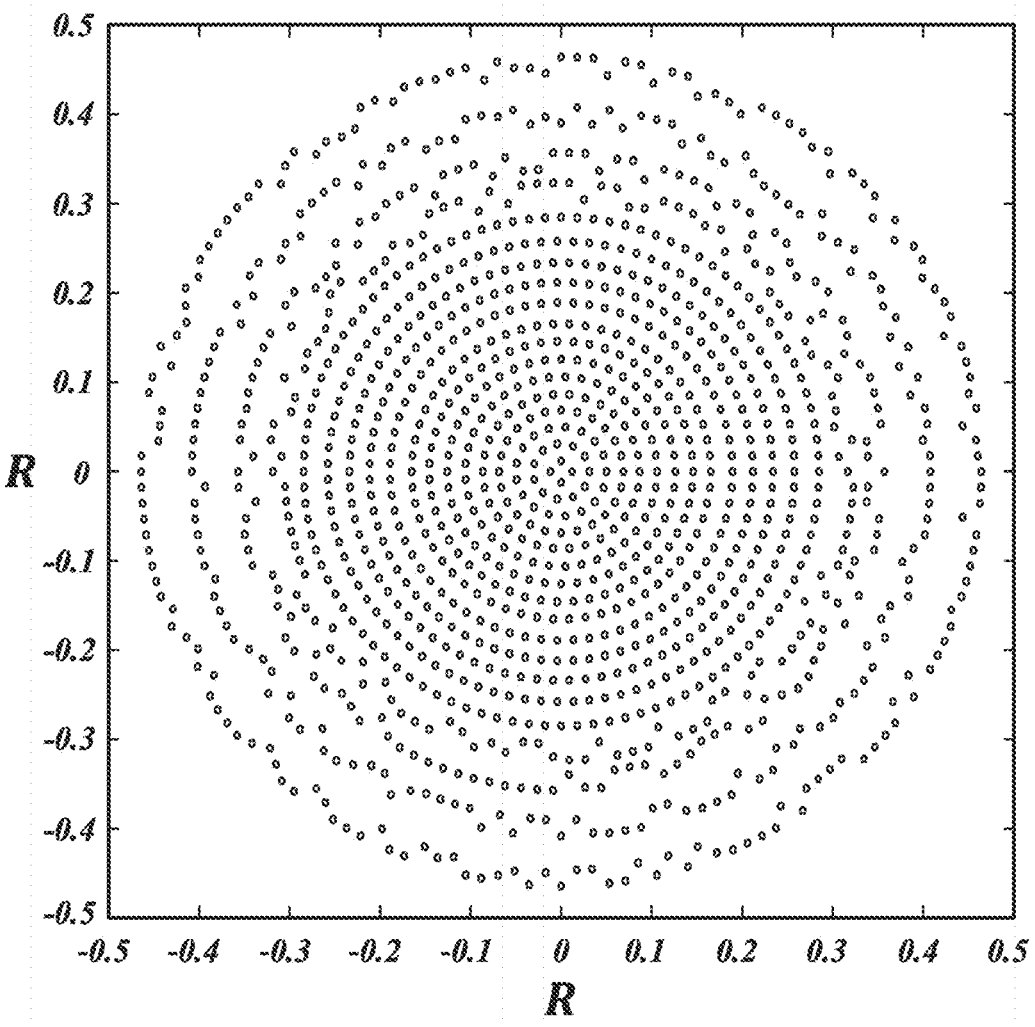

The antenna elements 122*i* may be distributed with a space taper configuration in one or more different arrangements. For example, in FIG. 1D, antenna elements 122*i* are configured in concentric circle or ring arrangements. In other embodiments of the present disclosure, adjacent antenna elements may be configured in other arrangements. See, for example, changes in space tapering from ring to ring in FIG. 7A, oscillating ring arrangements in FIGS. 7B, 7C, 7E, 7F, non-concentric or non-conforming ring arrangements in FIG. 7D, and other non-circular progressive polymer arrangements, such as elliptical, polygonal, or rectangular arrangements (see FIG. 7G). In other embodiments, variance in the arrangements may include having closed shapes having varied radial distances in an arrangement, random arrangements, or mathematically-defined arrangements. In some embodiments, the arrangements may not be closed, for example the arrangements may be shaped as incomplete circles or ellipses. In some embodiments, the shape of the arrangements may be different than the shape of the carrier, for example, circular arrangements may be carried by a rectangular carrier.

A series of close-shaped arrangements are illustrated in the present disclosure, for example, having a closed circular shape for each of the arrangements of antenna elements. However, open-shaped arrangements are also possible, for example the antenna elements arranged in a line or along a line (or a series of lines) extending from a center or from a vicinity of the center of the carrier toward the periphery of the carrier. Referring to FIG. 1D, the arrangements can be separated by a larger distance $D_1$ at the periphery of the carrier 112, followed by a smaller distance $D_2$ toward the center of the carrier, and so on. In some embodiments, several arrangements, for example several centrally located arrangements, can be separated by the same or similar distance, while the distances among the peripheral arrangements are greater than those among the centrally located arrangements. In other embodiments, the distances among the peripheral elements may be smaller than those in the more centrally located arrangements.

In accordance with embodiments of the present disclosure, to achieve space tapering between arrangements, at least one distance between antenna elements in first and second arrangements are different than another distance between antenna elements in the second and third arrangements. These distributions/arrangements of the antenna elements having different distances between antenna elements are generally referred to as space-tapered distributions or layouts of the phased array antenna.

Further, the distances between the adjacent antenna elements in a given arrangement may differ from one arrangement to another. For example, referring to FIG. 1D, the distances between the adjacent antenna elements 122*i* can be $d_1$ in the outermost ring arrangement, $d_2$ in a subsequent ring arrangement, $d_3$ in a subsequent ring arrangement, and so on. In some embodiments, the distances D between the arrangements and/or distances d between the adjacent antenna elements 122*i* in a given arrangement at the periphery of the carrier 112 can reduce power of the side lobes and/or increase power of the central lobe of the emitted RF field.

Figure 5:
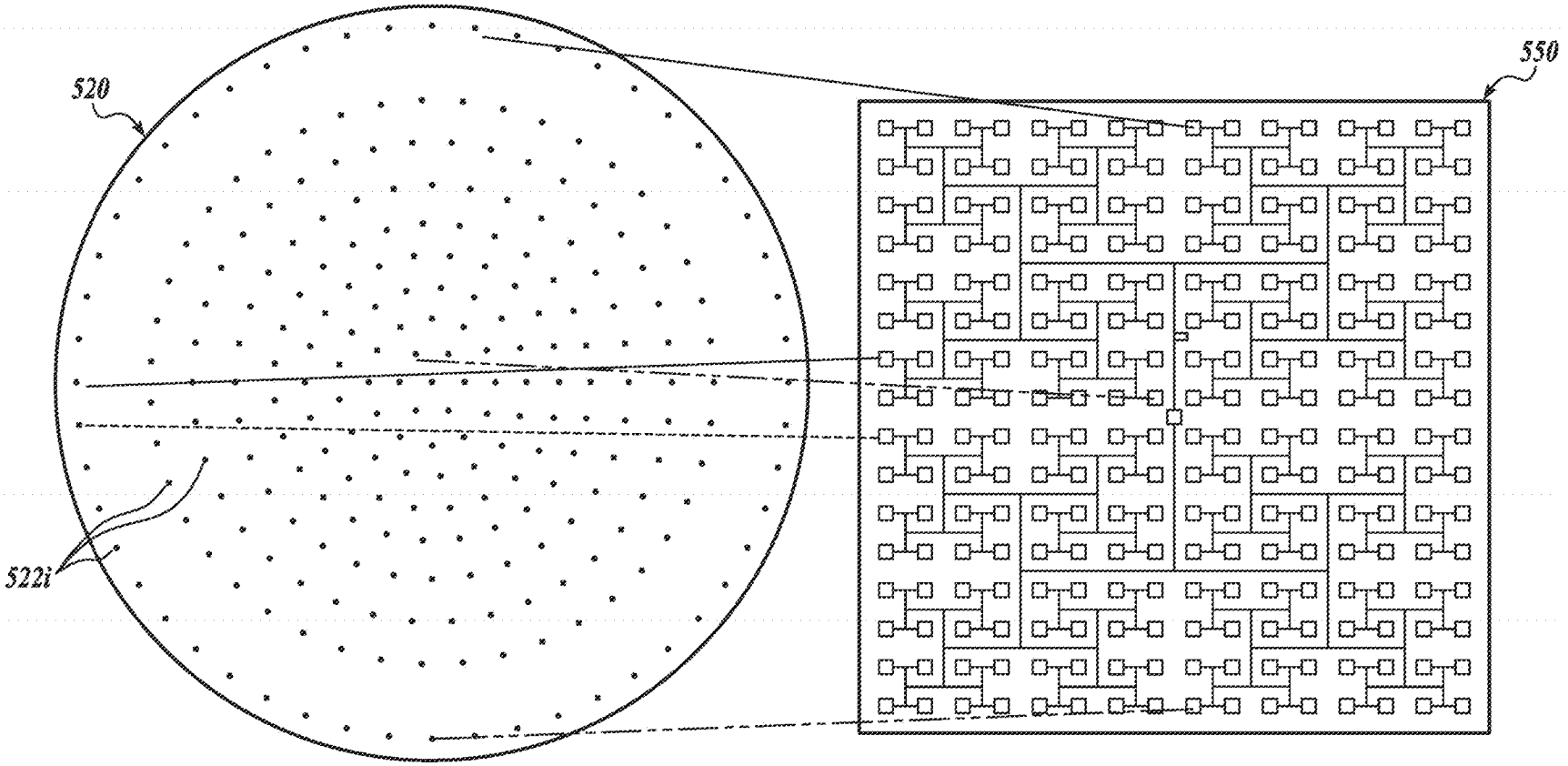
FIG. 5 is a schematic view of is a schematic view of an exemplary phased array antenna routing from feed network layer to an exemplary space tapered antenna lattice in accordance with an embodiment of the present technology.

FIG. 1E shows antenna elements 122*i* distributed over the carrier 112. In some embodiments of the present disclosure, the carrier 112 also carries amplifiers 124*i* (PAs/LNAs) (not shown) and beamformers 142*i* (shown on the opposite side of the carrier in FIG. 1E) electrically connected with individual antenna elements 122*i*. The carrier 112 may include one or more layers (also referred to as "routing layers," "metallization layers," or "trace layers"). In some embodiments, the layers of the carrier 112 may include one or more of a mapping layer, a multiplex feed network layer (for example, a hierarchical network or an H-network layer or other suitable feed network layer), a beamformer layer, and other layers. As a non-limiting example of a feed network formation layer, FIG. 5 is a schematic view of phased array antenna system routing from an exemplary H-network 550 to an antenna lattice 520 in accordance with an embodiment of the present technology.

Figure 6:
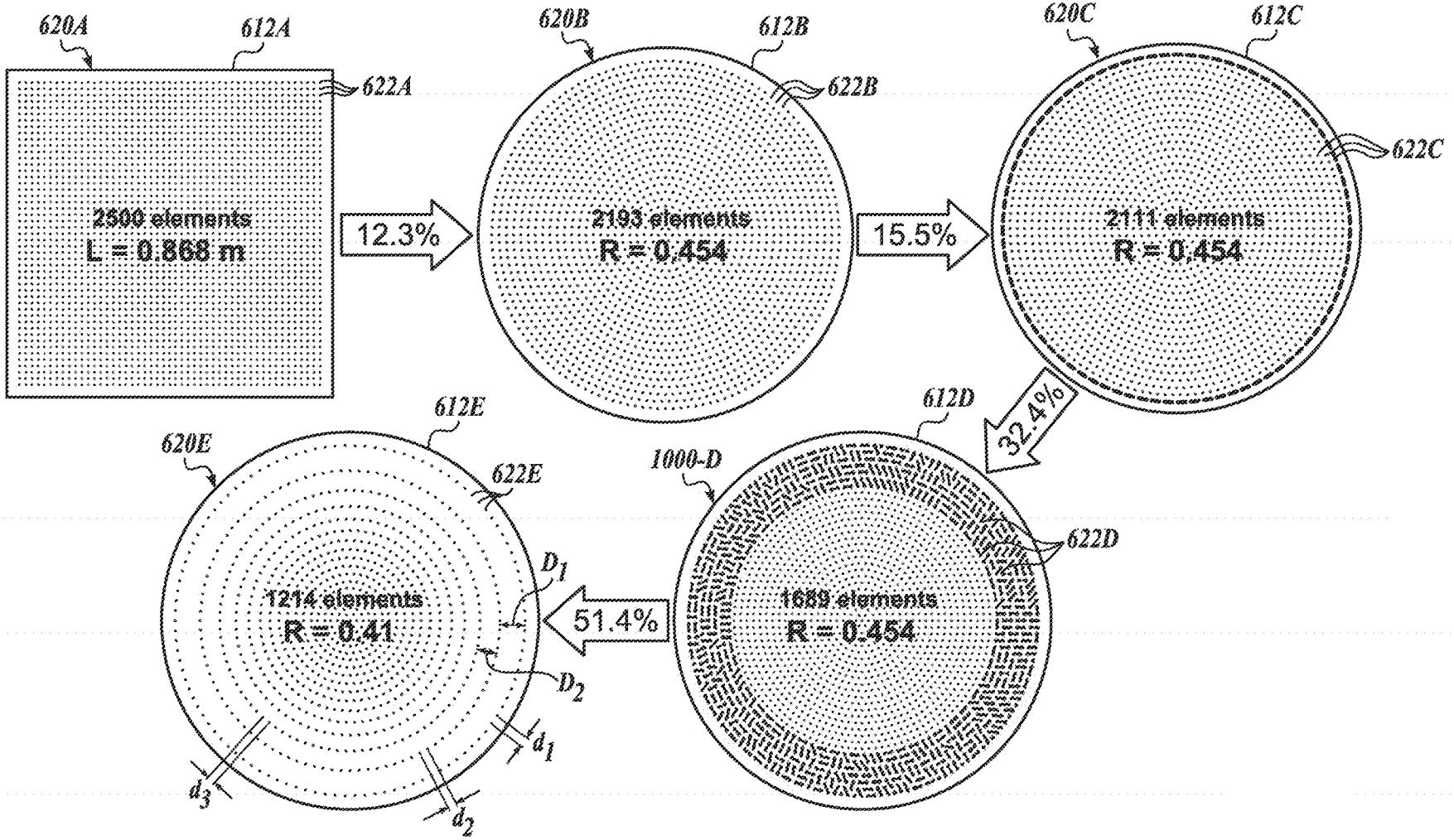
FIG. 6 is a process schematic showing the reduction of more than 50% of antenna elements in an exemplary space tapered antenna lattice in phased array antenna system in accordance with one embodiment of the present disclosure.

FIG. 6 is a schematic view of an exemplary illustration of reducing the number of individual antenna elements in a space tapered antenna lattice in accordance with one embodiment of the present technology. The sizes of the carriers and the numbers of the corresponding antenna elements are provided for illustration, and other sizes/numbers are also possible and within the scope of the present disclosure.

Starting from the upper-left antenna lattice 620A, antenna elements 622A are distributed in a uniform manner over an exemplary carrier 612A. In the illustrated example, 2500 antenna elements 622A are uniformly distributed over the square-shaped carrier 612A having sides L=0.868 m.

In a subsequent iteration of the process, the exemplary antenna lattice 620B changes from being square in shape to being circular in shape, having an exemplary radius R=0.454 m, one half of the length of a square-shaped carrier 612A side. The circular carrier 612B carries 2193 concentrically distributed antenna elements 622B, which is a 12.3% reduction in antenna elements compared to the number of the antenna elements 622A in antenna lattice 620A. In some embodiments, this lesser number of the antenna elements 622B may result in reducing unwanted side lobes of the RF signal.

In a subsequent iteration of the process, an exemplary antenna lattice 620C is also circular with a radius R=0.454 m. In this iteration, some peripheral antenna elements 622C are removed from the antenna lattice 620C, for example, the outmost arrangement of the antenna elements are coupled in partial subarrays. Therefore, the antenna lattice 620C includes a lesser number of the antenna elements 622C than the previous iterations. As a result of the coupling, the antenna lattice 620C includes 2111 antenna elements 622C, 82 elements less than antenna lattice 620B, which is a 15.5% reduction in antenna elements 622C compared to the antenna lattice 620A. In at least some embodiments, the removal of the peripheral antenna elements 622C may result in reduced power of the side lobes. In some embodiments, the entire peripheral arrangement of antenna elements 622C may be removed.

In a subsequent iteration of the process, an exemplary antenna lattice 620D is also circular with a radius R=0.454 m. In this iteration, the number of antenna elements 622D in the antenna lattice 620D is further reduced with some antenna elements 622D being removed from several peripheral arrangements, while central arrangements remain fully populated. In some embodiments, the peripheral arrangements may be entirely depopulated by removing all antenna elements 622D in some ring arrangements. As a result, the antenna lattice 620D includes 1689 antenna elements 622D, which is a 32.4% reduction in antenna elements 622D compared to the antenna lattice 620A. In at least some embodiments, the removal (depopulation) of the antenna elements from the peripheral arrangements may result in further reduction of the power of the side lobes.

In a subsequent iteration of the process, an exemplary antenna lattice 620E is also circular with a radius R=0.454 m. The antenna lattice 620E includes antenna elements 622E distributed with peripheral ring arrangements separated by a larger distance D (e.g., $D_1$) than the distance between more centrally located arrangements (e.g., $D_2$ and further toward the center of the carrier). As a result, the number of antenna elements in the antenna lattice 620E is further reduced to 1214, which is a 51.4% reduction in antenna elements 622E compared to the antenna lattice 620A. Furthermore, because of the smaller number of the peripheral antenna elements, the power of the side lobes also may be reduced.

In some embodiments, power to select antenna elements can be turned off or mapped to other antenna elements to create an effective space taper and an effective reduction in the antenna element count, in accordance with embodiments of the present disclosure. For example, some peripheral antenna elements in an antenna lattice can be turned off to reduce the power of the side lobes.

FIGS. 7A-7F are exemplary schematic layouts of individual antenna elements of the phased array antenna lattices in accordance with embodiments of the present technology. In some embodiments, at least some antenna elements are distributed in mathematically defined arrangements. For example, the arrangements may be defined as:

$$r_n=(r_{nom}+A\cos(B>))\cos(>)$$

where $r_n$ represents a distance of an individual antenna element form the center of the phased array antenna 1000, $r_{nom}$ represents a nominal radius of the arrangement, A and B are selectable constants, and > is a radial angle of the individual antenna element.

Figure 7C:
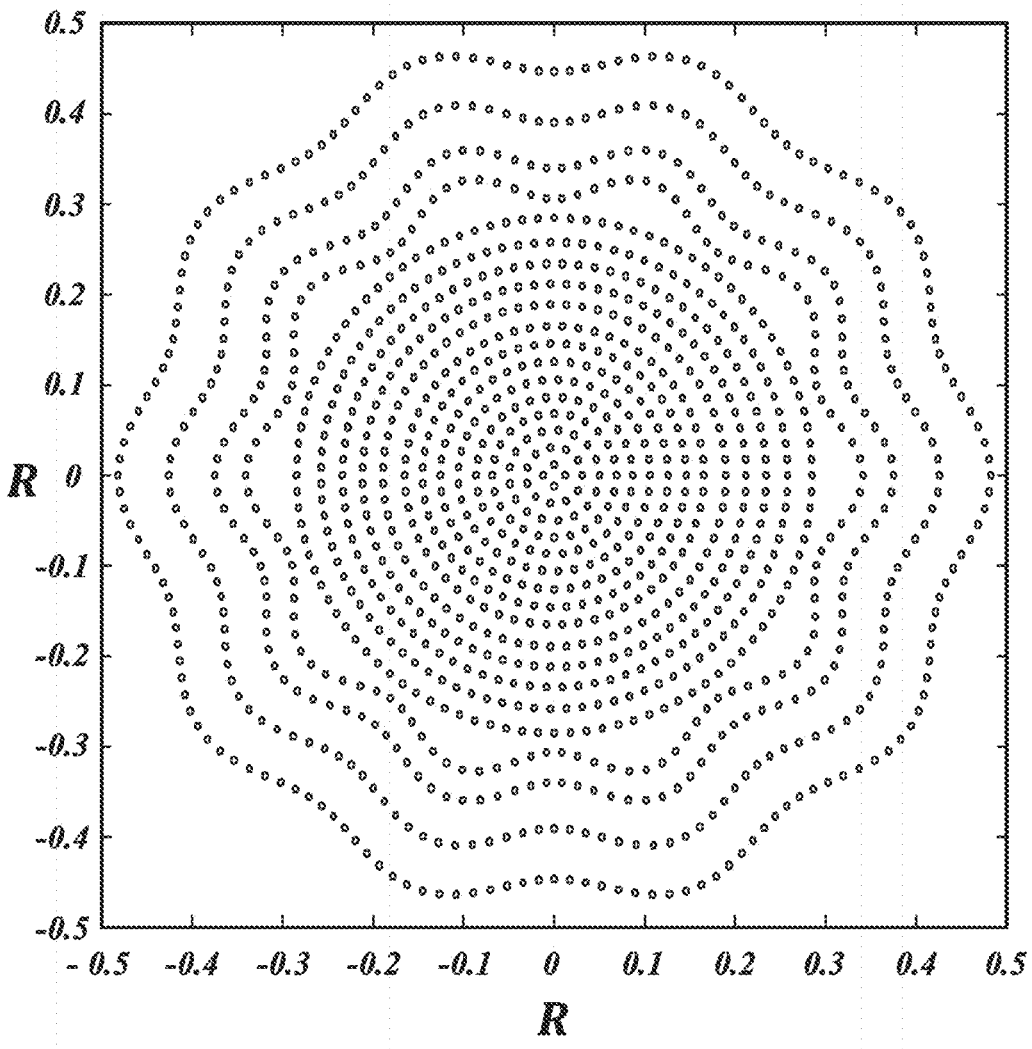
Figure 7D:
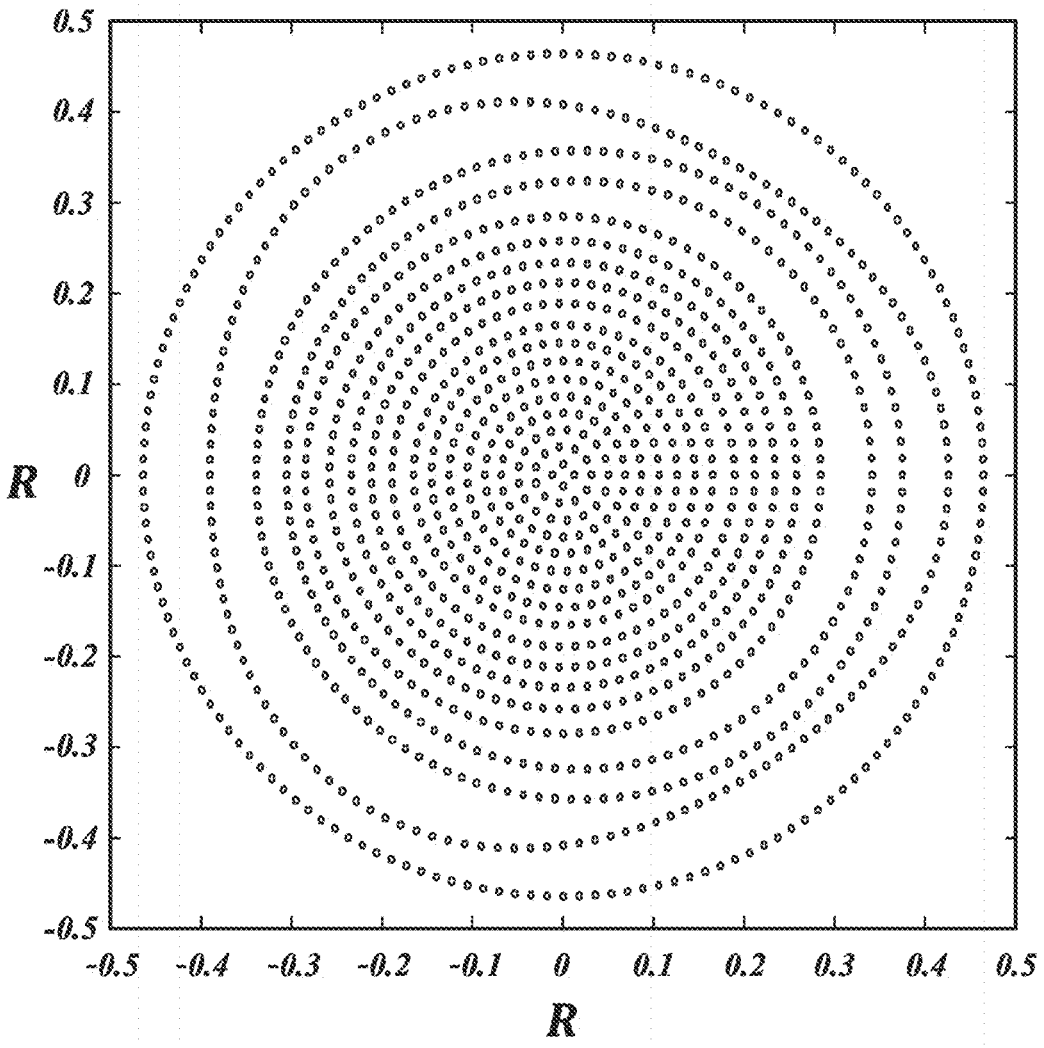
Figure 7E:
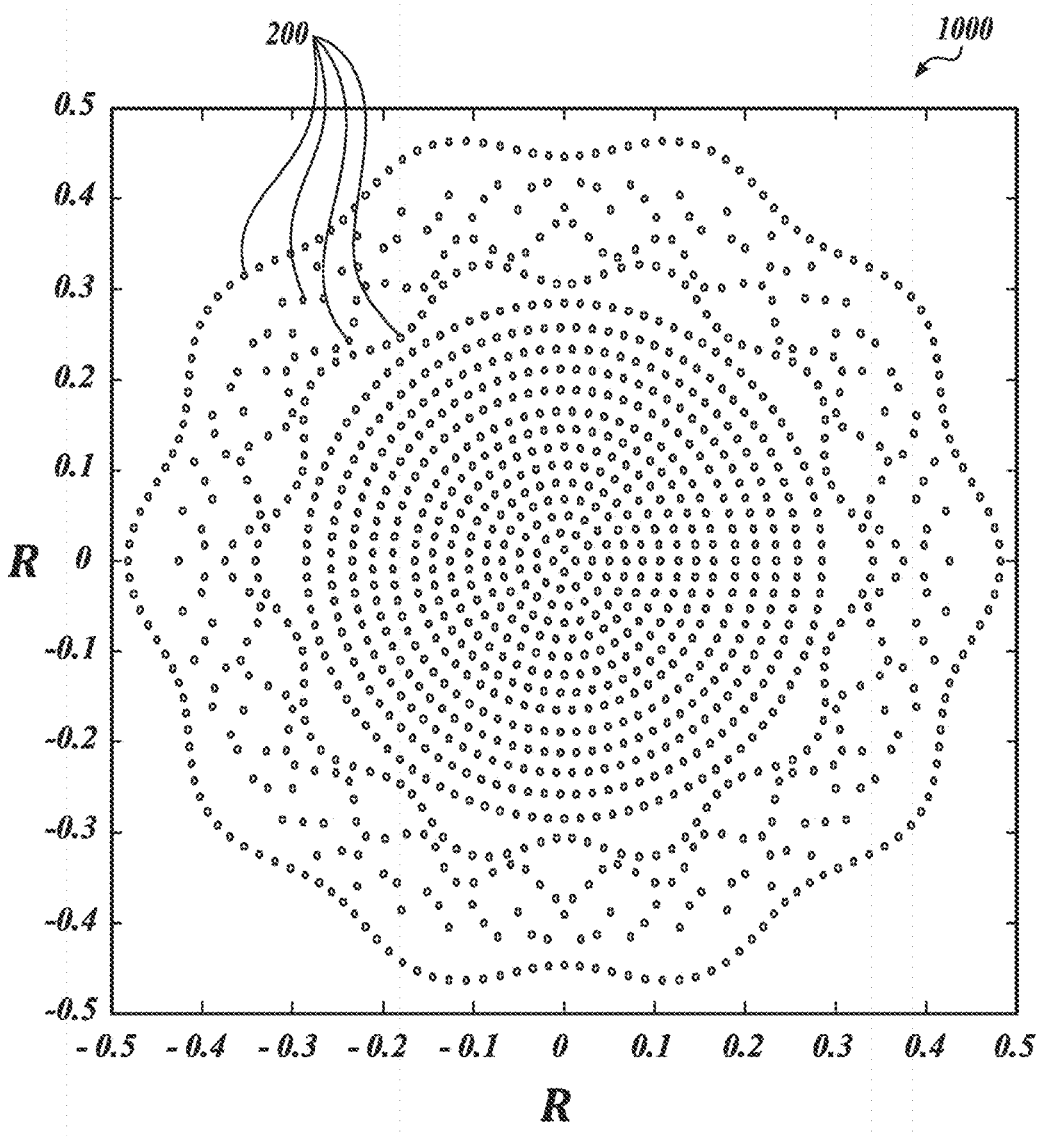
Figure 7F:
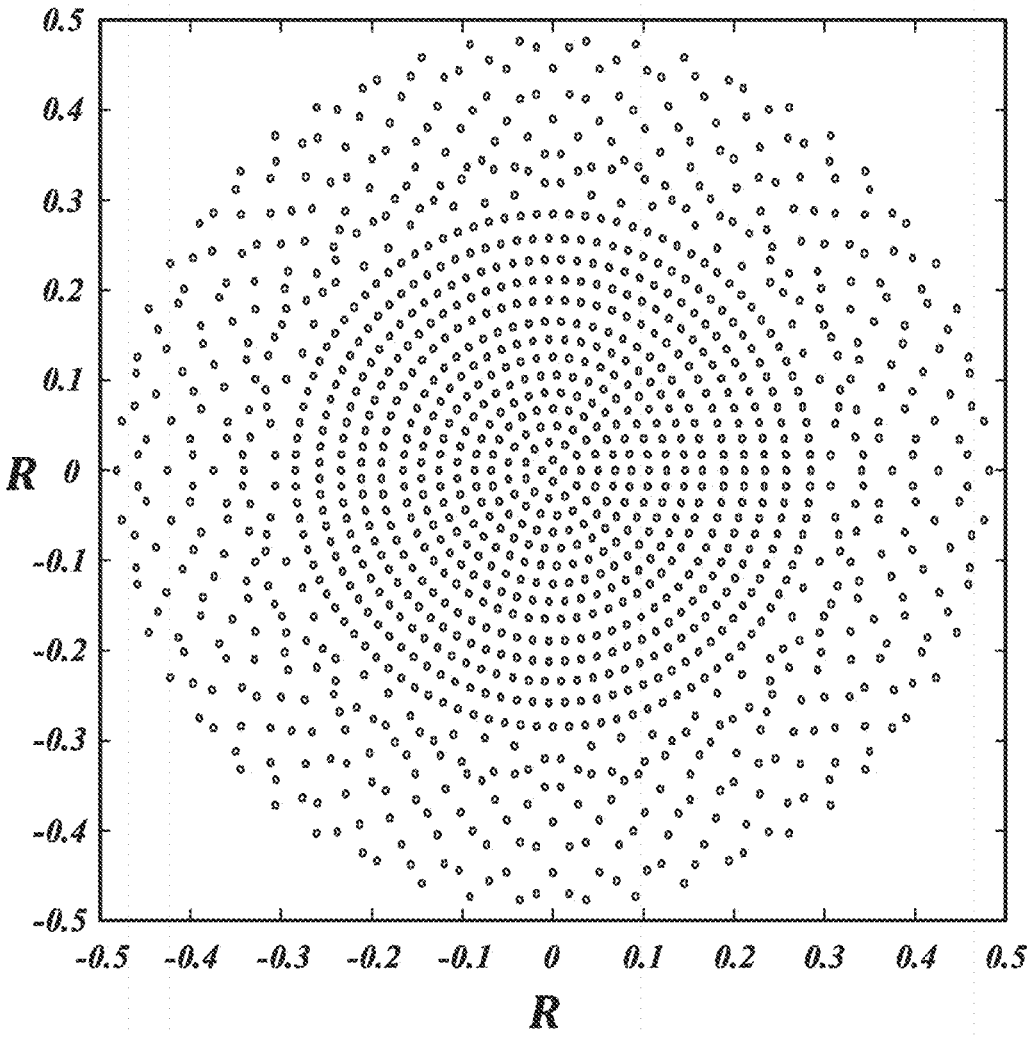

The above equation may be applied for some or all arrangements to obtain different layouts of the antenna elements. For example, FIGS. 7B-7F show antenna elements in irregular ring arrangements at the periphery of the phased array antenna and regular ring arrangements at the center of the phased array antenna. For example, FIG. 7C shows the antenna elements in four undulating arrangements at the periphery of the phased array antenna and regular ring arrangements at the center of the phased array antenna. FIG. 7D shows some non-circular or non-concentric ring arrangements at the periphery of the phased array antenna. In some embodiments, additional and/or non-peripheral arrangements can also be non-concentric. FIG. 7E shows a "sunflower" distribution of peripheral arrangements. A sunflower distribution in accordance with embodiments of the present disclosure may have a mix of concentric arrangements and varied arrangements, such as oscillating arrangements. FIG. 7F shows antenna elements in more regular centrally-located ring arrangements and less regular peripherally-located arrangements.

Figure 7G:
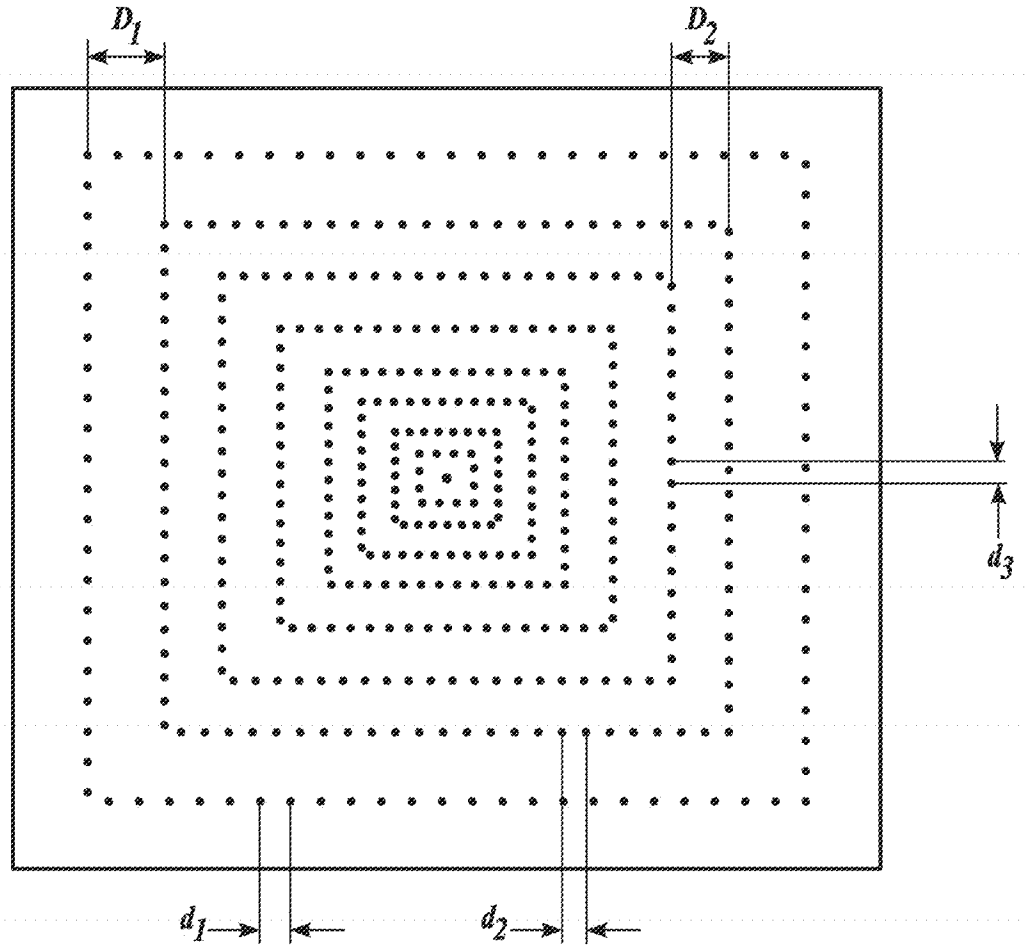

FIG. 7G is a schematic layout of individual antenna elements of a phased array antenna in accordance with an embodiment of the present technology. The antenna elements may be distributed into several arrangements. In some embodiments, the arrangements are rectangular. The arrangements may be separated by different distances, for example, the distance $D_2$ may be greater than the distance $D_1$.

Figure 7H:
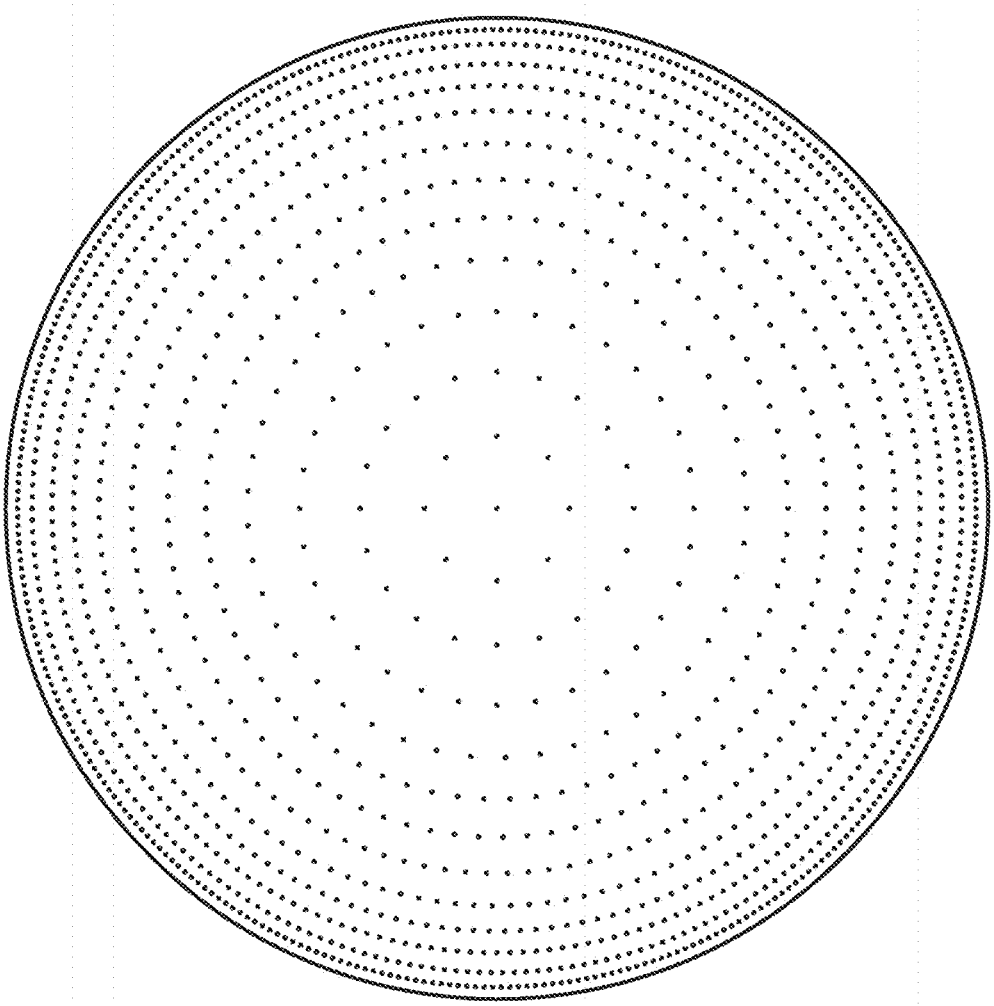

FIG. 7H is a schematic layout of individual antenna elements of a phased array antenna in accordance with an embodiment of the present technology. The antenna elements may be distributed into several ring arrangements. The arrangements may be separated by different distances, for example, the arrangements may be spaced closer together at the periphery of the phased array antenna, while being spaced at larger distances at the center of the phased array antenna. In some embodiments, distances between the adjacent antenna elements in the peripheral arrangements are smaller than the distances between the adjacent antenna elements in the more centrally-located arrangements.

Figure 8A:
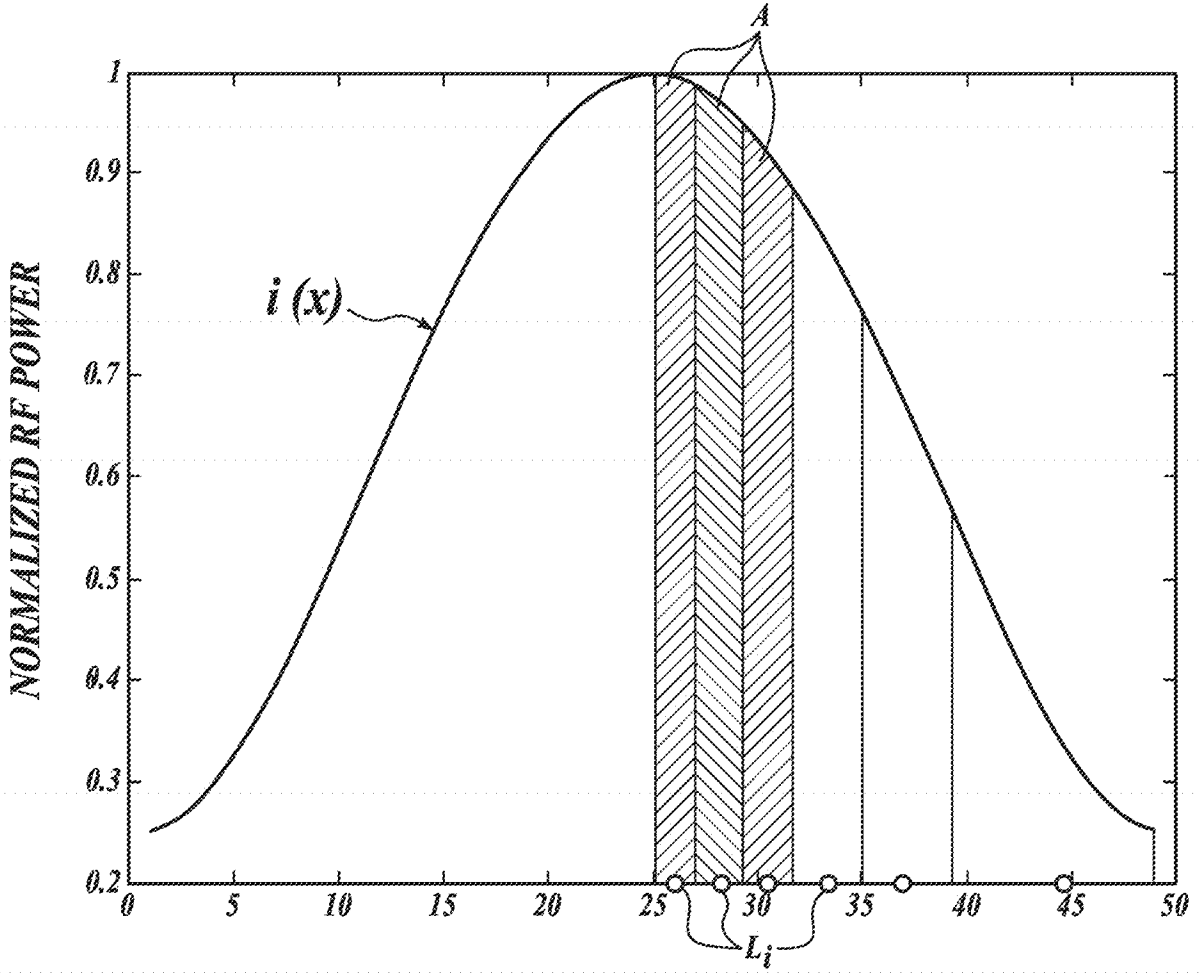
FIGS. 8A and 8B are graphs of exemplary distribution of individual antenna elements in an exemplary phased array antenna system in accordance with embodiments of the present technology.
Figure 8B:
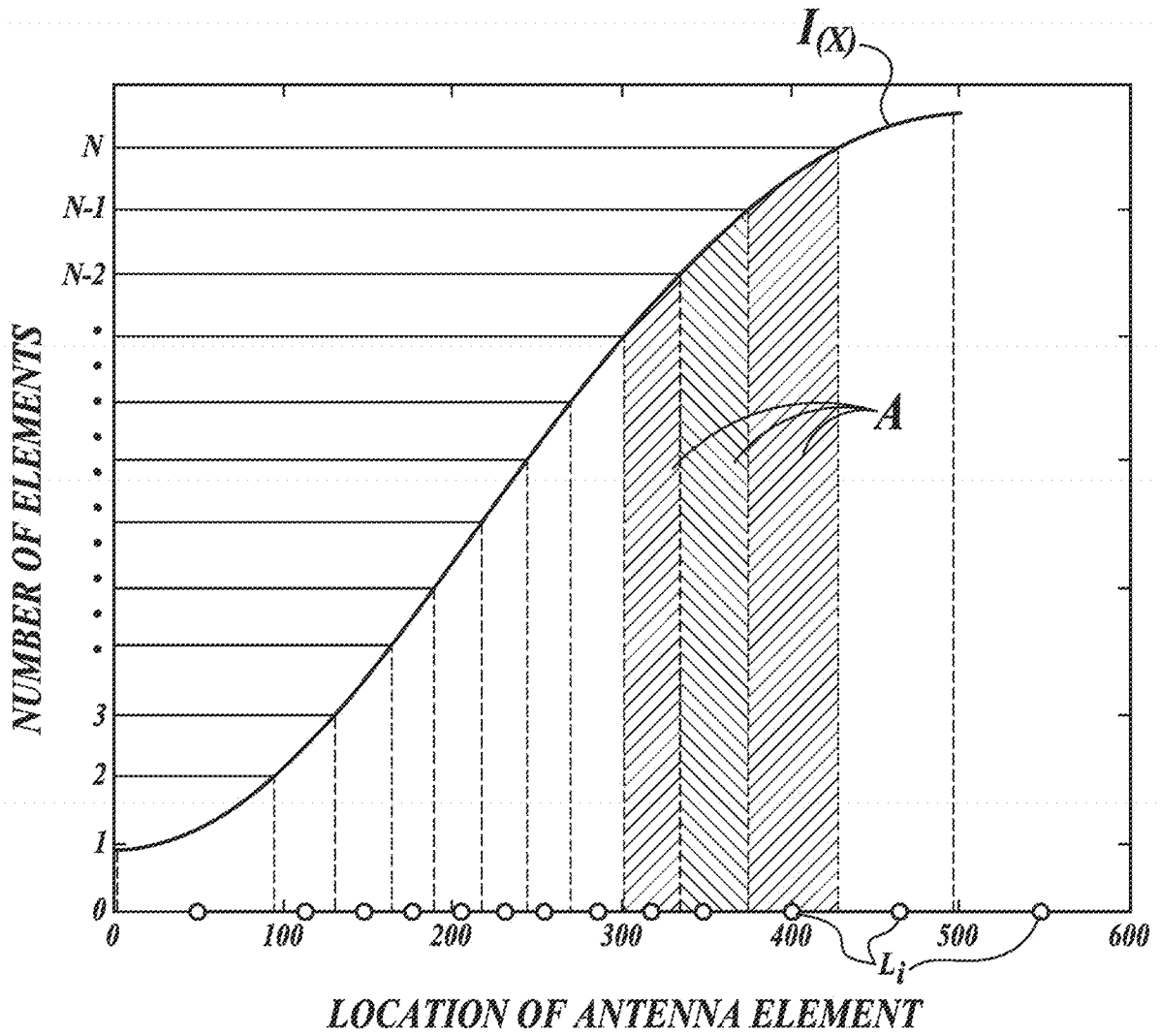

FIGS. 8A and 8B are graphs of distribution of individual antenna elements in accordance with embodiments of the present technology. The graph in FIG. 8A shows an amplitude distribution i(x) (e.g., amplitude of the central lobe).

The illustrated amplitude distribution is Taylor 30 dB, but other amplitude distributions are also possible. The horizontal axis is a normalized location of antenna elements. The normalization may be performed, for example, with respect to the characteristic dimension of the carrier that carries the antenna elements. The vertical axis is a normalized RF power. The normalization may be performed, for example, with respect to the full specified power of a pair of the PA and antenna element. The normalized location of antenna elements can be defined by dividing the area under the curve i(x) into a desired number of segments that have same area A. As a result, the central areas will be narrower, and the peripheral areas will be wider. Locations Li on the horizontal axis denote a middle point of a given area under the curve, which corresponds to the location of the antenna element 100 in a radial direction. As a result of normalization, the antenna elements at the periphery of the phased array antenna (e.g., closer to the horizontal axis values of 0 and 50) will be further apart than the antenna elements closer to the middle of the phased array antenna (e.g., closer to the horizontal axis values of 25).

FIG. 8B illustrates another embodiment of a method for determining locations of the antenna elements. The horizontal axis represents a normalized location of the antenna elements. The vertical axis is divided into N portions, representing N antenna elements. The curve I(x) represents a cumulative distribution function of the desired amplitude distribution i(x), where i(x) can be, for example, Taylor 30 dB. Therefore, I(x) can be determined as:

$$I(x)=CDF(i(x)).$$

The intersection of the N horizontal lines with the curve I(x) determines a group of areas A. The areas A are defined by a segment of the horizontal axis, a segment of the curve I(x), and two vertical lines. The middle of an individual segment of the horizontal axis determines a location $L_i$ of the antenna element $N_i$. Again, the antenna elements at the periphery of the phased array antenna (e.g., closer to the horizontal axis value of 600) will be further apart than the antenna elements closer to the middle of the phased array antenna (e.g., closer to the horizontal axis values of 0).

Figure 8C:
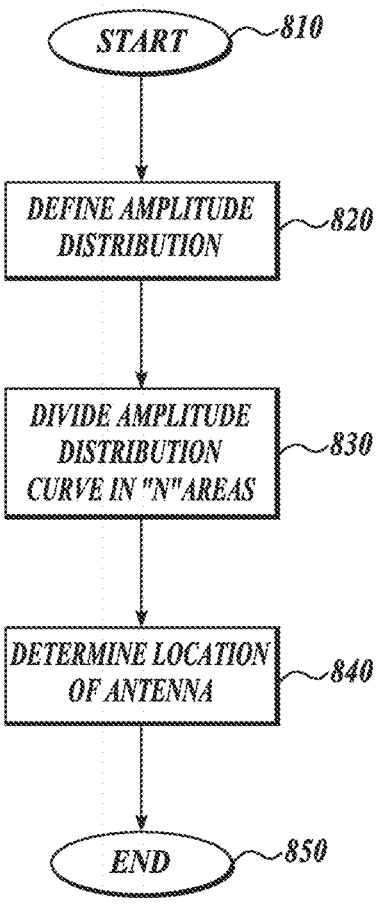
FIG. 8C is a flow diagram of a method for distributing individual antenna elements in an exemplary phased array antenna system in accordance with embodiments of the present technology.

FIG. 8C is a flow diagram of a method for distributing individual antenna elements in accordance with embodiments of the present technology. The method can start at step 810 by, for instance, defining a number N of the ring arrangements of the antenna elements.

In step 820, a desired amplitude distribution is defined for the main lobe of the RF signal. For example, a Taylor 30 dB distribution can be used. The desired amplitude distribution can be plotted or tabulated for subsequent use.

In step 830, the total area under the amplitude distribution curve is divided into the N subareas A, each having the same surface. In some embodiments, the total area can be divided into the subareas using the CDF described with reference with FIG. 8B.

In step 840, a location of each antenna element is determined as an abscissa of the middle point of the corresponding subarea A. The method can end in step 850.

Figure 9A:
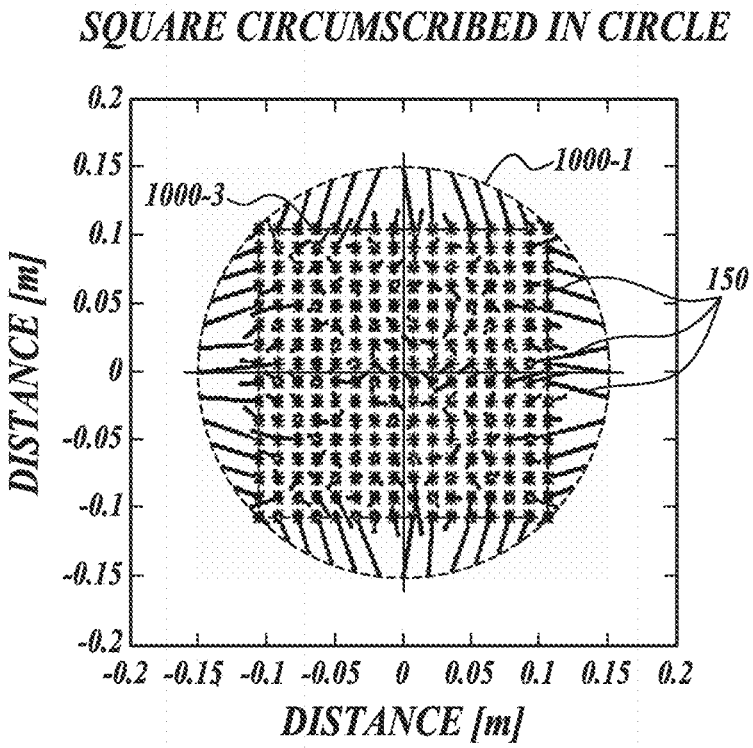
FIGS. 9A-9C are schematic views of phased array antenna routing in accordance with embodiments of the present technology.
Figure 9B:
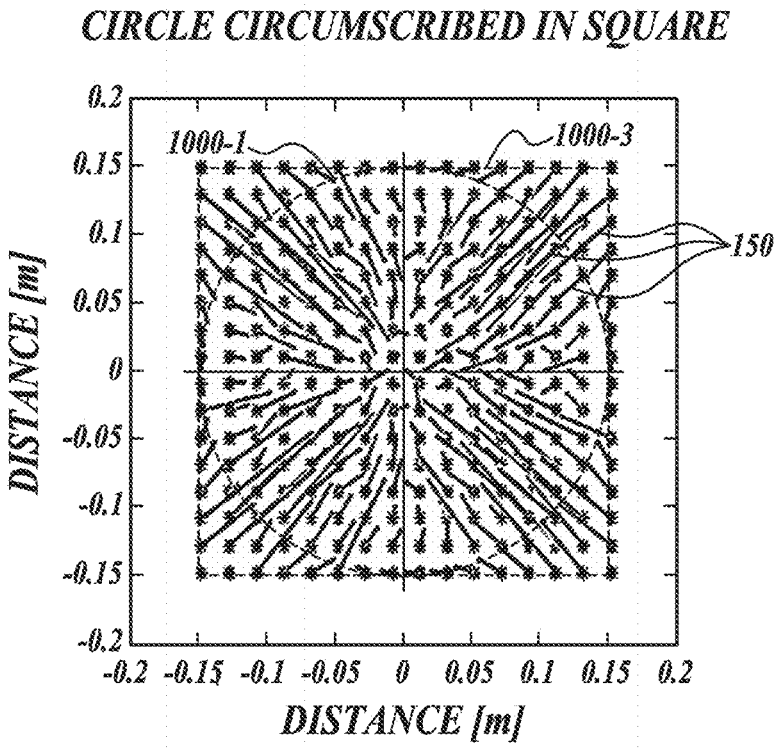
Figure 9C:
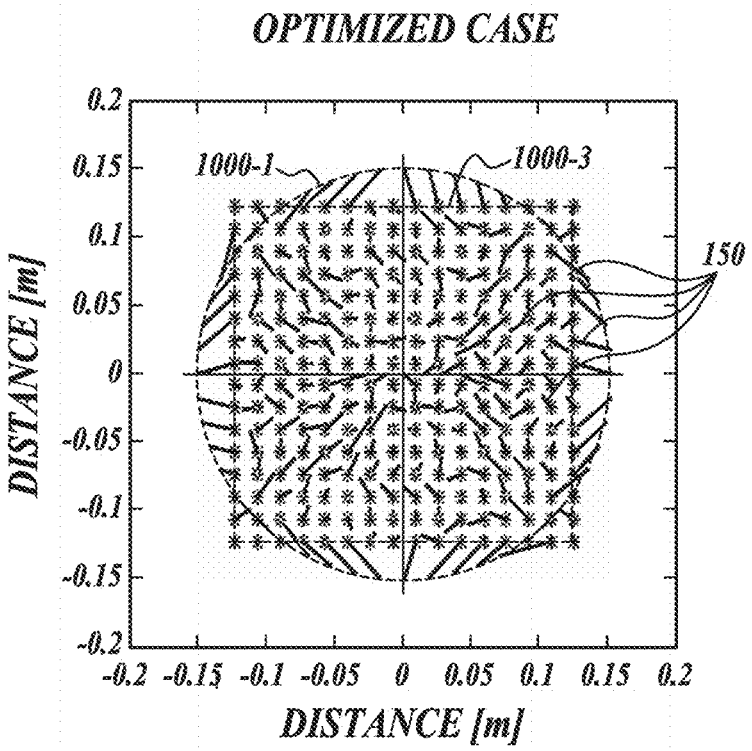

FIGS. 9A, 9B, and 9C are schematic views of the phased array antenna routing in accordance with embodiments of the present technology. Each of FIGS. 9A, 9B, and 9C shows a top view of the antenna lattice overlaid over the H-network layer or a beamformer lattice. The conductive traces connect pads of the H-network layer or a beamformer lattice to the antenna elements (or to the PAs, LNAs, or phase shifters of the individual antenna elements). In some embodiments, a Hungarian Algorithm can be used to route the traces, but other routing algorithms are also possible.

The three embodiments illustrated in FIGS. 9A, 9B, and 9C correspond respectively to square (i.e., the beamformer lattice) circumscribed in circle (i.e., the antenna layer), circle circumscribed in square, and square and circle intersecting. As explained above, to keep the signals in phase from the beamformer layer to the antenna lattice, the length of the individual traces of the mapping layer should be as uniform as possible. Furthermore, the individual traces of the mapping layer should be laid out (routed) without overlap or crossing of the traces, and the length of connections between antenna elements and feed network elements should be minimized. FIG. 9A shows that the traces are generally longer in the vicinity of the middle of the sides of the beamformer lattice. Analogously, FIG. 9B shows that the traces are generally longer in the vicinity of the corners of the beamformer lattice. A statistical comparison of the length of the individual trace is shown in FIG. 9D below.

Figure 9D:
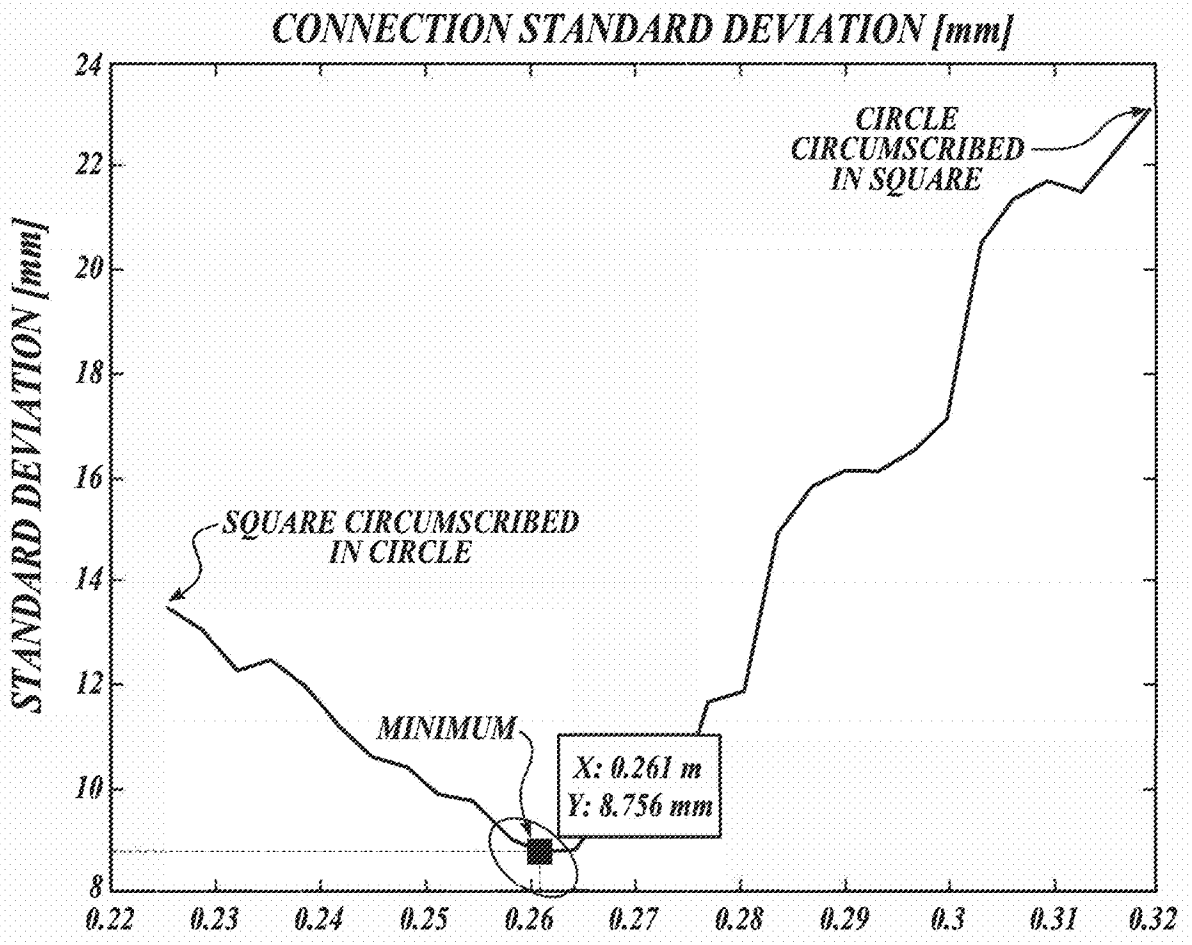
FIG. 9D is a graph of standard deviation of phased array antenna routing in accordance with one embodiment of the present technology.

FIG. 9D is a graph of standard deviation of the length of traces in accordance with an embodiment of the present technology. Generally, a smaller standard deviation corresponds to a higher uniformity of length within the population of traces, resulting in a higher uniformity of the signal phase. The horizontal axis shows a characteristic length of the beamformer in meters (e.g., a side of the square). The vertical axis shows a standard deviation of the length of the traces in millimeters. When the square (the H-network layer) is circumscribed in circle (the antenna layer), the side of the square is about 0.225 m, and the standard deviation is about 13.5 mm. When the circle (the antenna layer) is circumscribed to the square (the H-network layer), the side of the square is about 0.315 m, and the standard deviation is about 23 mm. For the illustrated embodiment, the minimum standard deviation of 8.756 mm is obtained for the square having the side 0.261 long, corresponding to the scenario shown in FIG. 9C. In some embodiments, other statistical moments can be used to optimize the length of the traces. For example, skewness (third central moment) or kurtosis (forth central moment) can be used.

Example: RF Signal from Space Tapered Phased Array Antenna System

Referring to FIG. 2, a graph of phased array antenna RF signal generated in accordance with an embodiment of the present technology. The simulation was run for the RF signal at 11 GHz. Coordinates u and v are derived from the spherical coordinate system as:

$u=\sin\theta\cos\varphi$; and $v=\sin\theta\sin\varphi$.

The vertical axis corresponds to signal power in dB. The simulated signal is perpendicular to the plane of the antenna elements, but other directions of the signal (i.e., direction of the main lobe) are also possible with the phased array antenna. For the simulated signal in the present example, the power of the main lobe is about 38.5 dB, while the power of the side lobes is at or below 30.9 dB. Therefore, the side lobes are almost 70 dB weaker than the main lobe, which indicates a relatively high SNR.

Interspersed Antenna Lattice

As described above, arrays of differently operating antenna elements may be interspersed in the antenna aperture to make optimal use of the surface of the carrier and to increase the number of beams (communication links) emitted or received by a phased array antenna system, in accordance with embodiments of the present disclosure. Interspersing of antenna elements may be implemented in a space taper configuration, as described above, or in other uniform or non-uniform configurations.

In accordance with one embodiment of the present disclosure, a phased array antenna system, includes a carrier, a first plurality of antenna elements carried by the carrier and configured to transmit and/or receive signals at a first value of a parameter, and a second plurality of antenna elements carried by the carrier and configured to transmit and/or receive signals at a second value of the parameter different from the first value of the parameter. The individual antenna elements of the first plurality of antenna elements are interspersed with individual antenna elements of the second plurality of antenna elements.

In some embodiments, the interspersed arrays of antenna elements may have regular interspersing. For example, the antenna elements may be arranged within interspersed rectangles, circles, or other arrays. In some embodiments, the interspersed arrays may have irregular shapes or irregular interspersing.

In many embodiments of the present disclosure, an advantage of interspersing two or more arrays or groupings of antenna elements results in improvements to the phased array antenna. When operating at different values of the parameter (e.g., operating at different frequencies), the neighboring individual antenna elements interact less than when operating at the same parameter (e.g., operating at the same frequency). As a result, the individual antenna elements may be distributed more densely in the phased array antenna system, the cross-talk between the neighboring antenna elements may be reduced, and/or data rates may be increased.

In some embodiments, the interspersed groups or arrays of the antenna elements may operate at more than one different value of a parameter. For example, the first group of antenna elements may receive data at frequency f1, the other group of antenna elements may transmit data at frequency f2. In addition, the first group of antenna elements may receive data at a polarization angle α, and the second group of antenna elements may receive data at a polarization angle β. Other differences between the interspersed groups are also within the scope of the present disclosure. As described in greater detail below, the carrier may support more than two interspersed groups.

Figure 10A:
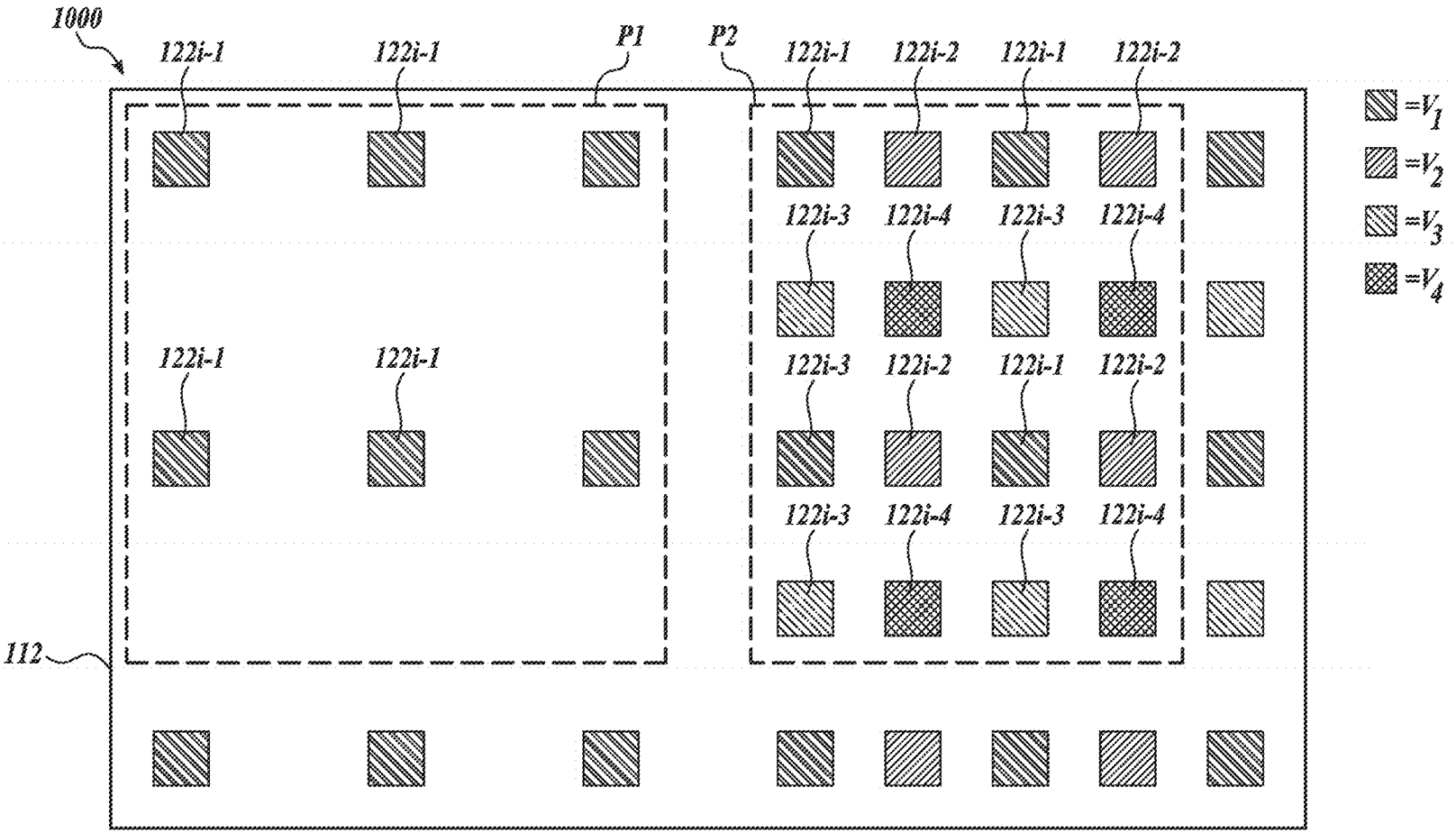
FIG. 10A is a schematic layout of individual antenna elements in an interspersed antenna lattice of a phased array antenna system in accordance with one embodiment of the present technology.

FIG. 10A is a schematic layout of individual antenna elements of an exemplary phased array antenna system 1000 in accordance with an embodiment of the present technology. The antenna elements 122-*i* may be placed over a carrier 112. In some embodiments, the interspersing may be applied over the entire phased array antenna or only a portion of the phased array antenna. For example, in FIG. 10A, a phased array antenna includes an interspersed layout on a portion P1 of the carrier 112 and a conventional one-parameter layout of the antenna elements on another portion P2 of the carrier 112.

The illustrated phased array antenna system 1000 includes a one-value antenna element layout in portion P1 and a four-value antenna element layout in portion P2. The four values $V_1$-$V_4$ may correspond to different values of the same parameter (e.g., frequencies f1-f4) or different parameters (e.g., frequency f1-polarization angle α, frequency f2-polarization angle α, frequency f2-polarization angle α, and frequency f1-polarization angle β).

Although shown as a four-value antenna element layout, any number of different values of parameter or combination of parameters for antenna element groupings is within the scope of the present disclosure. For example, the antenna element layout may include two, three, five, or more interspersed groupings having different values of parameter or combination of parameters for improved performance.

In at least some embodiments, a multiple-value layout of interspersed arrays of antenna elements enables a higher bandwidth, a smaller footprint of the phased array antenna, or both. For example, the antenna elements 122-1 (collectively referred to as a "group" or "array") may receive data at frequency $f_1$ and polarization angle α, while the antenna elements 122-2 receive data at frequency $f_2$ and polarization angle β. Furthermore, the antenna elements 122-3 may be configured to receive data at frequency $f_2$ and polarization angle α, while the antenna elements 122-4 are configured to receive data at frequency $f_1$ and polarization angle β. Other combinations of parameters associated with individual antenna elements 122-*i* are also within the scope of the present disclosure (e.g., frequency, polarization, beam orientation, data streams, receive (RX)/transmit (TX) functions, time multiplexing segments, etc.).

In some embodiments of the present disclosure, the antenna elements of, for example, the first and second pluralities operate simultaneously or at about the same time. In other embodiments of the present disclosure, the antenna elements of the first and second pluralities operate at different times.

In some embodiments of the present disclosure, the antenna elements of, for example, the first and second pluralities both transmit and/or receive data. In other embodiments of the present disclosure, the antenna elements of the first and second pluralities operate to transmit or receive.

In some embodiments, the interspersed antenna elements need not follow a perpendicular row and column layout illustrated in FIG. 10A. Instead, at least a portion of the interspersed layout may be arranged in random configurations or in other patterns such as rectangles, circles, other polygons, in concentric or non-concentric arrangements, having regular and irregular other groupings, and alternating, repeating, or non-repeating patterns.

Figure 10B:
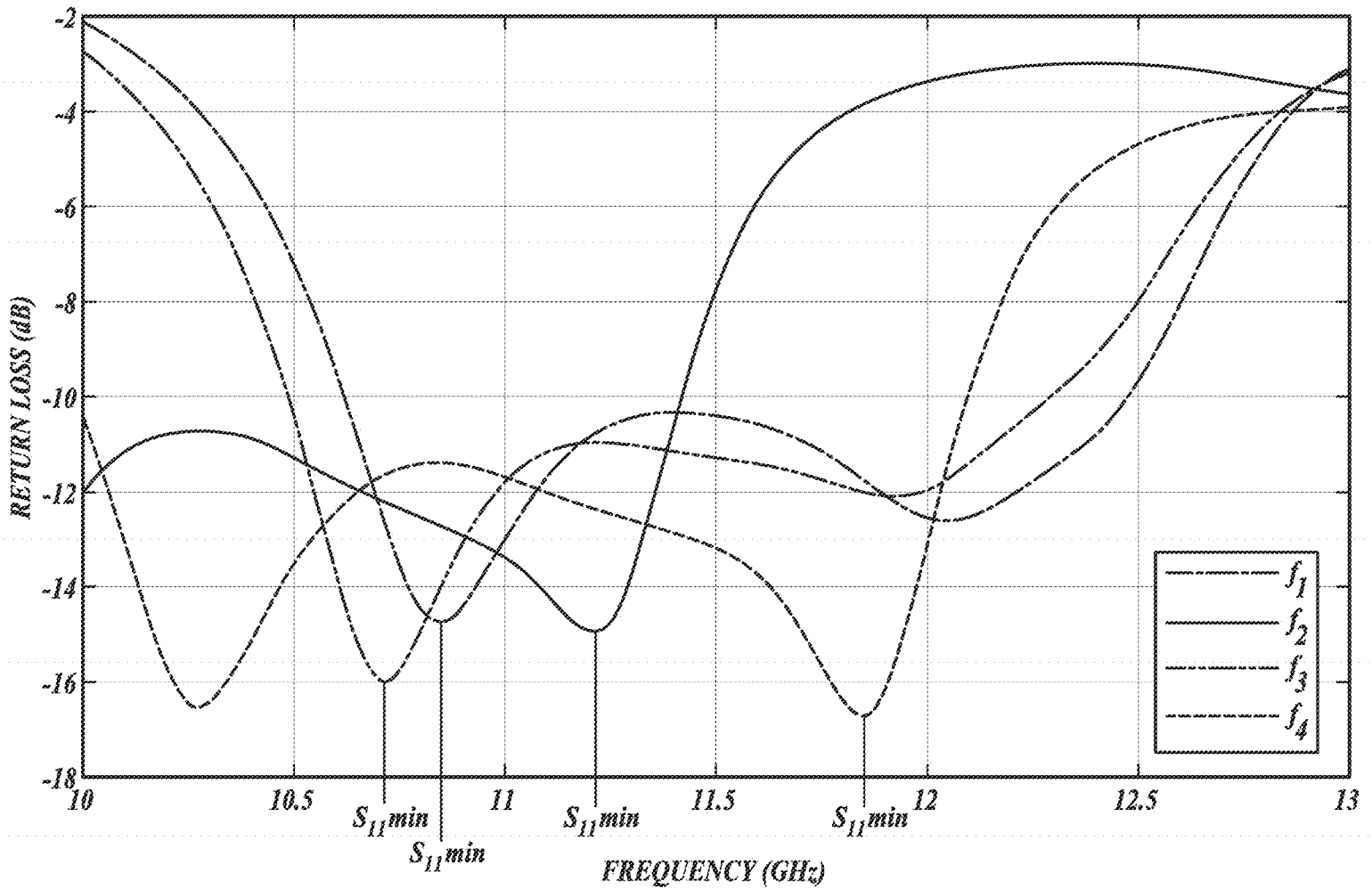
FIG. 10B is a graph of return loss vs. frequency for the antenna elements of FIG. 10A in accordance with one embodiment of the present technology.

FIG. 10B is a graph of return loss versus frequency in accordance with embodiments of the present technology. The illustrated graph shows simulation results that correspond to the layout including multiple groupings of antenna elements, where the simulated parameter is frequency. The horizontal axis shows the frequency of operation for the groups of the antenna elements in the multiple-value layout. The vertical axis shows the return loss in dB for each of the groups of the antenna elements 122*i*-1 to 122*i*-4.

The graphs of the return loss show that the minimum return loss (i.e., the $S_{11min}$ parameter) occurs at different frequency of operations: about 10.7 GHz, 10.85 GHz, 11.2 GHz, and 11.8 GHz for the antenna elements 122*i*-3, 122*i*-1, 122*i*-2, and 122*i*-4, respectively. Because the groups of antenna elements are sensitive to different frequencies, cross-talk is reduced.

In general, a lower value of the return loss (i.e., the $S_{11}$ parameter) indicates higher performance of the antenna. The simulated $S_{11}$ parameter for all groups of the antenna elements was below −14 dB. In many embodiments, the return loss of about −14 dB or below signifies a well-performing phased array antenna. Therefore, for the simulated phased array antenna of FIG. 10A, each group of antenna elements performs adequately at their corresponding frequencies, while the overall bandwidth of the phased array antenna is increased, because the phased array antenna may now operate at four values of frequency instead of just one (e.g., two frequency values for receiving signals RX at 10.7 GHz and 11.2 GHz, and two frequency values for transmitting signals TX at 10.85 GHz 11.8 GHz). Other frequency values and combinations of RX and TX are within the scope of the present disclosure.

Figure 11:
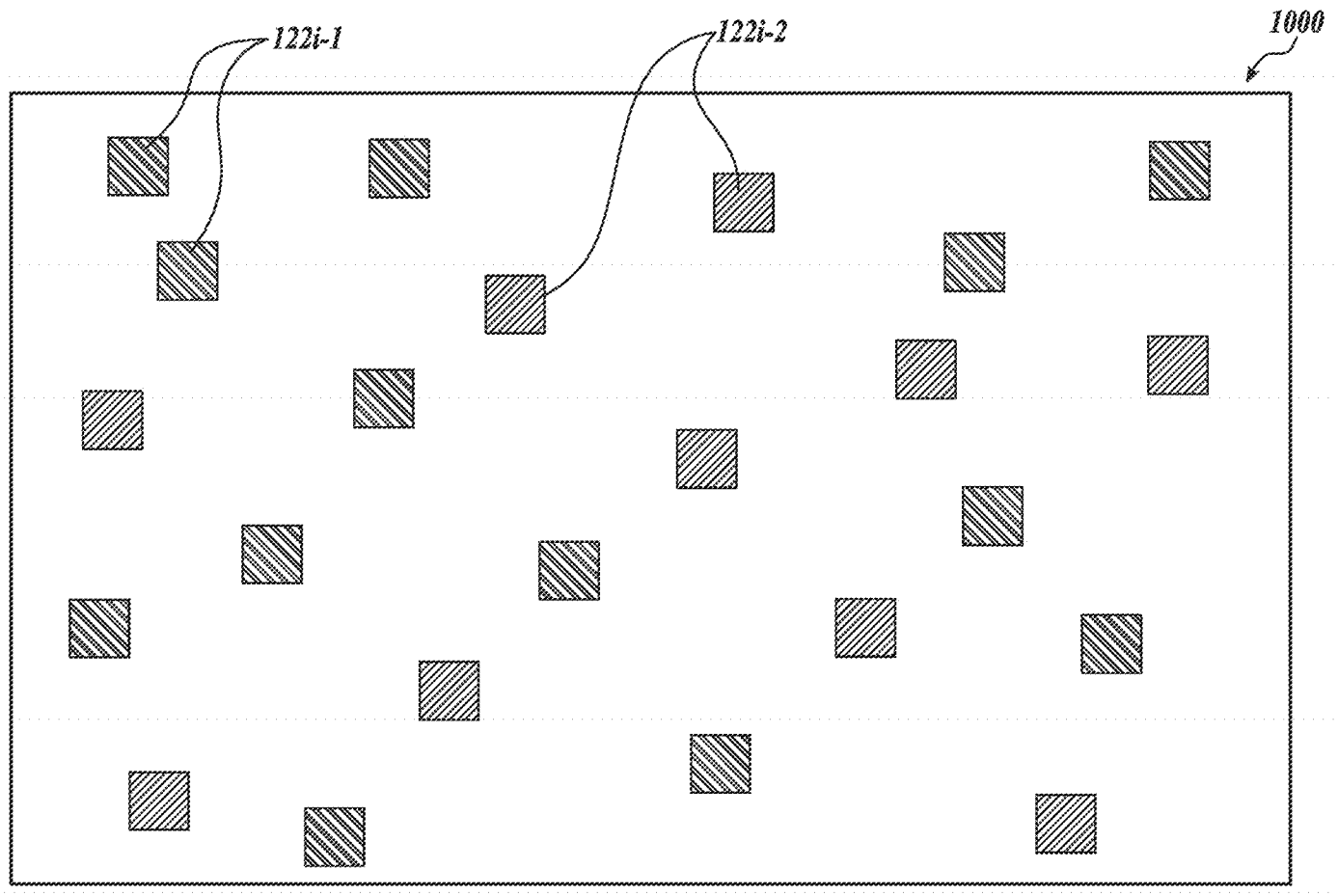
FIG. 11 is a schematic layout of interspersed individual antenna elements of a phased array antenna in accordance with one embodiment of the present technology.

FIG. 11 is a schematic layout of individual antenna elements of a phased array antenna in accordance with an embodiment of the present technology. In the illustrated embodiment, antenna elements 122*i*-1 operate at a first value of at least a first parameter (e.g., f1) while antenna elements 122*i*-2 operate at the second value of at least a first parameter (e.g., f2). In some embodiments, the antenna elements 122*i*-1 and antenna elements 122*i*-2 are interspersed in an irregular pattern where the individual antenna elements 122*i*-1 may be placed outside of the intersection of the rows and columns of a rectangular matrix. However, the individual antenna elements operating at a given value can still be properly phase-offset to produce required directivity of the RX and/or TX beam.

In operation, an array of antenna elements in an interspersed antenna lattice may operate at the first value of the parameter (e.g., frequency f1) such that all (or at least some) arrays, when properly phase-offset, interact to receive/transmit a beam of radio frequency (RF) signals at the required angle of orientation. Similarly, an array may operate at the second value of the parameter (e.g., frequency f2) as to receive or transmit another beam of RF signals at different frequency at same or different angle of orientation. The different arrays may also receive or transmit their RF beams at different values of the same parameter or of a different parameter. In at least some embodiments, the overall size of the phased array antenna system may be decreased, because the array operating at one value of a parameter does not significantly interact with the other arrangements operating at a different value of the parameter.

Several illustrative, non-exclusive combinations of the values of the parameters for the arrays of antennas elements are provided in Table 1 below.

TABLE 1

VARIOUS PARAMETERS FOR ARRAYS OF ANTENNA ELEMENTS

| Antenna elements | Frequency | RX/TX | Polarization angle | Beam direction | Time multiplexing |
|---|---|---|---|---|---|
| 100-1 | f1 | RX | α1 | Θ1 φ1 | all times |
| 100-2 | f2 | RX | α1 | Θ1 φ1 | all times |
| 100-3 | f3 | TX | β1 | Θ1 φ1 | all times |
| 100-4 | f4 | TX | β1 | Θ1 φ1 | all times |
| 100-5 | f1 | RX | α1 | Θ2 φ2 | all times |
| 100-6 | f2 | RX | α1 | Θ2 φ2. | all times |
| 100-7 | £3 | TX | β1 | Θ2 φ2. | all times |
| 100-8 | f4 | TX | β1 | Θ2 φ2 | all times |

Figure 12A:
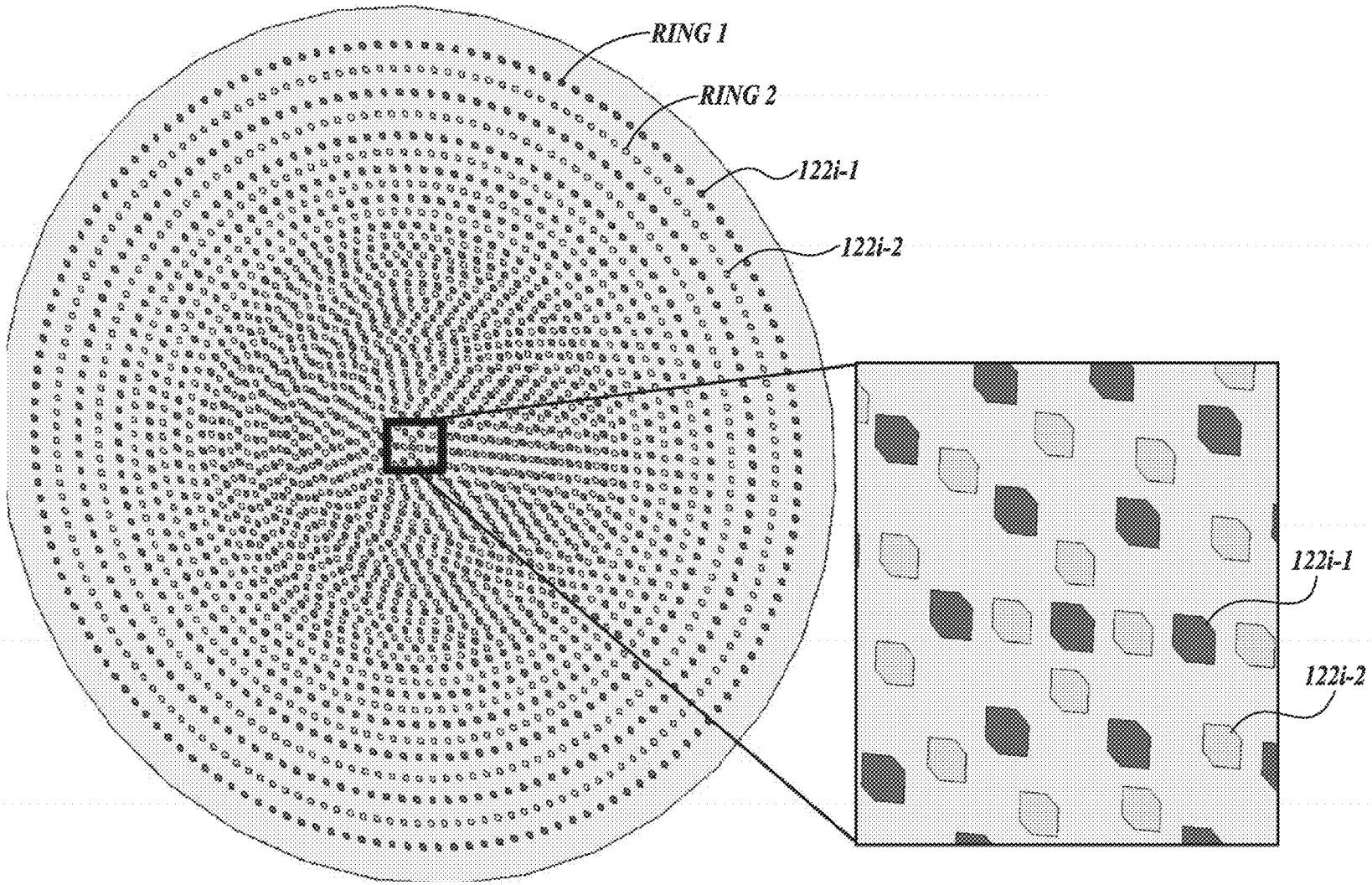
FIG. 12A is a schematic layout of an interspersed antenna lattice having two antenna arrays in a phased array antenna system in accordance with one embodiment of the present technology.
Figure 12B:
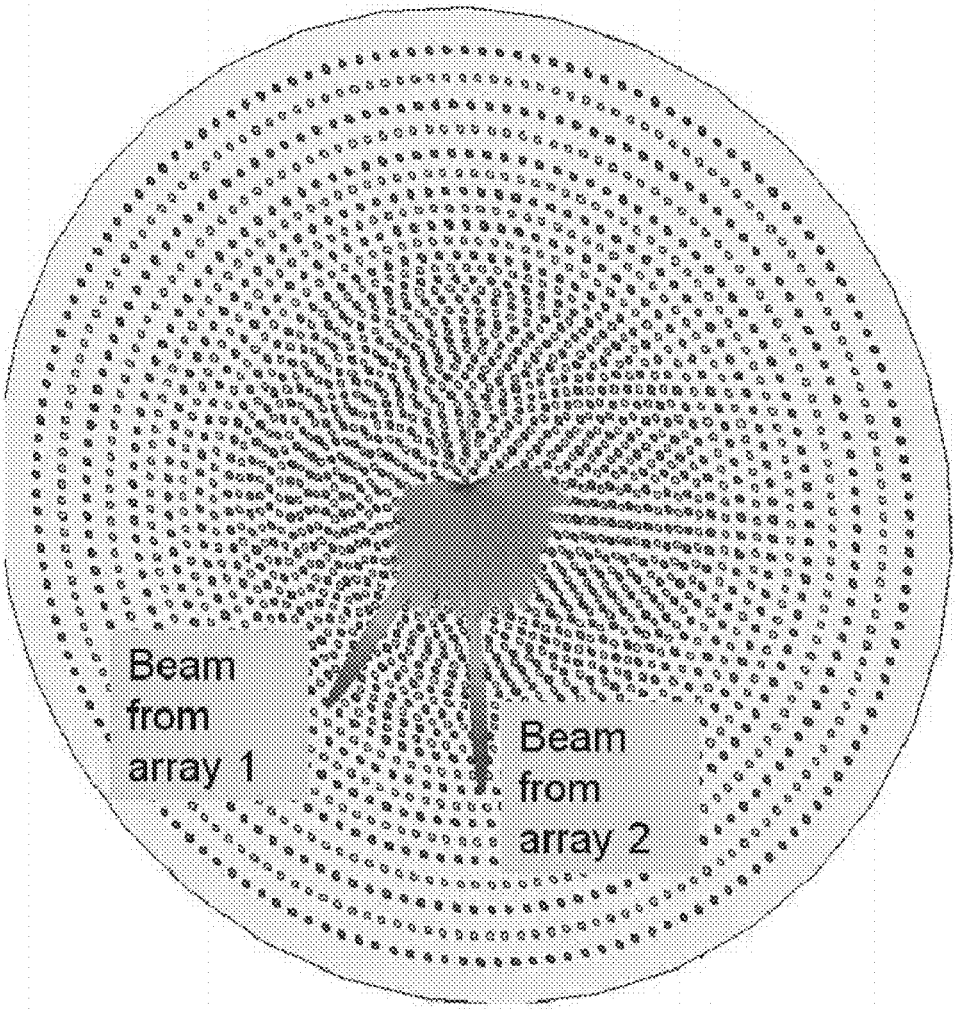
FIG. 12B is a schematic layout of the interspersed antenna lattice in a phased array antenna system of FIG. 12A showing the beam from the first array of antenna elements and the beam from the second array of antenna elements in accordance with one embodiment of the present technology.
Figure 12C:
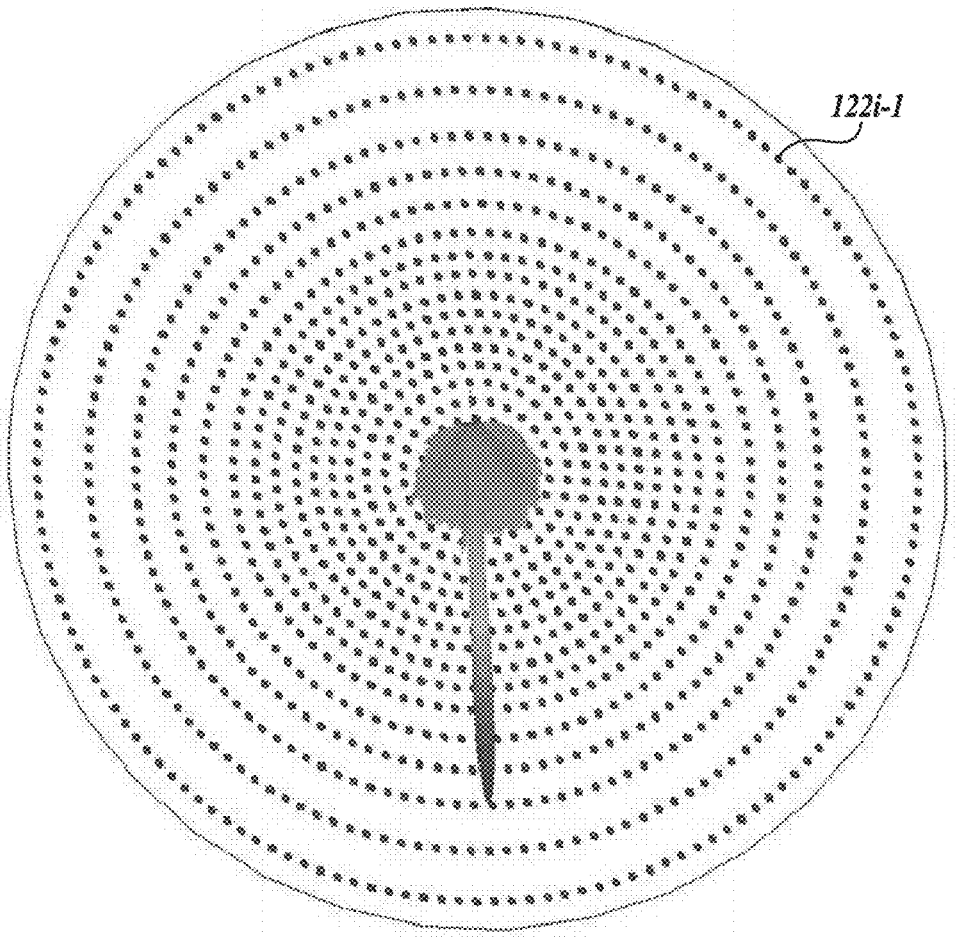
FIG. 12C is a schematic layout of a non-interspersed antenna lattice in a phased array antenna system a single beam from the array of antenna elements in accordance with one embodiment of the present technology.

FIG. 12 is a schematic layout of an antenna aperture of a phased array antenna system in accordance with one embodiment of the present technology. In the illustrated embodiment of FIG. 12, the interspersing configuration is incorporated into a space-tapered configuration of antenna elements. The outermost grouping of antenna elements, labeled RING 1, is in a circular arrangement and includes the antenna elements 122*i*-1 that operate at the first value of a parameter (e.g., frequency f1). The second outermost grouping of antenna elements labeled RING 2 the antenna elements 122*i*-2 that operate at the second value of the parameter (e.g., frequency f2). In the illustrated embodiment, the antenna elements of the second grouping 122*i*-2 are interspersed with the antenna elements of the first grouping 122*i*-2. (Compare an antenna aperture in FIG. 12C having only one grouping of antenna elements 122*i*-1.) Closer to the center of the antenna aperture, the antenna elements 122*i*-1 and 122*i*-2 of the different groups are more closely arranged and may not be in circular ring. In the illustrated embodiment, the first array of antenna elements 122*i*-1 includes 1214 antenna elements and the second interspersed array of antenna elements 122*i*-2 includes 1283 antenna elements.

With the illustrated arrangements RING1 and RING2, the interspersing of the antenna elements is highly regular, i.e., an antenna element that operates at one value of the parameter (e.g., an antenna element 122*i*-1) is always flanked with the antenna elements that operate at another value of the parameter (e.g., antenna elements 122*i*-2). However, different types of interspersing are also within the scope of the present disclosure. For example, several antenna elements of one value of the parameter (e.g., antenna elements 12*i*-1) may be grouped together and not each flanked by antenna elements that operate at a different value of the parameter (e.g., antenna elements 122*i*-2). Furthermore, the arrangements RING1, RING2, etc., may have different shapes, e.g., rectangular, elliptical, trapezoidal, etc. The arrangements may be non-intersecting, but in other embodiments the arrangements may intersect. Further, the arrangements may be concentric, as illustrated in FIG. 12A, but in other embodiments the arrangements may non-concentric.

FIG. 12B is a schematic view of the interspersed antenna aperture of FIG. 12A showing first and second beams BEAM1 and BEAM2 emitting from the antenna aperture in accordance with an embodiment of the present technology. In the illustrated embodiment, the phased array antenna 1000 receives/transmits RF beams a first beam BEAM1 at a first frequency from the first grouping of antenna elements and a second beam BEAM2 at a second frequency different from the second grouping of antenna elements, which is different from the first frequency of the first grouping of antenna elements. For example, the phased array antenna may transmit BEAM1 at frequency while receiving BEAM2 at frequency $f_2$. Other numbers of beams and combinations of parameters are also within the scope of the present disclosure.

In general, the undesirable interactions among the beams are reduced because the interspersed antenna elements operate at different values of one or more parameters. Because the interspersed antenna elements operate at different values of one or more parameters (e.g., different frequencies) interference is reduced, the antenna elements can be more densely arranged on the antenna aperture. The result is an increased number of beams from the same antenna aperture. Comparatively, referring to FIG. 12C, an antenna aperture having a single grouping of antenna elements at a single parameter are spaced less densely and emit only a single beam BEAM 1.

The antennal elements are spaced on the antenna aperture to avoid coupling, but also to maximize the use of landscape of the carrier. When antenna elements are interspersed and operating at a different frequency than adjacent antenna elements, the degree of coupling between adjacent antenna elements is reduced. In one embodiment of the present disclosure, less than −14 dB of coupling between interspersed array is desirable. In another embodiment, less than −12 dB of coupling between interspersed array is desirable.

Spacing between antenna elements is a balance between acceptable coupling and maximization of the landscape of the carrier. Spacing is also a function of frequency. At higher frequencies, less spacing is needed between antenna elements.

In addition to spacing between interspersed antenna elements, channel separation between the groupings of interspersed antenna elements may further reduce interference between the groupings, in accordance with embodiments of the present disclosure. In a non-limiting example, in a Ku-Band downlink of 10.7 GHz to 12.75 GHz, having a total spread of 2.05 GHz, the frequency allocation may be divided into four channels: 10.7 to 11.2 GHz; 11.2 to 11.7 GHz; 11.7 to 12.2 GHz; and 12.2 to 12.7 GHz. If there are two antenna apertures on the satellite, each having two groupings of interspersed antennas, then the frequency channels can be allocated to reduce cross-talk between the groupings. Table 1 below provides an exemplary channel configuration a Ku-Band downlink of 10.7 GHz to 12.75 GHz, having a total spread of 2.05 GHz. When divided into four channels, each channel represents 500 MHz.

TABLE 1

Four Channels in Ku-Band downlink of 10.7 GHz to 12.75 GHz
FREQUENCY ALLOCATION FOR 10.7 GHZ TO 12.75 GHZ BAND

| Channel 1 | Channel 2 | Channel 3 | Channel 4 |
|---|---|---|---|
| 10.7 to 11.2 GHz | 11.2 to 11.7 GHz | 11.7 to 12.2 GHz | 12.2 to 12.7 GHz |
| Panel 1; Array 1 | Panel 2; Array 1 | Panel 1; Array 2 | Panel 2 Array 2 |

In other non-limiting example, the same band may be divided into eight channels with each channel representing 250 MHz

TABLE 2

Eight Channels in Ku-Band downlink of 10.7 GHz to 12.75 GHz
Frequency Allocation For 10.7 GHz to 12.7 GHz Band

| Ch 1 | Ch 2 | Ch 3 | Ch 4 | Ch 5 | Ch 6 | Ch 7 | Ch 8 |
|---|---|---|---|---|---|---|---|
| 10.825 250 MHz Panel 1; Array 1 | 11.075 250 MHz Panel 2; Array 1 | 11.325 250 MHz Panel 1; Array 2 | 11.575 250 MHz Panel 2; Array 2 | 11.825 250 MHz Panel 1; Array 3 | 12.075 250 MHz Panel 2; Array 3 | 12.325 250 MHz Panel 1; Array 4 | 12.575 250 MHz Panel 2; Array 4 |

In a non-limiting example, the antenna elements may be divided between two panels, Panel 1 and Panel 2, each having two different types of antenna modules.

Frequency planning can be used to increase the fractional bandwidth between interspersed antenna elements on the same side of a carrier.

In the illustrated example of an 4-channel case (TABLE 1 above), the following frequency planning can be used to establish at least a 500 MHz guard band difference between operational bands of interspersed antenna elements on the same side of a carrier. In this example (e.g. Ch-1 & Ch-3 on Panel-1), the fractional guardband is 500 MHz divided by the center frequency (11.45 GHz) of the channel pair which equals 4.4%.

In the illustrated example of an 8-channel case (TABLE 2 above), the following frequency planning can be used to establish at least a 750 MHz guard band difference between operational bands of interspersed antenna elements. In this example (e.g. Ch-1 & Ch-5 on AIP-1), the fractional guardband is 750 MHz divided by the center frequency (11.325 GHz) of the channel pair which equals 6.6%.

Figure 13:
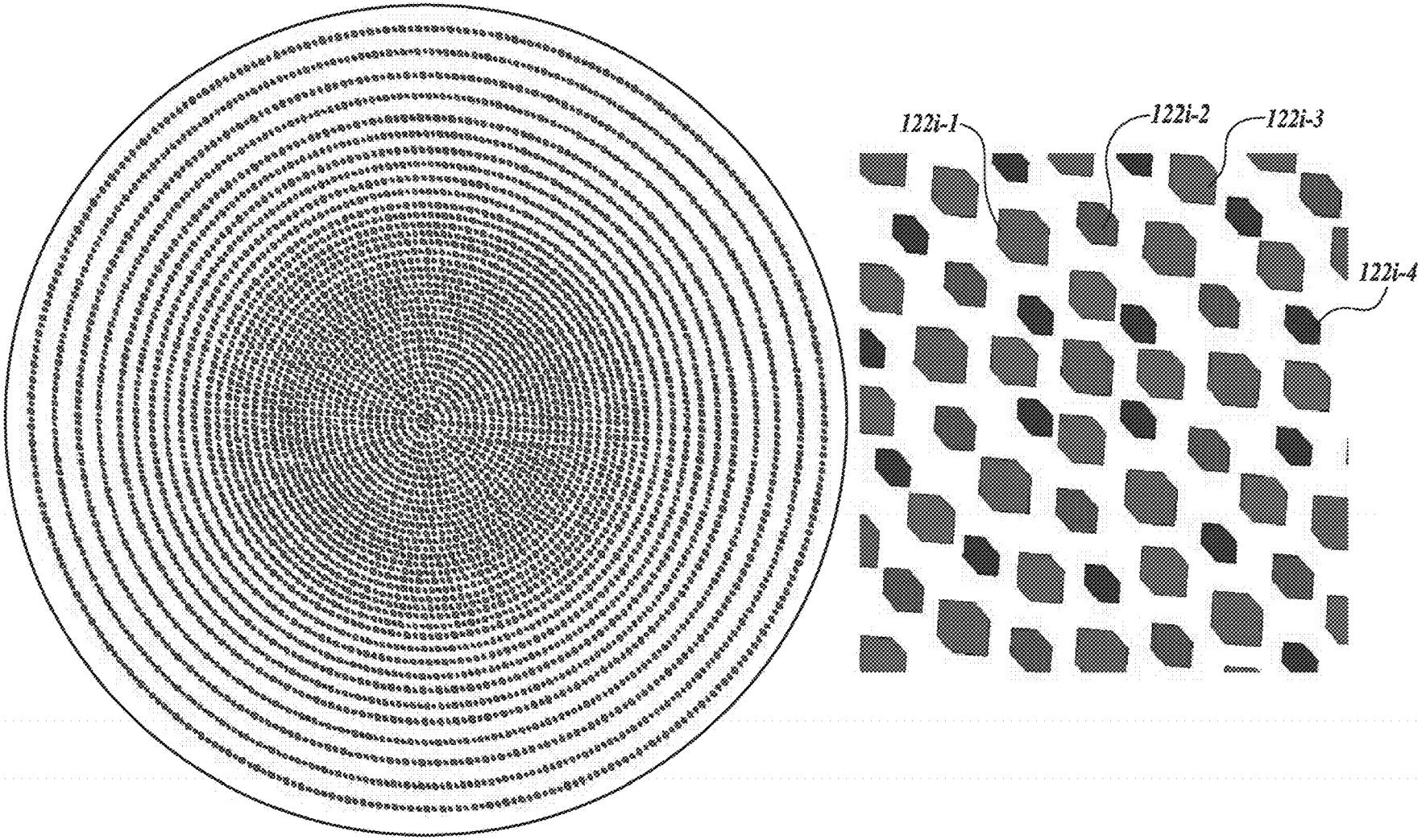
FIG. 13 is a schematic layout of an interspersed antenna lattice having four antenna arrays in a phased array antenna system in accordance with one embodiment of the present technology.
Figure 14:
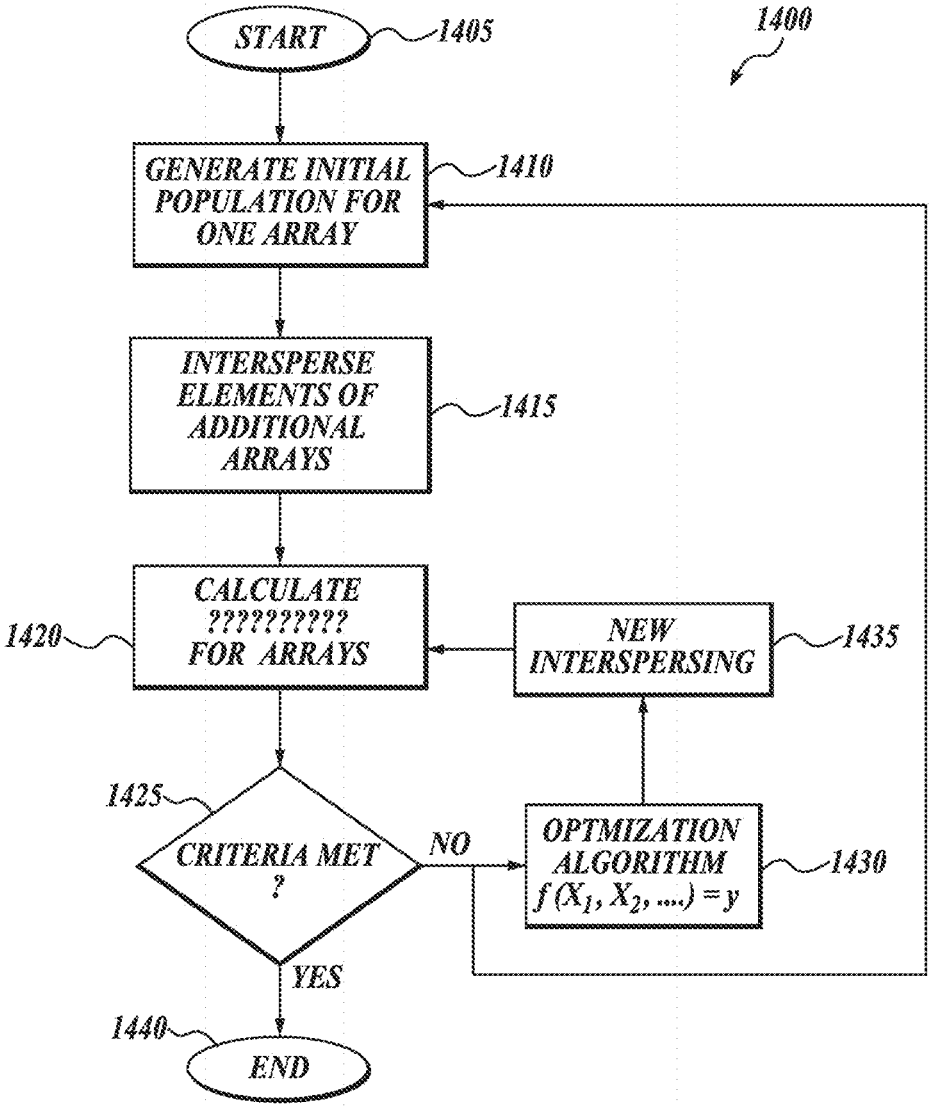
FIG. 14 is a flow chart of a method for interspersed phased array antenna design in accordance with an embodiment of the present technology.

FIG. 13 shows interspersing of four groupings of antenna elements.

FIG. 16 is a flow chart of a method for phased array antenna design in accordance with an embodiment of the present technology. The method starts at step 1405. At step 1410, an initial population (distribution) is defined for a group of the antenna elements (an array or an arrangement) that is configured to operate at one value of the parameter.

At step 1415, the individual antenna elements of one or more additional groups of antenna elements (arrays) are interspersed with the antenna elements of the initial population.

At step 1420, one or more estimates of the performance of the interspersed phased array antenna are determined. Possible measures of the performance are return loss parameters ($S_{LL}$), sidelobe levels for the beams, gain of the antenna, directivity of the beams, beam width, and scan range for the antenna.

At step 1425, one or more estimates of the effectiveness of the antenna are compared with predetermined criteria. If the criteria is not met, the method may either go back to step 1410 to start with new initial population, or go to step 130 to optimize the interspersing of the additional arrays. For example, at step 130 optimization algorithms may be used to optimize the interspersing of the additional arrays.

At step 1435, new interspersing (as derived from the optimization algorithm) is implemented. At step 1420, the estimates of performance are recalculated using the new interspersing, followed by the new verification whether the criteria is met at step 1425. If the criteria are met, the method may end at step 1440.

Rotation of Antenna Elements for Purity Polarization

With reference to FIGS. 15A-17, in accordance with embodiments of the present disclosure, antenna elements in an antenna lattice may be rotated relative to one another to improve the signal performance of the antenna aperture. There are two components of circular polarization: co-polarization and cross-polarization. Co-polarization is generally desired and cross-polarization is generally undesired. Physical rotation of antenna elements in an antenna lattice relative to one another can effectively cancel or reduce cross-polarization components to achieve high polarization purity and/or desired polarization characteristics. High polarization purity (or low cross-polarization) of an antenna system improves signal strength and decreases leakage from the main beam B (see FIGS. 1A and 1B).

In some embodiments of the present disclosure, individual antenna elements 122*i* may be rotated about a centerline (e.g., rotated about an axis of the antenna element that is perpendicular to the plane of the carrier 112) to realize high polarization purity when the antenna aperture 110 is receiving or emitting signals.

Figure 15A:
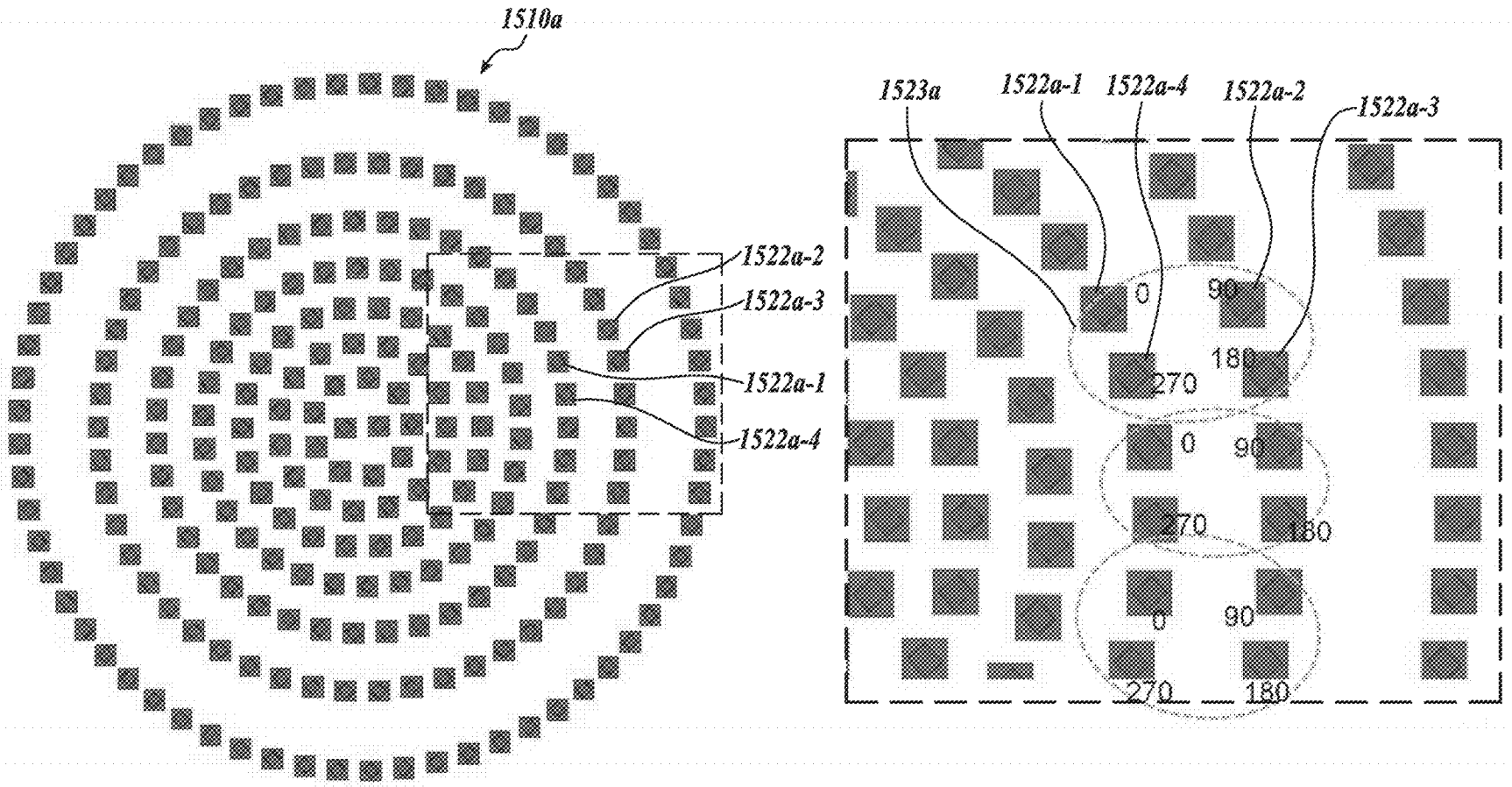

With reference to FIG. 15A, an antenna lattice 1510*a* of antenna elements 1522*a* having a space taper configuration is provided. The antenna elements 1522*a* of the antenna lattice 1510*a* are grouped into sequential rotational groupings 1523*a* of four antenna elements 1522*a*-1, 1522*a*-2, 1522*a*-3, and 1522*a*-4 with two of the elements in one ring of the space taper lattice and two of the elements in an adjacent ring of the space taper lattice, defining a rectangular-shaped grouping. The antenna elements 1522*a*-1, 1522*a*-2, 1522*a*-3, 1522*a*-4 are each physically rotated by 90 degrees relative to each other traveling in a circular pattern around the grouping.

In some embodiment, all the antenna elements in a grouping are structurally identical to each other. In some embodiments, not all the antenna lattice elements are in sequential rotational groupings.

In addition to physical rotation of the antenna elements, high polarization purity can be realized if the antenna elements are electrically excited by the same amount of electrical phase shift. For example, referring to FIG. 15A, adjacent antenna elements 1522*a*-1, 1522*a*-2, 1522*a*-3, 1522*a*-4 in each sequential rotational grouping 1523*a* may be electrically excited by 90 degrees electrical phase shift between each antenna element.

By providing such physical rotation and electrical phase shift, sequentially rotated antennas in a space tapered configuration can provide high purity circularly polarized signals.

Other antenna lattices having other configurations besides a space tapered configuration, other sequential rotational groupings, and other physical rotation patterns of the antenna elements are within the scope of the present disclosure. Referring to FIG. 15B, a portion of a 2-D array of antenna elements 1522*b* is provided. The antenna elements 1522*b* of the antenna lattice 1510*b* are grouped into sequential rotational groupings 1523*b* of four antenna elements 1522*b*-1, 1522*b*-2, 1522*b*-3, and 1522*b*-4 defining a rectangular-shaped grouping. The antenna elements 1522*b*-1, 1522*b*-2, 1522*b*-3, and 1522*b*-4 are each physically rotated by 90 degrees relative to each other traveling in a circular pattern around the grouping. Likewise, adjacent antenna elements 1522*a*-1, 1522*a*-2, 1522*a*-3, 1522*a*-4 in the sequential rotational grouping 1523*a* may be electrically excited by 90 degrees electrical phase shift between each antenna element.

Referring to FIG. 15C, a portion of a 2-D offset array of antenna elements 1522*c* is provided. The antenna elements 1522*c* of the antenna lattice 1510*c* are grouped into sequential rotational groupings 1523*c* of three antenna elements 1522*c*-1, 1522*c*-2, and 1522*c*-3 defining a triangular-shaped grouping. The antenna elements 1522*c*-1, 1522*c*-2, and 1522*c*-3, are each physically rotated by 120 degrees relative to each other traveling in a circular pattern around the grouping. Likewise, adjacent antenna elements 1522*c*-1, 1522*c*-2, and 1522*c*-3 in the sequential rotational grouping 1523*c* may be electrically excited by 120 degrees electrical phase shift between each antenna element.

Referring to FIG. 15D, a portion of a 2-D array of antenna elements 1522*d* is provided. The antenna elements 1522*d* of the antenna lattice 1510*d* are grouped into sequential rotational groupings 1523*d* of nine antenna elements 1522*d*-1, 1522*d*-2, 1522*d*-3, 1522*d*-4, 1522*d*-5, 1522*d*-6, 1522*d*-7, 1522*d*-8, and 1522*d*-9. The antennas are each physically rotated by 40 degrees relative to each other traveling in a non-circular pattern though the grouping. Likewise, adjacent antenna elements in the sequential rotational grouping 1523*d* may be electrically excited by 40 degrees electrical phase shift between each antenna element.

Other sequential rotation schemes are within the scope of the present disclosure. For example, adjacent antenna elements may be polarized at 0°, 90°, 0°, and 90°.

In designing sequential rotational groupings in accordance with embodiments of the present disclosure, a trade-off is considered between generation of high purity circularly polarized signals by using a greater number of antenna elements within a sequential rotational grouping and the signal degradation which may occur as a result of the grouping size (e.g., the planar area associated with the grouping) increasing as the number of antenna elements within the grouping increases. The number of antenna elements in a sequential rotational grouping is independent of the type of lattice arrangement, e.g., whether the lattice is a space tapered lattice or a 2-D array.

Figure 16A:
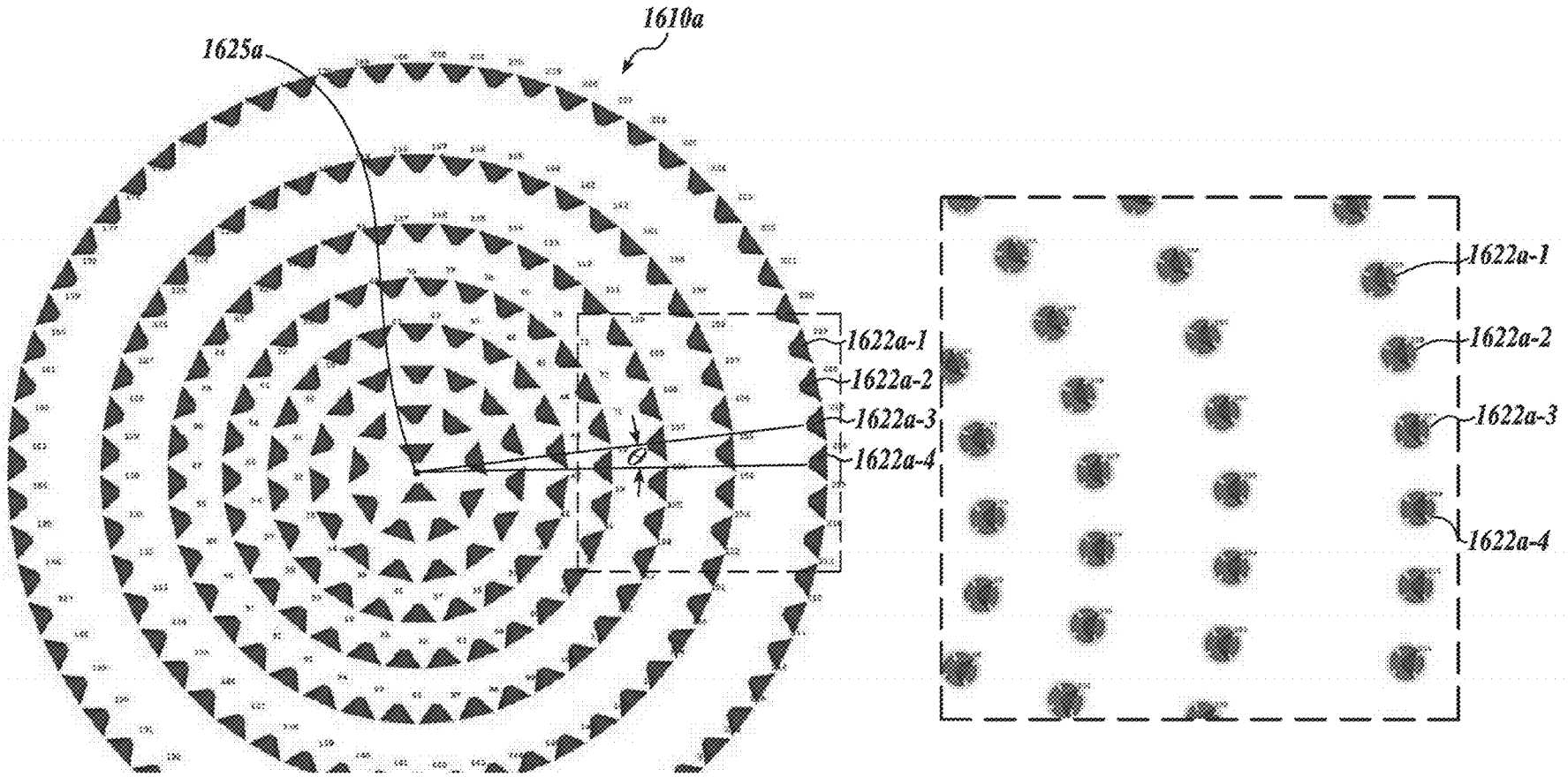
FIGS. 16A and 16B are schematic layouts of an antenna lattice including antenna rotation schemes for polarization purity in accordance with other embodiments of the present disclosure.

With reference to FIG. 16A, another antenna lattice 1610*a* of antenna elements 1622*a* having a space taper configuration is provided. In the embodiment of FIG. 16A, the antenna elements 1622*a* of the antenna lattice 1610*a* are progressively rotated relative to each other for polarization purity. For example, antenna elements 1622*a*-1, 1622*a*-2, 1622*a*-3, and 1622*a*-4 are each physically rotated by the same degree of angular rotation θ relative to each other traveling in a circular pattern around the center axis 1625*a* of the antenna lattice 1610*a*. In some embodiments, adjacent antenna elements in the progressive rotation may be electrically excited by e degrees electrical phase shift between each antenna element.

The arrows in the antenna elements 1622*a*-1, 1622*a*-2, 1622*a*-3, and 1622*a*-4 are used to show the direction of orientation of the antenna elements relative to each other. In the illustrated embodiment, all the arrows are pointing toward the center axis 1625 of the antenna lattice 1610*a*. However, other directions are also within the scope of the present disclosure so long as the antenna elements are progressively rotated relative to each other by the same degree of angular rotation θ. The degree of angular rotation in a given ring is 360 degrees divided by the number of antenna elements in that ring. All rings will have progressive rotation, with the degree of angular rotation for each ring in accordance with the formula above. Inner rings have smaller number of elements. Therefore, the degree of angular rotation is larger for inner rings compared to outer rings.

Figure 16B:
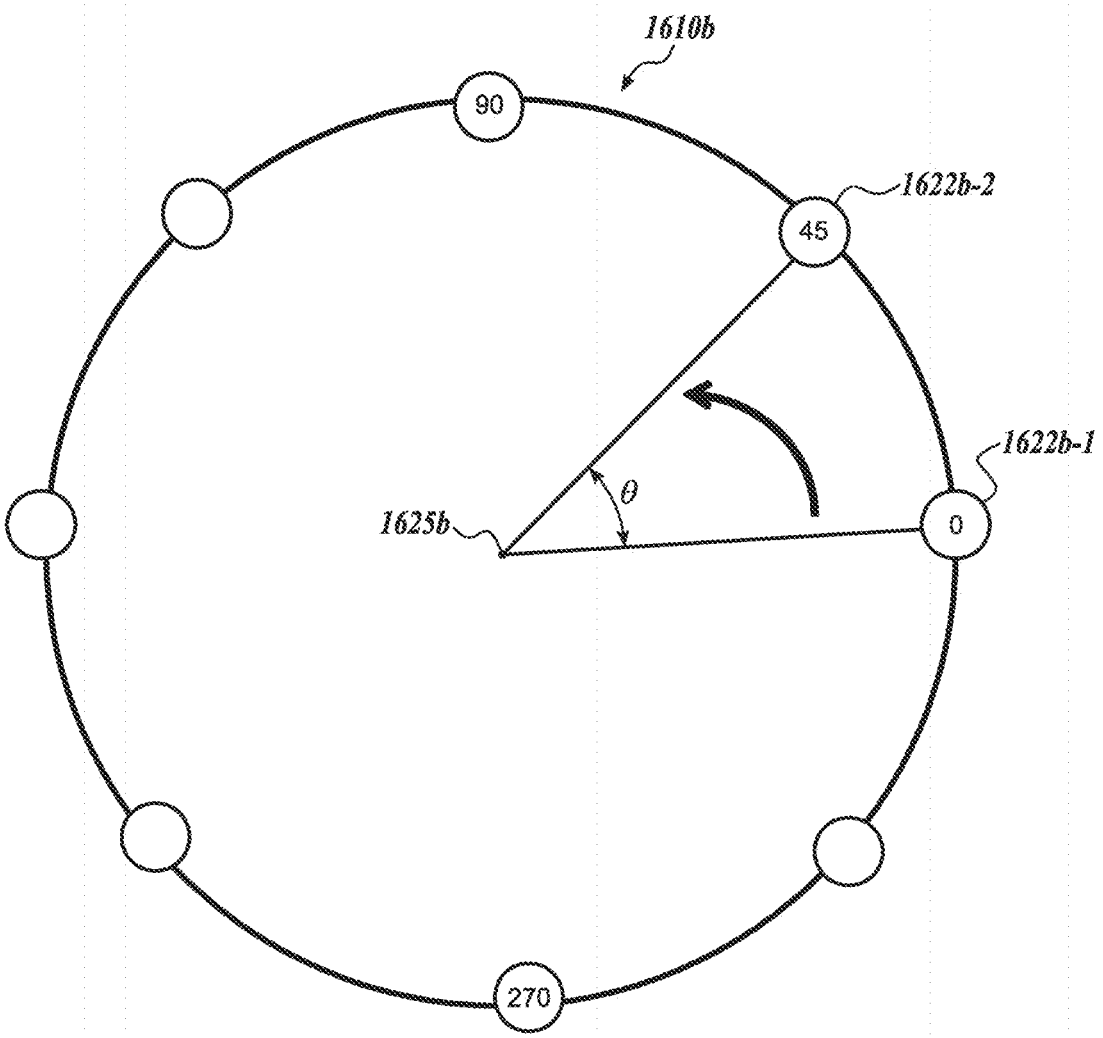

Referring to FIG. 16B, in a non-limiting example of progressive rotation for polarization purity, adjacent antenna elements 1622*b*-1 and 1622*b*-2 are rotated by a degree of angular rotation θ, wherein θ=45 degrees. In some embodiments, adjacent antenna elements in the progressive rotation may be electrically excited by e degrees electrical phase shift between each antenna element.

In the embodiments of FIGS. 16A and 16B, the antenna lattices 1610*a* and 1610*b* are arranged in circular patterns. However, the antenna lattices 1610*a* and 1610*b* need not be space tapered lattices.

Figure 17:
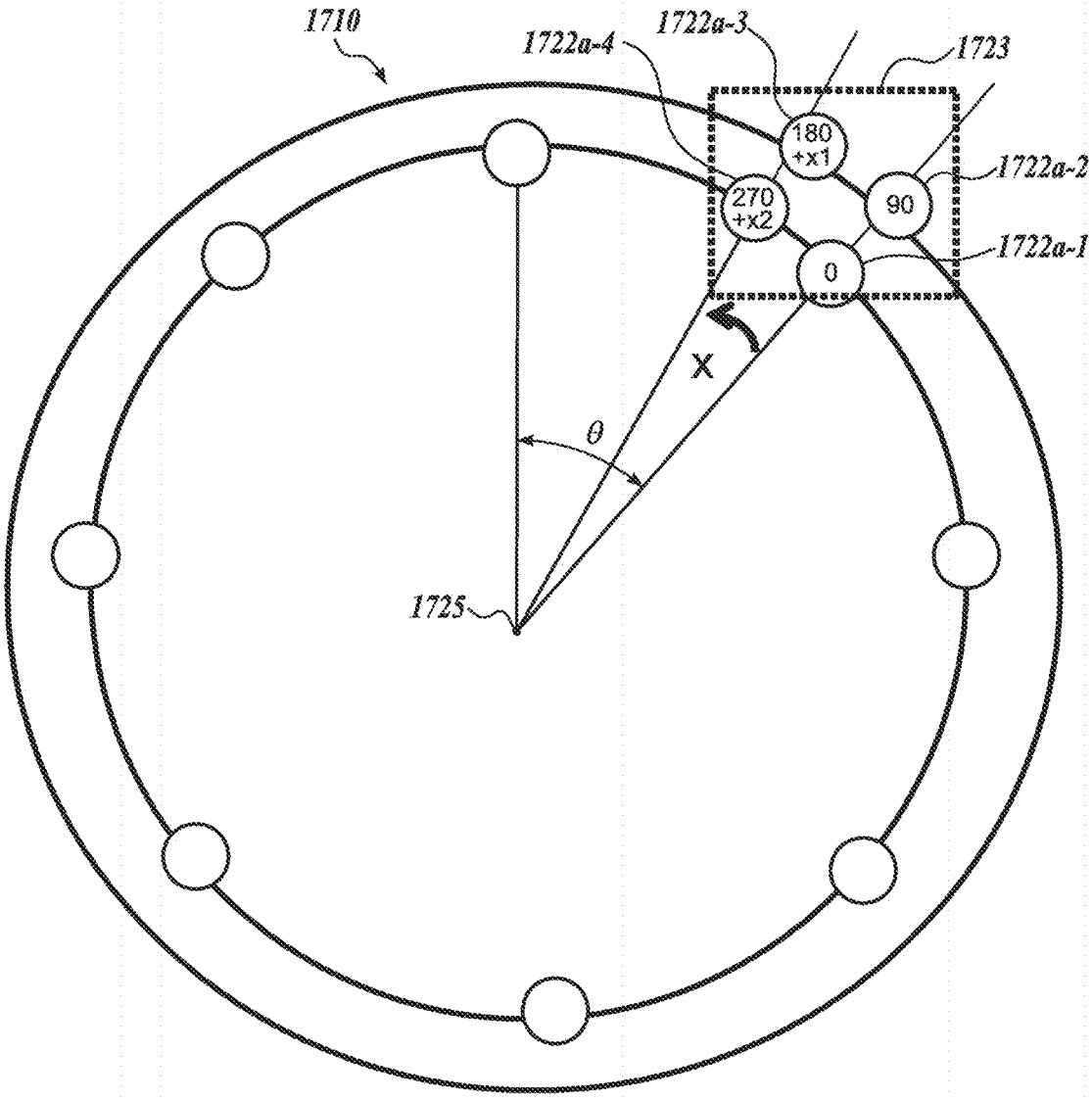
FIG. 17 is a schematic layout of an antenna lattice including an antenna rotation scheme for polarization purity in accordance with other embodiments of the present disclosure.

Referring to FIG. 17, an example of combination sequential and progressive rotation is provided. In the embodiment of FIG. 17, the antenna elements 1722 of the antenna lattice 1710 are grouped into sequential rotational groupings 1723 of four antenna elements 1722*a*-1, 1722*a*-2, 1722*a*-3, and 1722*a*-4 with two of the elements in an outer ring of the space taper lattice and two of the elements in an inner ring of the space taper lattice, defining a rectangular-shaped grouping. The antenna elements 1722*a*-1, 1722*a*-2, 1722*a*-3, and 1722*a*-4 are each physically rotated by 90 degrees relative to each other traveling in a circular pattern around the grouping, as per the sequential rotation scheme discussed above. Likewise, adjacent antenna elements 1722*a*-1, 1722*a*-2, 1722*a*-3, 1722*a*-4 in each sequential rotational grouping 1723 may be electrically excited by 90 degrees electrical phase shift between each antenna element.

In addition to sequential rotational groupings 1723, the groupings 1723 or antenna elements 1722 of the antenna lattice 1710 themselves are progressively rotated relative to each other for polarization purity. For example, other groupings adjacent grouping 1723 are each physically rotated by the same degree of angular rotation θ relative to each other traveling in a circular pattern around the center axis 1725 of the antenna lattice 1710. Likewise, adjacent antenna elements in the progressive rotation may be electrically excited by e degrees electrical phase shift between each antenna element.

Antenna elements 1722*a*-1, 1722*a*-2, 1722*a*-3, 1722*a*-4 in each sequential rotational grouping 1723 may have rotational adjustment as a function of angular rotation offset x between adjacent antenna elements in a grouping. For example, the physical rotation of antenna elements 1722*a*-1, 1722*a*-2, 1722*a*-3, 1722*a*-4 would be 0, 90, 180, and 270 degrees, respectively, relative to each other based on sequential rotation scheme alone. With the addition of progressive rotation, antenna element 1722*a*-*c* is rotated a total of 180+x1 degrees rather than 180 degrees. The rotational adjustment of x1 degrees applies the progressive rotation between adjacent antenna elements within a given ring, in this case, between antenna elements 1722*a*-2 and 1722*a*-3. Likewise, antenna element 1722*a*-4 is rotated a total of 270+x2 degrees rather than 270 degrees. Values x1 and x2 are calculated based on the equation discussed above for progressive rotation.

While illustrative embodiments have been illustrated and described, it will be appreciated that various changes can be made therein without departing from the spirit and scope of the disclosure.

The invention claimed is:

1. A phased array antenna, comprising:

a carrier;

a first plurality of antenna elements carried by the carrier, distributed in a first geometric pattern on the carrier, and configured to transmit and/or receive signals at a first value of a parameter; and a second plurality of antenna elements carried by the carrier, distributed in a second geometric pattern on the carrier, and configured to transmit and/or receive signals at a second value of the parameter different from the first value of the parameter, wherein antenna elements of the first plurality of antenna elements and the second plurality of antenna elements are located interspersed within a common aperture of the phased array antenna, and wherein the second geometric pattern is rotated with respect to the first geometric pattern.

2. The phased array antenna of claim 1, wherein the first value of the parameter is a first frequency and the first plurality of antenna elements is configured to transmit signals at the first frequency, and wherein the second value of the parameter is a second frequency, different from the first frequency, and the second plurality of antenna elements is configured to receive signals at the second frequency.

3. The phased array antenna of claim 1, wherein the parameter is selected from a group consisting of frequency, polarization, beam orientation, data streams, time multiplexing segments, and combinations thereof.

4. The phased array antenna of claim 1, wherein the antenna elements of the first and second pluralities of antenna elements are configured to transmit and/or receive signals at least in part during a same period of time.

5. The phased array antenna of claim 1, wherein the first geometric pattern and the second geometric pattern are in circular or rectangular configurations.

6. The phased array antenna of claim 1, wherein the first geometric pattern and the second geometric pattern are concentric configurations.

7. The phased array antenna of claim 1, wherein the first geometric pattern and the second geometric pattern are non-concentric configurations.

8. The phased array antenna of claim 1, wherein the first geometric pattern and/or the second geometric pattern are in space tapered arrangements.

9. The phased array antenna of claim 1, wherein the first geometric pattern receives or transmits a first beam in a first direction and the second geometric pattern receives or transmits a second beam in a second direction.

10. The phased array antenna of claim 1, wherein the first plurality of antenna elements is included in a first array of antenna elements including N antenna elements and the second plurality of antenna elements is included in in a second array of antenna elements including M antenna elements, wherein N and M are different.

11. The phased array antenna of claim 10, wherein the first array of antenna elements occupies a first area within the common aperture and the second array of antenna elements occupies a second area within the common aperture and wherein the first area is contained within the second area.

12. A phased array antenna, comprising:

a carrier;

a first plurality of antenna elements carried by the carrier and configured to transmit and/or receive signals at a first value of a parameter;

a second plurality of antenna elements carried by the carrier and configured to transmit and/or receive signals at a second value of the parameter different from the first value of the parameter, wherein antenna elements of the first plurality of antenna elements and the second plurality of antenna elements are located within a common aperture of the phased array antenna; and a third plurality of antenna elements carried by the carrier and configured to transmit and/or receive signals at a third value of the parameter different from the first and second values of the parameter, wherein individual antenna elements of the first, second, and third pluralities of antenna elements are interspersed.

13. The phased array antenna of claim 12, wherein individual antenna elements of the first plurality of antenna elements and the second plurality of antenna elements are interspersed.

14. The phased array antenna of claim 12, wherein the antenna elements of the first plurality are distributed in a first arrangement, and the antenna elements of the second plurality are distributed in a second arrangement.

15. A phased array antenna system, comprising:

a carrier;

a first plurality of antenna elements carried by the carrier and configured to transmit signals; and a second plurality of antenna elements carried by the carrier and configured to receive signals, wherein:

the second plurality of antenna elements are distributed in a second geometric pattern, the first plurality of antenna elements are distributed in a first geometric pattern that is enclosed by the second geometric pattern, and antenna elements of the first plurality of antenna elements and the second plurality of antenna elements are interspersed within a common aperture of the phased array antenna system.

16. The phased array antenna system of claim 15, wherein the first plurality of antenna elements is included in a first array of antenna elements configured to transmit signals at a first frequency and the second plurality of antenna elements is included in a second array of antenna elements configured to receive signals at a second frequency, different from the first frequency.

17. The phased array antenna system of claim 16, wherein the first array of antenna elements includes N antenna elements and the second array of antenna elements includes M antenna elements.

18. The phased array antenna system of claim 17, wherein N and M are different.

19. The phased array antenna system of claim 16, wherein the first array of antenna elements occupies a first area within the common aperture and the second array of antenna elements occupies a second area within the common aperture and wherein the first area is contained within the second area.

20. A method of using a phased array antenna, comprising:

receiving or transmitting a first signal at a first value of a parameter using a first plurality of antenna elements of the phased array antenna; and receiving or transmitting a second signal at a second value of the parameter different from the first value of the parameter using a second plurality of antenna elements of the phased array antenna, wherein:

the first plurality of antenna elements is distributed in a first geometric pattern on a carrier;

the second plurality of antenna elements is distributed in a second geometric pattern on the carrier, the second geometric pattern being rotated with respect to the first geometric pattern, and antenna elements of the first plurality of antenna elements and the second plurality of antenna elements are interspersed within a common aperture of the phased array antenna.

21. The method of claim 20, wherein the first value of the parameter is a first frequency and the first plurality of antenna elements is configured to transmit signals at the first frequency, and wherein the second value of the parameter is a second frequency, different from the first frequency, and the second plurality of antenna elements is configured to receive signals at the second frequency.

22. A method of using a phased array antenna, comprising:

receiving or transmitting a first signal at a first value of a parameter using a first plurality of antenna elements of the phased array antenna;

receiving or transmitting a second signal at a second value of the parameter different from the first value of the parameter using a second plurality of antenna elements of the phased array antenna, wherein antenna elements of the first plurality of antenna elements and the second plurality of antenna elements are located within a common aperture of the phased array antenna; and receiving or transmitting a third signal at a third value of the parameter different from the first and second values of the parameter using a third plurality of antenna elements, wherein individual antenna elements of the first, second, and third pluralities of antenna elements are interspersed.

23. The method of claim 22, wherein the first plurality of antenna elements and the second array of antenna elements are interspersed within the common aperture.

* * * * *